US006289655B1

(12) United States Patent
Ridgeway et al.

(10) Patent No.: US 6,289,655 B1
(45) Date of Patent: Sep. 18, 2001

(54) PACKAGING STRUCTURE

(75) Inventors: Devin C. Ridgeway, Chula Vista; James R. Paonessa, San Diego, both of CA (US)

(73) Assignee: Sealed Air Corporation, Saddle Brook, NJ (US)

( * ) Notice: Subject to any disclaimer, the term of this patent is extended or adjusted under 35 U.S.C. 154(b) by 0 days.

(21) Appl. No.: 09/706,037

(22) Filed: Nov. 3, 2000

Related U.S. Application Data

(60) Division of application No. 08/947,566, filed on Oct. 9, 1997, now Pat. No. 6,148,590, which is a continuation-in-part of application No. 08/541,144, filed on Oct. 11, 1995, now Pat. No. 5,678,695.

(51) Int. Cl.[7] ..... B65B 23/00; B65D 81/02

(52) U.S. Cl. ..... 53/449; 53/456; 206/583; 206/591

(58) Field of Search ..... 53/449, 456; 206/305, 206/320, 426, 445, 446, 461, 466, 497, 521, 524.9, 583, 591, 594, 775, 776, 778, 779, 477–483

(56) References Cited

U.S. PATENT DOCUMENTS 2,031,381 2/1936 McCallum .
2,707,553 5/1955 Yount .

(List continued on next page.)

FOREIGN PATENT DOCUMENTS 691904 8/1964 (CA) .
59982/1974 5/1974 (JP) .
77087/1974 7/1974 (JP) .
88376/1975 7/1975 (JP) .
102778/1975 8/1975 (JP) .
107583/1975 9/1975 (JP) .
177969/1982 11/1982 (JP) .
100158/1991 10/1991 (JP) .

*Primary Examiner*—Jim Foster
(74) *Attorney, Agent, or Firm*—Lerner, David, Littenberg, Krumholz & Mentlik, LLP

(57) ABSTRACT

A packaging structure for holding an object securely against a rigid backing. The structure includes a substantially rigid panel having a pair of fold lines defining respective folding side portions and a center portion. A flexible film material is superimposed on one surface of the rigid panel and extends onto at least one of the folding side portions. The ends of the film material are connected to the rigid panel, with at least one end connected to one of the folding side portions. The folding side portions include patterned cuts defining tabs which separate the film material from the center portion when the folding side portions are folded away from the film material.

17 Claims, 31 Drawing Sheets

U.S. PATENT DOCUMENTS

| | | | |
|---|---|---|---|
| 2,802,565 | 8/1957 | Kabbash . | |
| 2,919,797 | 1/1960 | McCracken . | |
| 3,089,590 | 5/1963 | Mell . | |
| 3,424,306 | 1/1969 | Munck . | |
| 3,437,198 | 4/1969 | Van Saun et al. . | |
| 3,507,383 | 4/1970 | Rorer . | |
| 3,540,579 | 11/1970 | Hellstrom . | |
| 3,669,337 | 6/1972 | Struble . | |
| 3,718,275 | 2/1973 | Willinger . | |
| 3,891,090 | 6/1975 | Spiegel et al. . | |
| 3,905,474 | 9/1975 | Haibara . | |
| 3,966,046 | 6/1976 | Deutschlander . | |
| 4,030,603 | 6/1977 | Angell . | |
| 4,182,224 | 1/1980 | Dutcher | 93/39 R |
| 4,285,432 | 8/1981 | de Villers et al. . | |
| 4,306,653 | 12/1981 | Fales . | |
| 4,307,804 | 12/1981 | Benham . | |
| 4,494,689 | 1/1985 | Ilitch . | |
| 4,606,460 | 8/1986 | Luray . | |
| 4,632,301 | 12/1986 | Slack | 206/292 |
| 4,757,900 | 7/1988 | Misset et al. . | |
| 4,852,743 | 8/1989 | Ridgeway . | |
| 5,086,925 | 2/1992 | Coalier et al. . | |
| 5,251,760 | 10/1993 | Smith et al. . | |
| 5,259,507 | 11/1993 | Smith . | |
| 5,323,896 | 6/1994 | Jones . | |
| 5,388,701 | 2/1995 | Ridgeway . | |
| 5,669,506 * | 9/1997 | Lofgren et al. | 206/583 |
| 5,694,744 | 12/1997 | Jones | 206/591 |
| 5,839,652 | 11/1998 | Ben-Haim | 229/240 |
| 5,855,317 | 1/1999 | Dalrymple | 229/186 |
| 5,894,932 | 4/1999 | Harding | 206/583 |
| 5,954,263 | 9/1999 | Posson | 229/186 |
| 5,967,327 | 10/1999 | Jones | 206/583 |

* cited by examiner

PACKAGING STRUCTURE

CROSS-REFERENCE TO RELATED APPLICATION

This is a divisional application of application Ser. No. 08/947,566, filed Oct. 9, 1997, now U.S. Pat. No. 6,148,590, which is a continuation-in-part of application Ser. No. 08/541,144, filed on Oct. 11, 1995, now U.S. Pat. No. 5,678,695.

FIELD OF THE INVENTION

The present invention relates to protective packaging structures, and relates more particularly to packaging structures wherein an object to be protected is held securely between a flexible film material and a rigid backing.

BACKGROUND OF THE INVENTION

Protective packaging structures are often used when an object to be packaged requires protection from physical shock, dust, dirt and other contaminants. For example, when shipping objects which may be relatively fragile, it is often desirable to package the object inside a box to protect the object from physical impacts to the box which may occur during loading, transit and unloading. In addition, when shipping objects such as computer components, it is often desirable to protect those components from dust and dirt.

Additionally, in most cases, some additional structure is used to keep an object within a box from moving uncontrollably in the box and thus incurring damage. Such additional structures include paper or plastic dunnage, structured plastic foams, and foam filled cushions, among others.

One useful form of packaging for especially fragile objects is referred to as suspension packaging, and examples are disclosed in U.S. Pat. No. 4,852,743 issued to Louis H. Ridgeway and U.S. Pat. No. 5,388,701 issued to Devin C. Ridgeway. In suspension packaging, the object is suspended between two sheets of plastic film material in a face-to-face relationship. The sheets are usually attached to frames which are sized to fit securely within a selected size box. Thus, the object is not in contact with any substantially rigid surfaces and is protected from physical shock. It is not necessary in all cases, however, for the object to be entirely suspended within the box, such as when packaging less fragile objects. In such cases, the extra space required for full suspension packaging becomes a less efficient use of materials.

A different type of packaging system is disclosed in U.S. Pat. No. 5,323,896 to Jones. The packaging system includes a sheet material of corrugated cardboard having a central fold line extending longitudinally along the sheet material, and two fold lines extending transversely thereto. A sleeve or tube made of a flexible and stretchable material is disposed around the sheet material and is of sufficient dimensions to fit in a flat condition loosely over the width of the sheet material. The sheet material is first folded along the central fold line, as shown in FIGS. 3 and 4, and the object to be packaged is inserted between the sheet material and the flexible tube. The end portions are then folded upwardly along the transverse fold lines into a generally perpendicular position to cause the sheet material to flatten out and hold the object against the sheet material. The assembly may then be placed in a box as shown in FIG. 6. To ensure that the object is securely held, the tube must be properly dimensioned to fit the particular object being packaged. Thus, objects that vary somewhat in size from the size for which the package is designed (i.e., slightly smaller objects), would not be held securely in the package.

Another type of packaging structure is illustrated in U.S. Pat. No. 4,307,804 to Benham and has a paperboard main panel with a cut-out and first and second side support panels defined by parallel hinge lines. A heat shrinkable film is bonded to the support panel so that the article to be packaged may be inserted in the manner shown in FIG. 3. The package must then be heated so that the heat shrinkable film draws the support panels together to secure the object being packaged.

OBJECT AND SUMMARY OF THE INVENTION

Therefore, it is an object of the present invention to provide a package that will successfully hold objects of various sizes against a substantially rigid backing with sufficient tension to cushion the objects and prevent uncontrolled movement of the objects so that they are protected from physical harm.

This invention meets this object with a substantially rigid panel having a pair of generally parallel fold lines adjacent to the opposite side edges of the panel. The fold lines thus define respective folding side portions and a center portion therebetween. A flexible film material having a first and second edge is superimposed on one surface of the rigid panel and extends over the center panel portion and past the fold lines onto the folding side portion of the rigid panel.

A means for securing the first edge of the film to the respective folding side portion of the rigid panel, such as a glue strip extending along the folding side portion, is also included. The means also cooperates with the folding side portions to tighten the film against objects between the film and the center panel portion when the folding side portions are folded away from the film.

A securing member is also included for securing the second edge of the film, which is not secured to the rigid panel. A respective one of the folding side portions includes a mating member, such as an aperture, configured to receive the securing member. Accordingly, objects may be positioned upon the center portion and the securing member may be mated with the mating member to secure the film to hold the object against the rigid panel. Various specific embodiments with other folds, cuts, etc. are described below.

The foregoing and other objects, advantages and features of the invention, and the manner in which the same are accomplished, will become more readily apparent upon consideration of the following detailed description of the invention taken in conjunction with the accompanying drawings, which illustrate preferred exemplary embodiments, and wherein:

DETAILED DESCRIPTION

Figure 2:
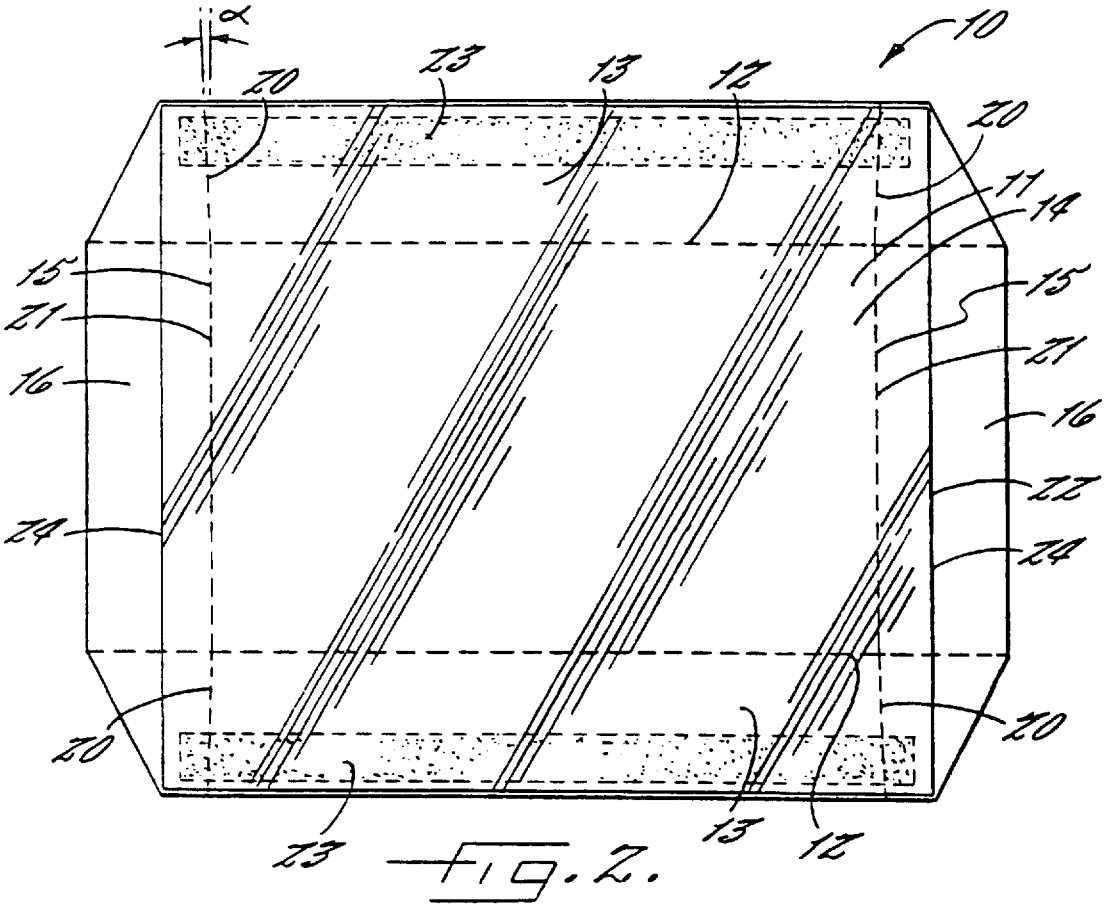
FIG. 2 is a plan view of the packaging structure in an unfolded state.

The packaging structure 10 according to the present invention includes a substantially rigid panel 11, as shown in planar form in FIG. 2. The panel 11, which will be generally rectangular or square depending on the application, may be formed of any substantially stiff but foldable material such as paperboard, cardboard or plastic. It will be appreciated that, although denominated as rigid, the chosen material would preferably have a certain amount of flexibility in the cases of extreme physical impact and that the use of very rigid materials, such as metals, may not be desirable. One preferred material is a single wall corrugated cardboard such as B-flute or E-flute corrugated cardboard.

The substantially rigid panel 11 may also include a pair of fold lines 12, usually scored, crimped or perforated, which are generally parallel and adjacent to the opposite side edges of the panel. These fold lines 12 thus define folding side portions 13 and a center portion 14 therebetween.

The packaging structure 10 may also include a second pair of fold lines 15, substantially parallel to one another and substantially perpendicular to the first pair of fold lines 12, that define respective folding end portions 16 in the rigid panel 11. The distal portions 20 of each of the second pair of fold lines 15 which extend onto the folding side portions 13 may be slightly offset by an acute angle relative to the portion 21 of the fold line extending over the center panel portion. The purpose of this offset, which is denoted by the angle $\alpha$ in FIG. 2, is to account for the finite thickness of the rigid material of the panel 11 when the side 13 and end 16 portions are folded, as will be understood from the discussion below.

A flexible film material 22 is superimposed on one surface of the rigid panel 11, and extends over the center panel portion 14. This flexible film material 22 is preferably a transparent and elastomeric polymer and in preferred embodiments may be formed of PVC (polyvinyl chloride) or polyurethane esther. By way of comparison, PVC film is generally less expensive and more transparent and may be more preferable for lightweight applications wherein a thickness of only 2–4 mils is necessary. Films made of polyurethane esther are generally more elastomeric, puncture resistant, and better suited for larger objects. Polyurethane esther is also generally less sensitive to temperature changes and more tacky which is useful for restraining the object from slippage. The polyurethane esther films may be manufactured with a slip agent, however, to control excessive tackiness. One particular preferred resin used in the manufacture of the film is SP876, a commercially available product of the BASF Company. It will be understood, of course, that a number of polymeric materials are suitable for the film material 22, and can be selected, and even custom designed, by those familiar with such materials without undue experimentation.

The packaging structure 10 also includes means for securing the film 22 to the folding side portions 13 of the rigid panel 11. In a preferred embodiment, the means constitutes a pair of glue strips 23 extending along the distal edge of the folding side portions 13 as shown in FIG. 2. Of course, it would be readily apparent to one of ordinary skill in the art that there are many other equivalent means which may be used to perform the functions of the glue strips 23. The glue strips 23 thus define two unsecured edge portions 24 of the film 22 generally adjacent to the folding end portions 16 of the panel 11 through which an object O to be packaged can be inserted between the film and the center panel portion 14.

The glue strips 23 also cooperate with the folding side portions 13 to tighten the film 22 against an object O between the film and the center panel portion 14 when the folding side portions are folded downwardly (i.e., away from the film) as discussed more fully below.

Figure 1:
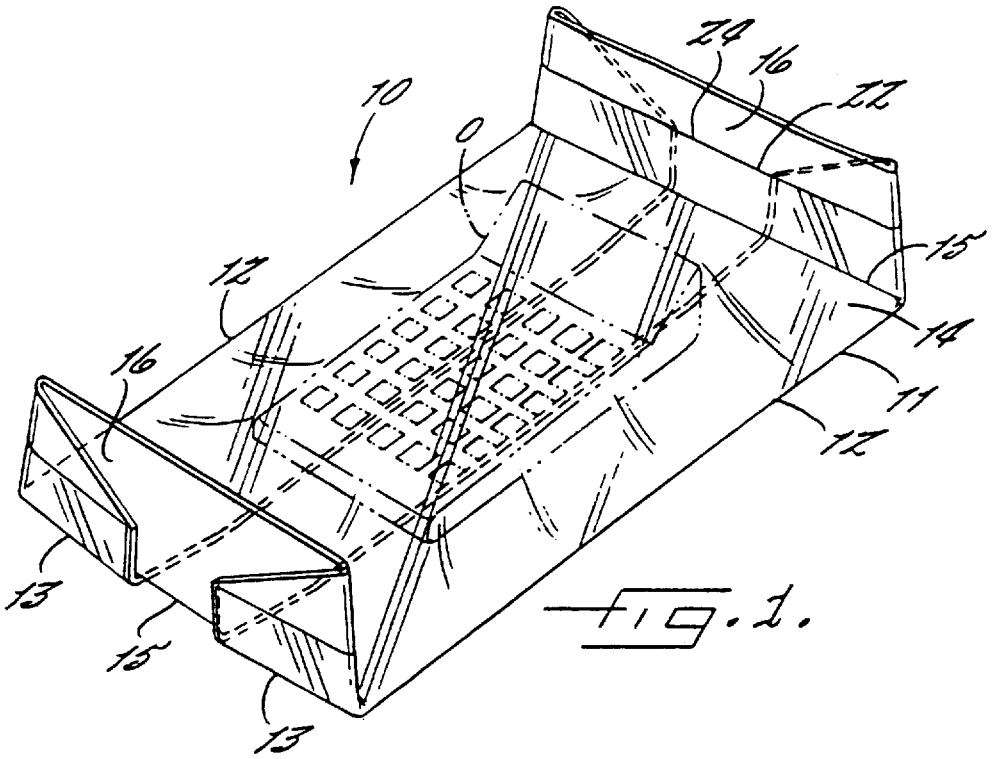
FIG. 1 is a perspective view of the packaging structure according to the present invention illustrating the position of an object packaged therein.
Figure 3:
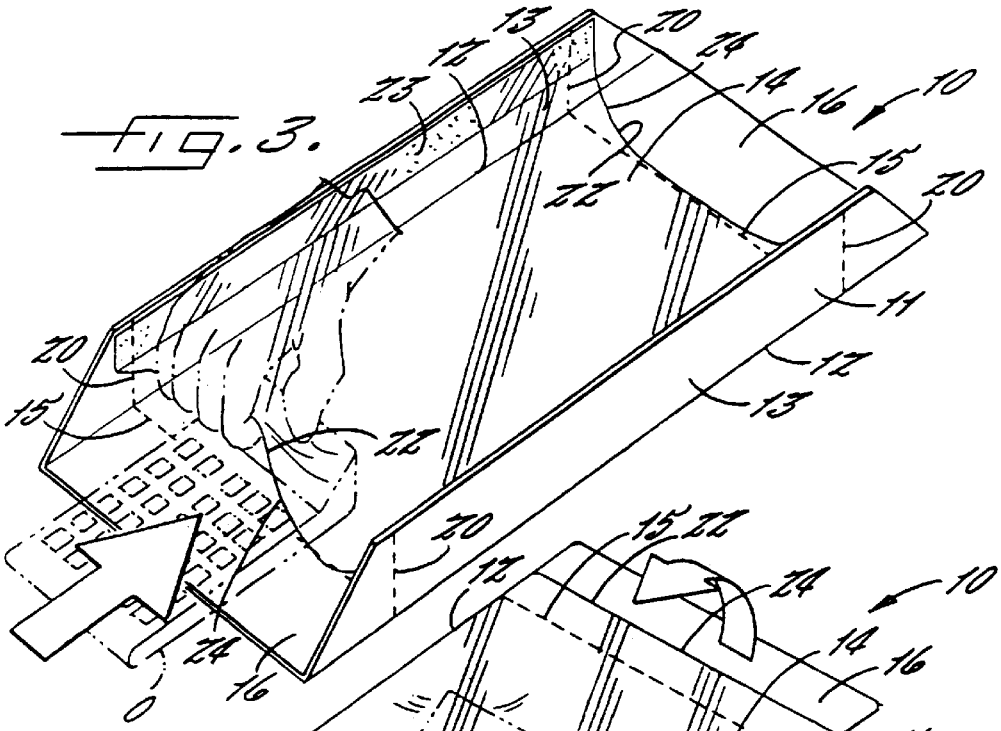
FIG. 3 is a perspective view of the packaging structure with the folding side portions folded up to illustrate the insertion of the object.
Figure 4:
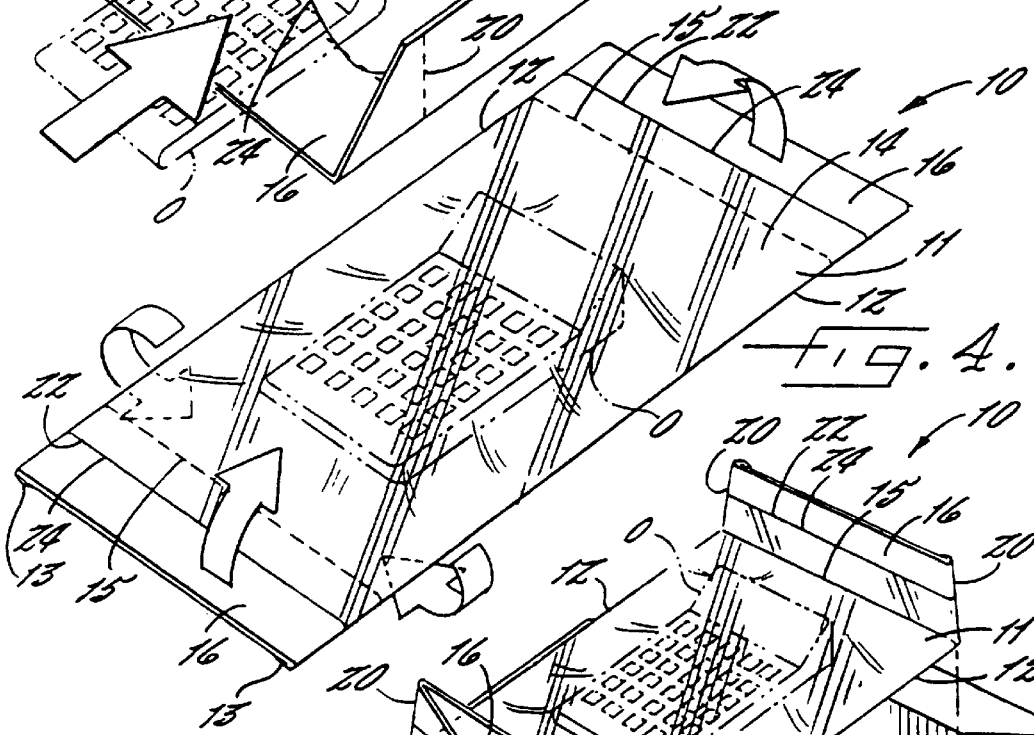
FIG. 4 is a perspective view of the packaging structure showing the direction in which the folding side portions and folding end portions are folded.
Figure 5:
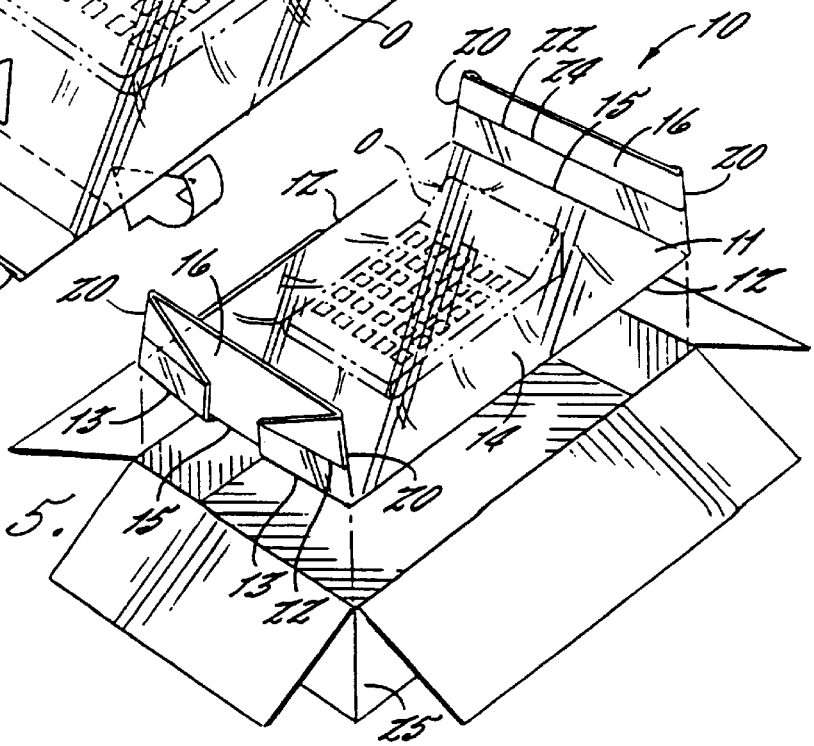
FIG. 5 is an exploded perspective view illustrating the way in which the packaging structure fits inside a box.

FIGS. 3–5 illustrate the manner of folding the embodiment of FIGS. 1 and 2 to package an object O. The folding side portions 13 are first folded upwardly (towards the film 22) to loosen the film 22 relative to the center panel portion 14 (FIG. 3). The object O to be packaged can thus be inserted more easily through one of the unsecured edge portions 24. The folding side portions 13 are then folded downwardly (away from the film material 22) through approximately 270 degrees so that the folding side portions 13 are flat against the underside of the center panel portion 14. When the side portions 13 are folded into their packaged position (e.g., FIG. 1) they pull against those portions of the film 22 that extend past the fold lines 12. Stated differently, because the film material 22 is wrapped around the outside of the fold lines 12, it must extend over a slightly greater distance than it would when in the position shown in FIG. 2, i.e., when the side portions 13 are coplanar with the center portion 14. This increased distance tends to encourage the film 22 to stretch slightly toward the side portions 13. It will be appreciated that the strain on the film material 22 in turn increases the film's tension and grip on the object O to be packaged. This feature thus provides improved retention of the packaged object O against the panel 11.

The folding end portions 16 are then folded upwardly, or towards the flexible film 22, to the position shown in FIGS. 1 and 5. The folded panel 11 may then be inserted into a box 25 having inner dimensions which correspond in height, width and length to the folded structure. Thus, the object O is securely packaged against the rigid panel 11 which is in turn securely packaged within the box 25.

The present invention includes multiple embodiments, the remainder of which are discussed individually below. Where possible, element numbers for corresponding elements are the same as those used above. It will be understood that many of the features of the embodiments discussed below may be used in combination with the features of the other various embodiments.

Figure 6:
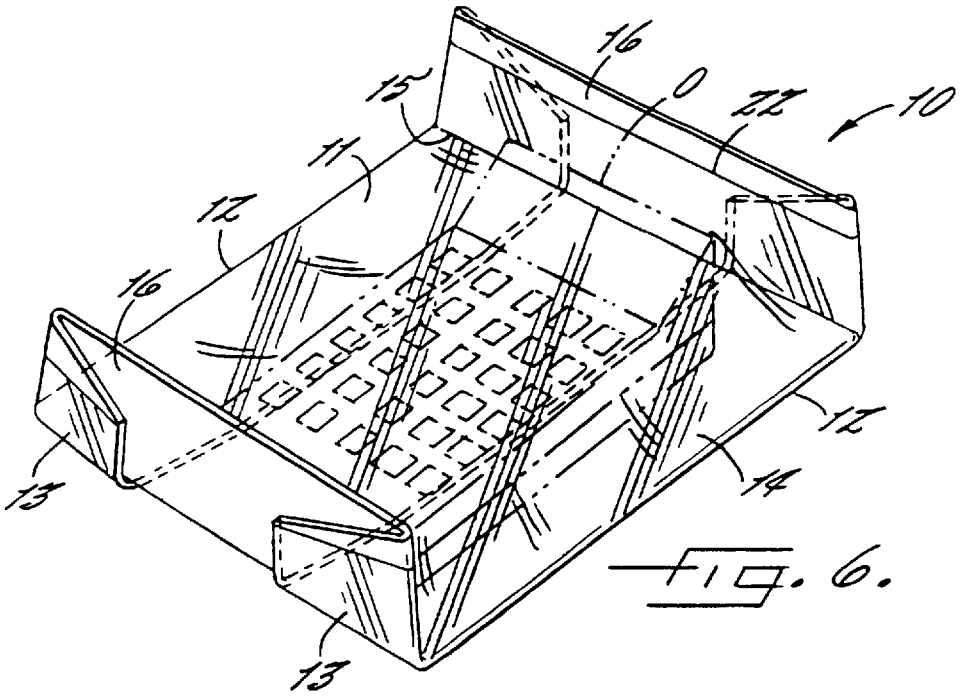
FIG. 6 is a perspective view of a second embodiment of the present invention.
Figure 7:
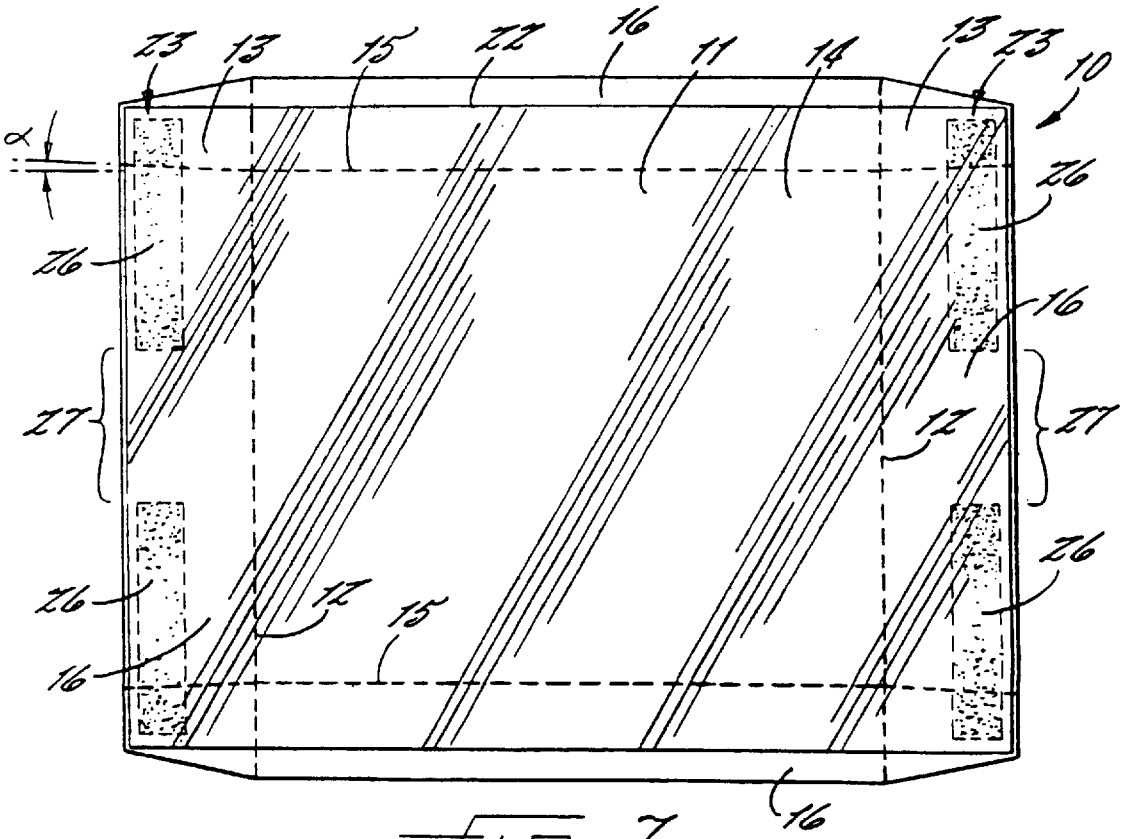
FIG. 7 is a top plan view of the second embodiment in an unfolded state illustrating a modified glue pattern.
Figure 8:
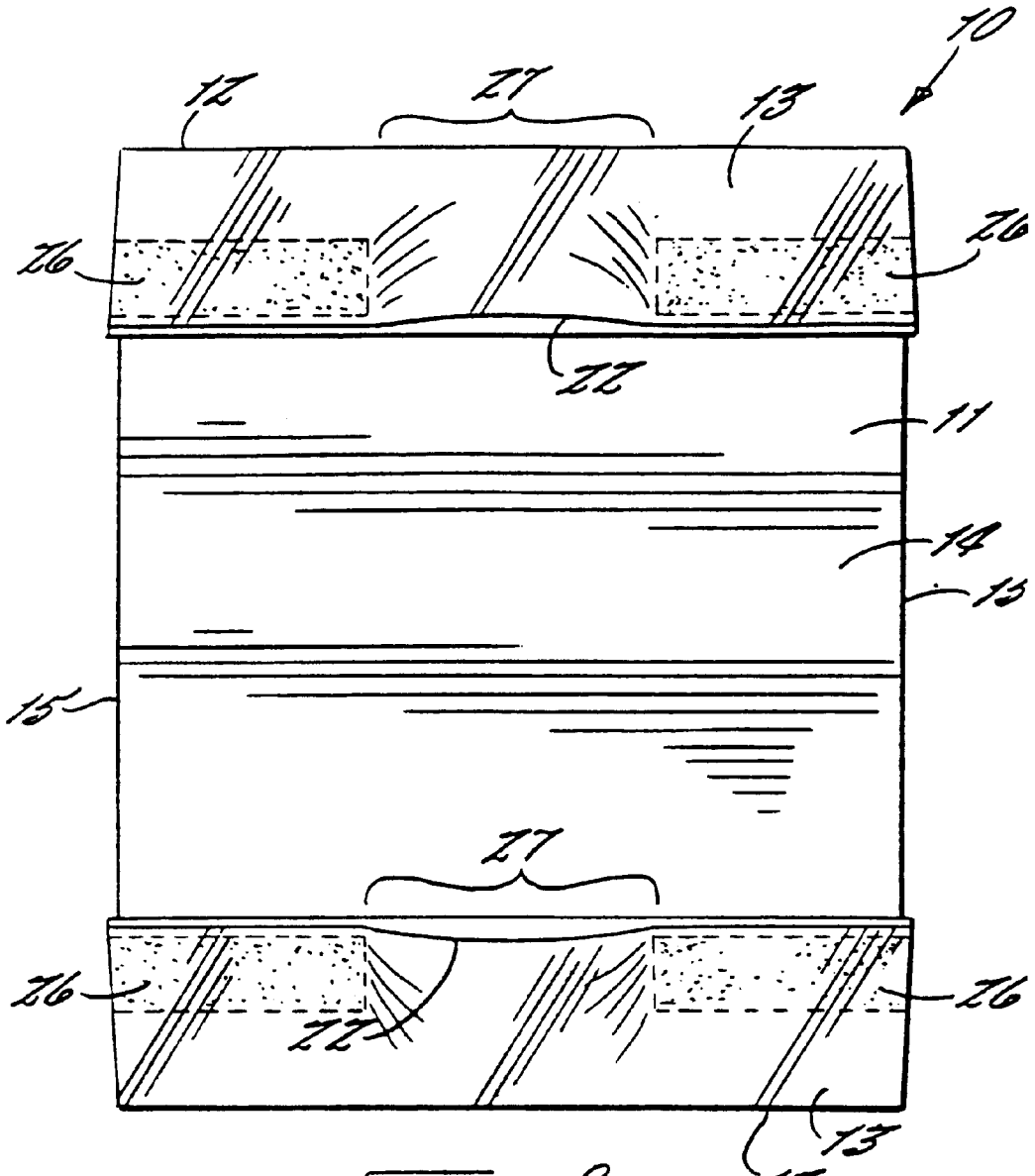
FIG. 8 is a bottom plan view of the second embodiment in a folded state.

A second preferred embodiment is illustrated in FIGS. 6–8 and is particularly useful for packaging taller objects; i.e., objects that (when packaged) extend further upwardly away from the panel 11. FIG. 7 shows that in this embodiment, each of the glue strips 23 includes two separate glue strip segments 26 having unsecured portions 27 of the film 22 therebetween. FIG. 8 illustrates that when the packaging structure 10 is folded as discussed above, the unsecured portions 27 of film between the glue strip segments 26 give slightly, which reduces the tension against a taller object O as compared to the first embodiment discussed above. The length of the unsecured portions 27 may be advantageously adjusted depending upon the height and width of the object O being packaged to provide controlled film support.

A point of terminology is worth noting here. As shown in FIG. 7, this, or other, embodiments may have folding end portions 16 which are longer (or shorter) than the folding side portions 13. As would be readily appreciated, the folding side portions 13 cooperate with the means for securing the film 22 so as to increase the tension of the film when folded, and their length relative to the folding end portions 16 is not critical to the operation of the invention. The relative lengths of the folding side portions 13 and folding end portions 16 are instead determined upon the shape and dimensions of the object being packaged. Indeed, the ease and simplicity with which the invention can be used to form custom packages is one of its significant advantages.

Figure 9:
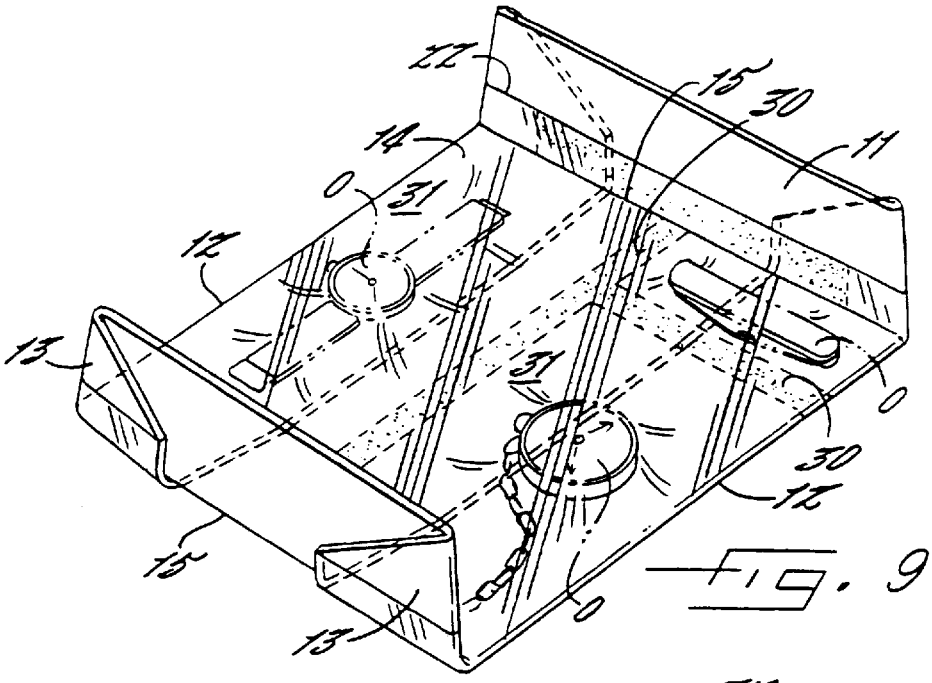
FIG. 9 is a perspective view of a third embodiment of the present invention showing the multiple objects which may be packaged therein.
Figure 10:
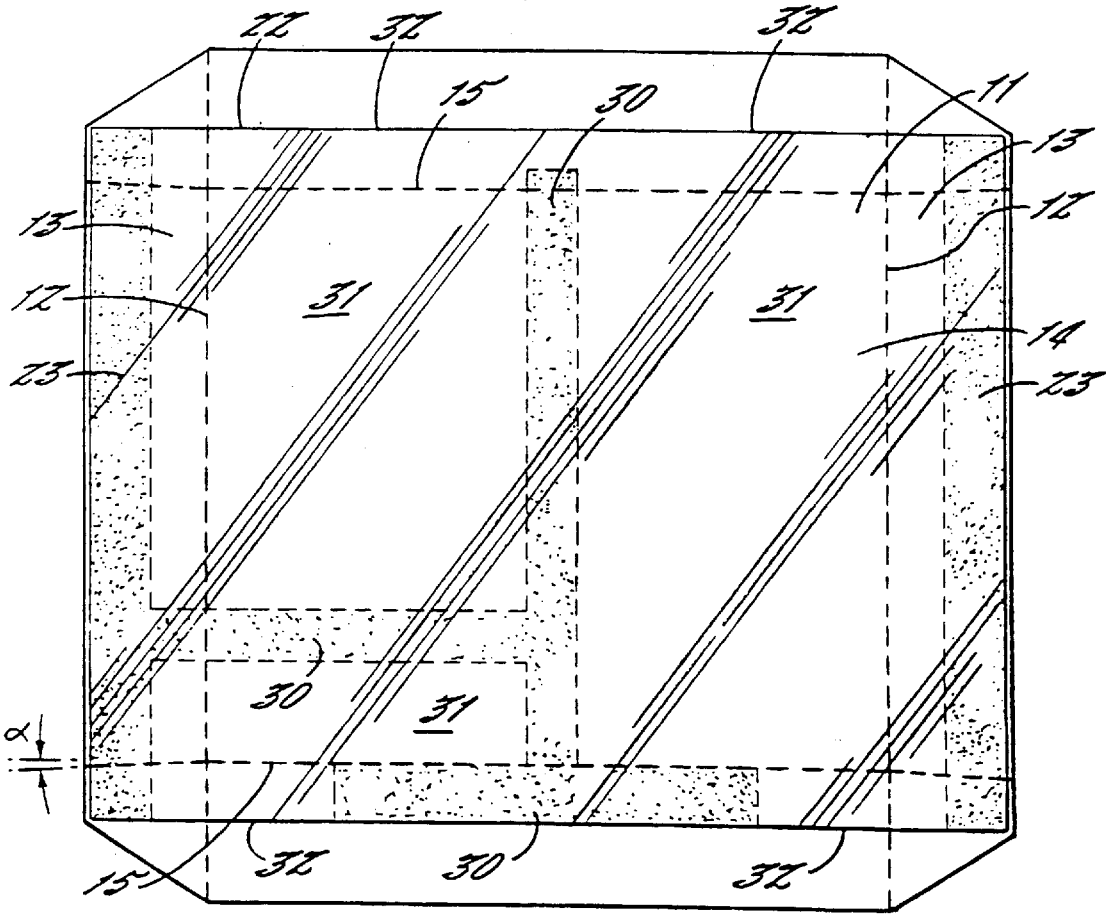
FIG. 10 is a top plan view of the third embodiment in an unfolded state.

A third embodiment is illustrated in FIGS. 9 and 10. In this embodiment, the invention includes additional glue strips 30 for securing the film 22 to the center panel portion 14. These glue strips 30 are arranged in a manner that defines several pockets 31, each of which has at least one unsecured edge portion 32. Accordingly, each of these separate pockets 31 may hold different objects O that are to be packaged together. The manner in which the panel 11 is folded and in which the film material 22 tightens to hold packaged objects is otherwise identical to the first embodiment, but with the glue strips 30 forming the additional pockets.

Figure 11:
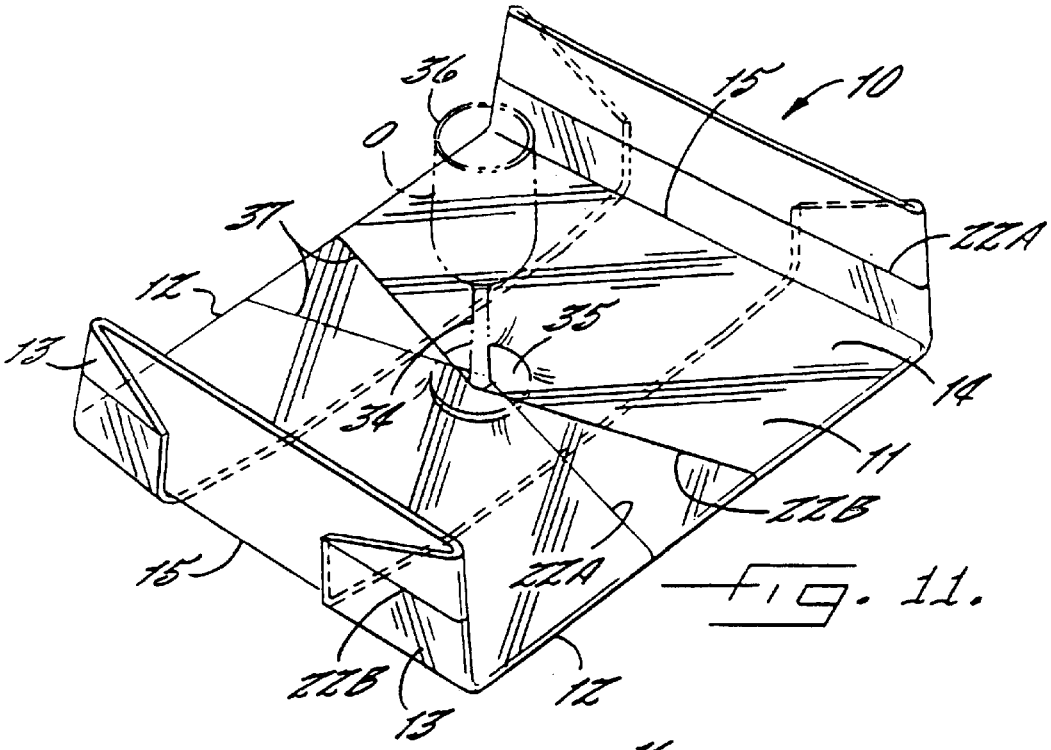
FIG. 11 is a perspective view of a fourth embodiment for packaging objects having a thinner portion.
Figure 12:
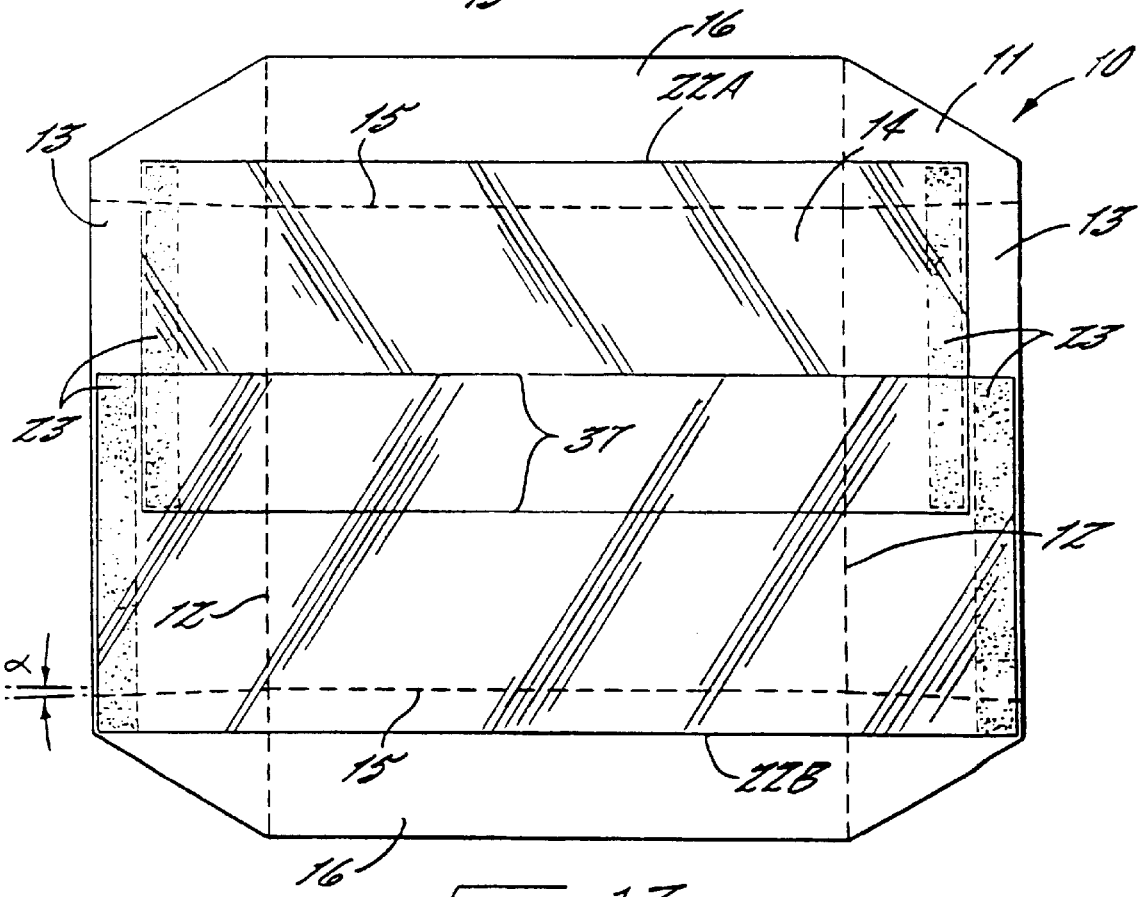
FIG. 12 is a top plan view of the fourth embodiment.

A fourth embodiment of the packaging structure 10 of the present invention is illustrated in FIGS. 11 and 12. In this embodiment, two pieces of flexible film material 22A,22B are secured to the folding side portions 13 in a laterally adjacent manner. This embodiment is particularly useful for packaging objects O having a thinner portion 34 and a thicker portion 35 adjacent to the center panel portion 14. For example, with the wine glass 36 illustrated in FIG. 11, it is only necessary for the film portions to overlie the base 35 of the glass and the stem 34 and container portions of the glass extend thereabove. As shown in FIG. 12, the two film pieces 22A,22B may partially overlap, or the adjacent edges 37 of the film pieces may abut or be slightly separated. Again, the manner in which the panel 11 folds and the film 22 secures an object is fundamentally the same as in the other embodiments.

Figure 13:
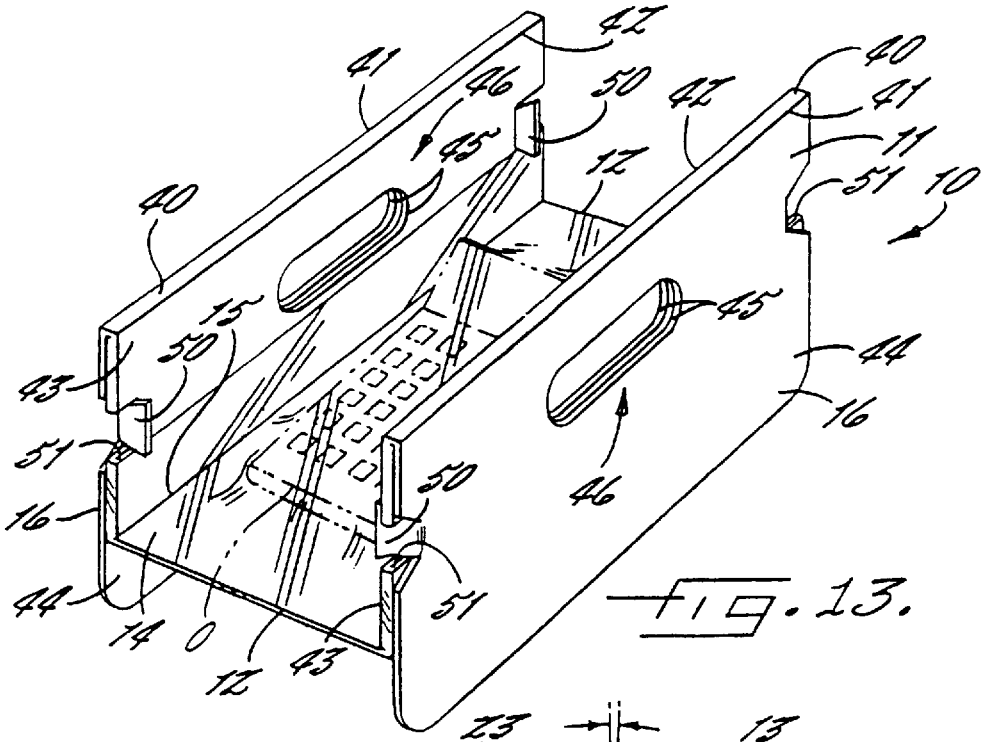
FIG. 13 is a perspective view of a fifth embodiment illustrating the handles and locking tabs.
Figure 14:
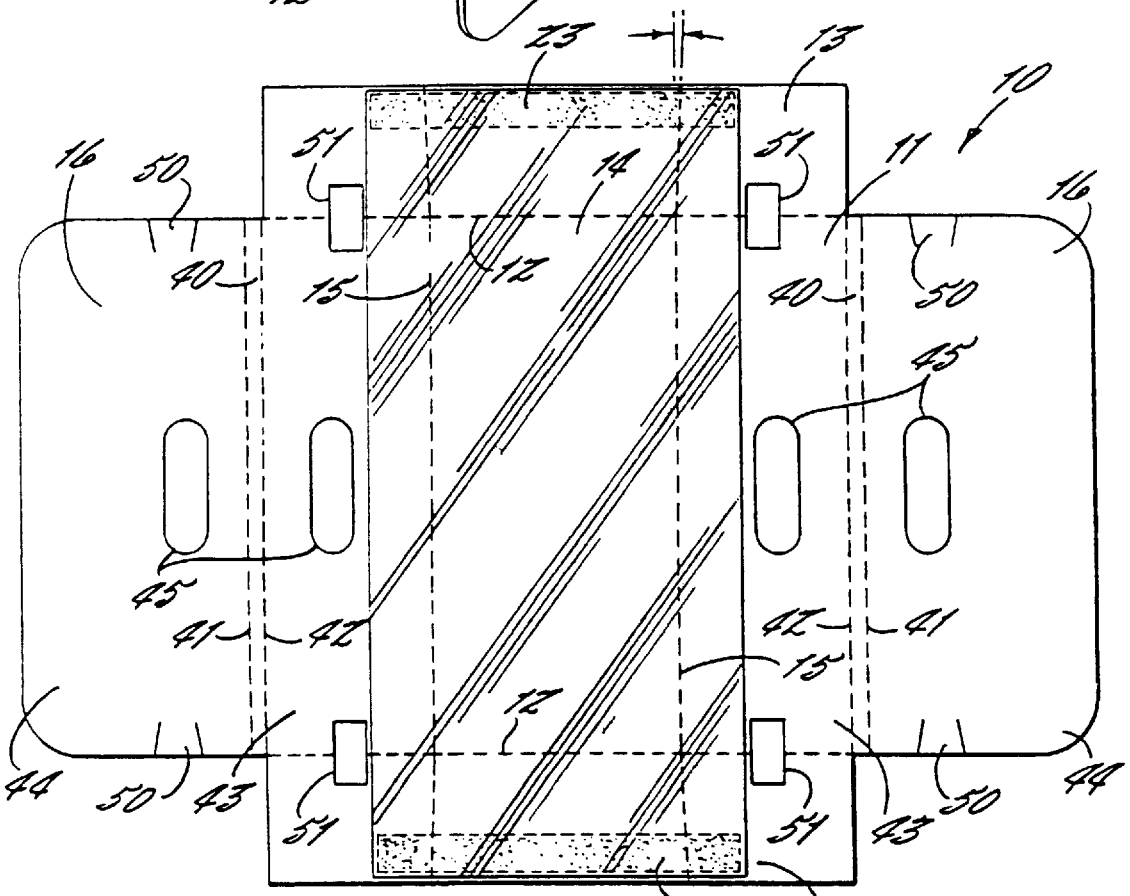
FIG. 14 is a top plan view of the fifth embodiment.

A fifth embodiment is illustrated in FIGS. 13 and 14. In this embodiment, a third pair of generally parallel fold lines 40 is formed in the folding end portions 16 generally parallel to the second pair of fold lines 15. Although denominated in the singular, it will be understood that each fold line 40 may actually include two sub-lines 41,42 separated by the distance of at least two thicknesses of the paperboard material so as to prevent crimping of the paperboard when folded. The third fold lines 40 thus define proximal 43 and distal 44 folding segments in each of the folding end portions 16.

Each of the folding end portions 16 may also include a pair of handle holes 45 formed equidistant from the respective one of the third pair of parallel fold lines 40. Thus, when the folding end portions 16 are folded in a manner as shown in FIG. 13, i.e., with the proximal segments 43 folded upwardly and the distal segments 44 folded downwardly, a pair of handles 46 is formed to allow the folded structure 10 to be more easily handled and inserted or removed from a box. The folding end portions 16 may also include a plurality of tabs 50 and notches 51 arranged such that the folded structure 10 may be locked into place by bending the tabs into the respective notches.

It will be understood, of course, that the presence of cutouts for handles or tabs for securing folds are not limited to this particular embodiment, but can be used in several or all of the embodiments as may be desired. In addition, another advantageous feature of the invention is illustrated in this embodiment by the distal segments 44 which space the center panel portion 14 from the bottom of the box 25. Thus, the object O, when placed in a box 25, is maintained out of direct contact with the box in all three axes and is protected from physical shock from any direction. In addition, having the center panel portion 14 spaced from the bottom of the box 25 will provide room for the panel portion 14 to flex slightly, thereby providing a shock absorbing function. Although described here in connection with the fifth embodiment of the invention, it will be understood that this feature may also be present in the other embodiments discussed above and below.

Figure 15:
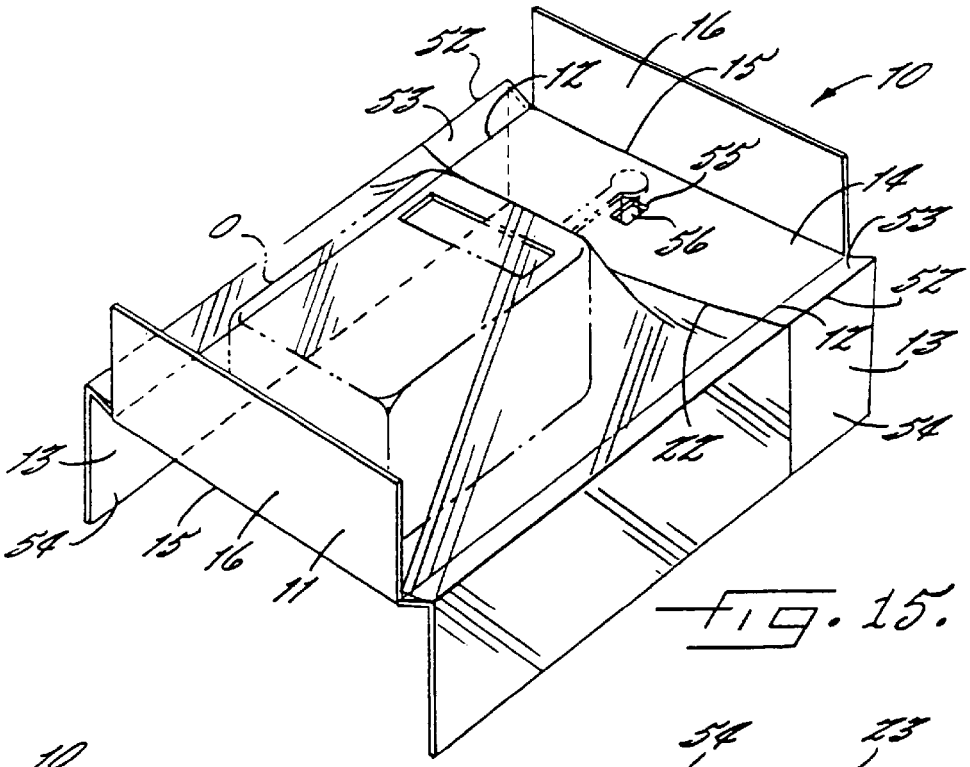
FIG. 15 is a perspective view of a sixth embodiment of the present invention for packaging larger objects.
Figure 16:
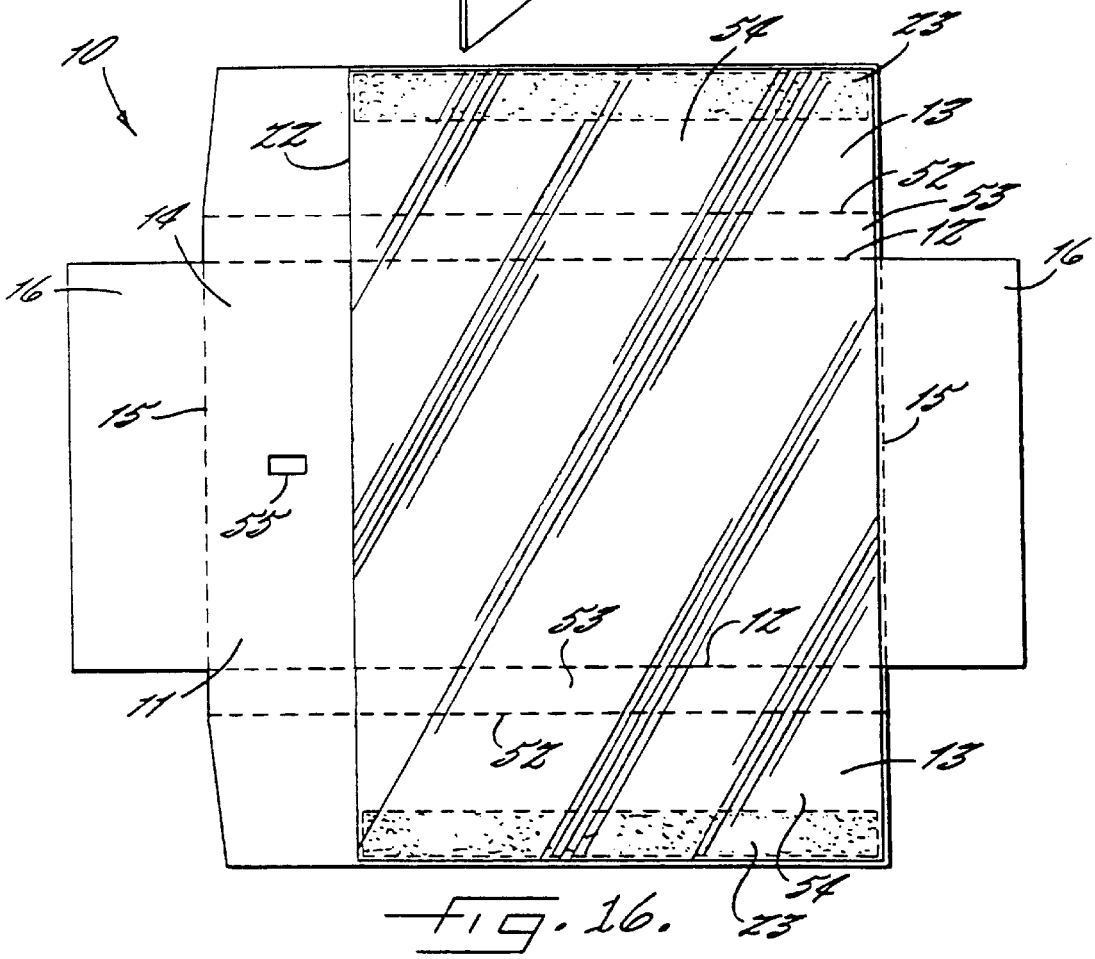
FIG. 16 is a top plan view of the sixth embodiment.

A sixth embodiment of the packaging structure 10 is illustrated in FIGS. 15 and 16 and includes a third pair of fold lines 52 in the folding side portions 13 and parallel to the first pair of fold lines 12. The third pair of fold lines 52 thus define proximal 53 and distal 54 segments in the folding side portions 13. This embodiment is advantageous for use with larger objects O because the proximal segments 53 can fold partially in the direction towards the object, thus creating more volume, and more containment area, between the film material 22 and the center panel portion 14.

The distal segments 54 are folded downwardly, as with the other embodiments, to tighten the film 22 against the object O. The distal segments 54 are not folded as far as the other embodiments, however, and are instead folded over only to a position approximately perpendicular to the center panel portion 14. Thus, when placed in box, the distal segments 54 are restrained from unfolding by the inner sides of the box. In addition, the distal segments 54 space the center panel portion 14 from the bottom of the box, which can further reduce the risk of physical impact damage.

An opening 55 may also be formed in the center panel portion 14 to accommodate a protuberance 56 of the object O being packaged.

Figure 17:
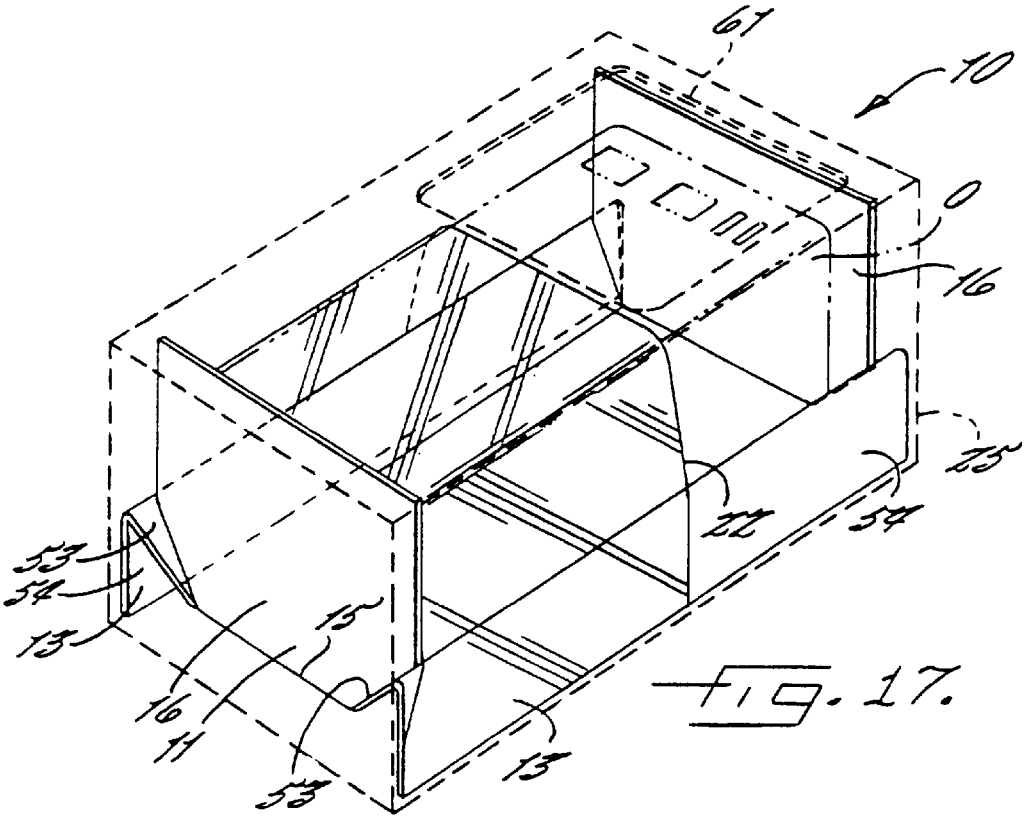
FIG. 17 is a perspective view of a seventh embodiment of the present invention.
Figure 18:
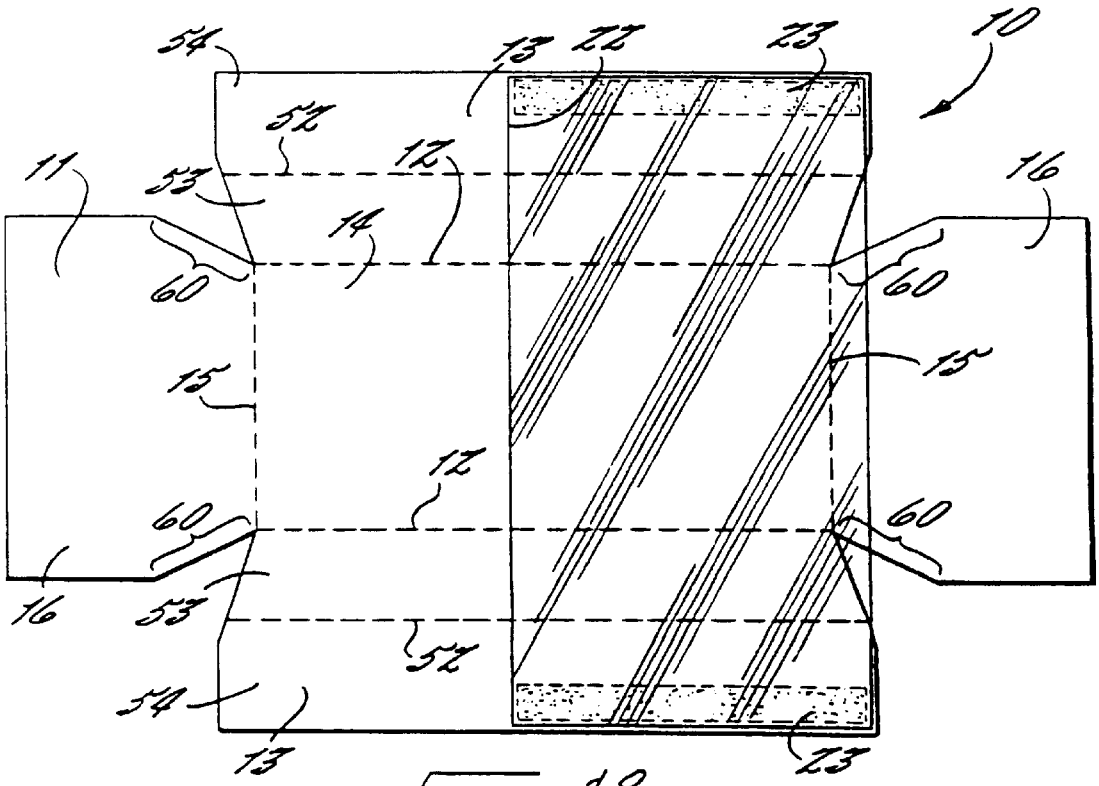
FIG. 18 is a top plan view of the seventh embodiment in an unfolded state.

A seventh embodiment is illustrated in FIGS. 17 and 18. The packaging structure 10 of this embodiment is essentially the same as the sixth embodiment in that the folding side portions 13 include proximal 53 and distal 54 segments. The seventh embodiment also includes, however, folding side 13 and end 16 portions which are flared outwardly, as best seen in the plan view of FIG. 18. Thus, when the folding end portions 16 are folded in the manner discussed above in connection with the sixth embodiment, the flared portions 60 of the folding end portions are placed in an abutting relationship with the proximal segments 53 of the folding side portions 13, as illustrated in FIG. 17. This provides added rigidity and strength to the structure 10.

Another illustrated feature of the seventh embodiment, which could also be incorporated with the other embodiments, is a shortened piece of flexible film material 22. It is not necessary for the film material 22 to extend over the entire length of the center panel portion 14 because, as would be readily appreciated, it is only necessary for a part of the object to be held between the film material and the center panel portion. It may be desirable to use a shortened piece of film 22 when, for example, it is desired that part of the object O be totally exposed, such as for aesthetic reasons.

In addition, the box 25 into which the structure 10 is inserted may include an opening 61 formed therein to expose the object O. In the case of consumer products, the shortened film and open box allow a prospective purchaser to see and touch the product without restriction.

Figure 19:
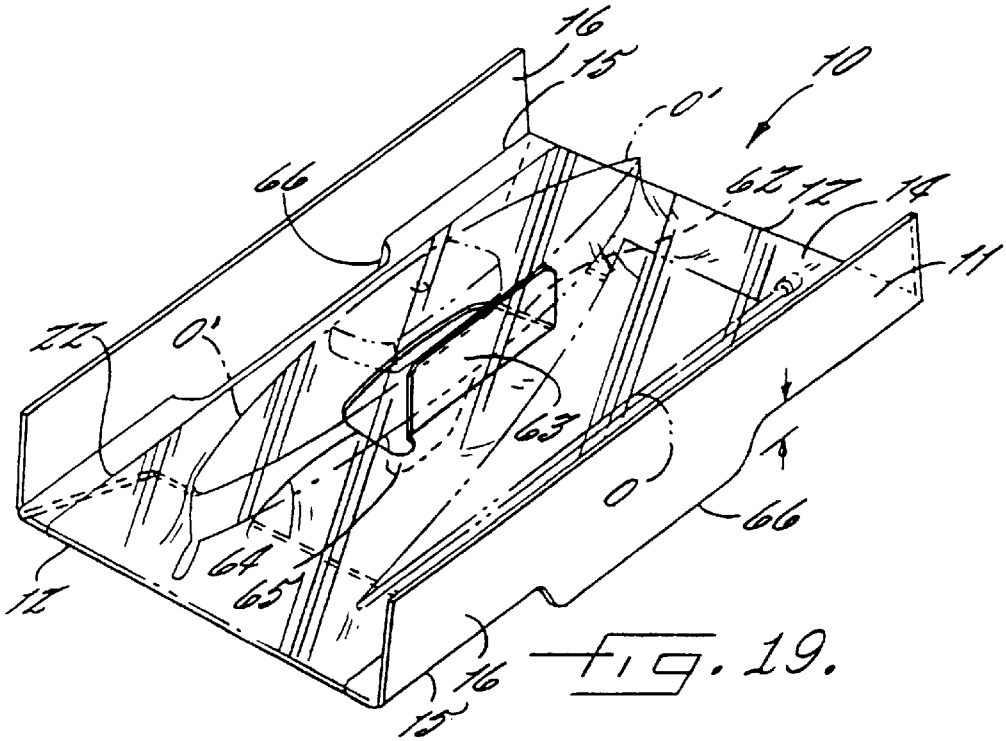
FIG. 19 is a perspective view of an eighth embodiment of the packaging structure illustrating the spacer tabs.
Figure 20:
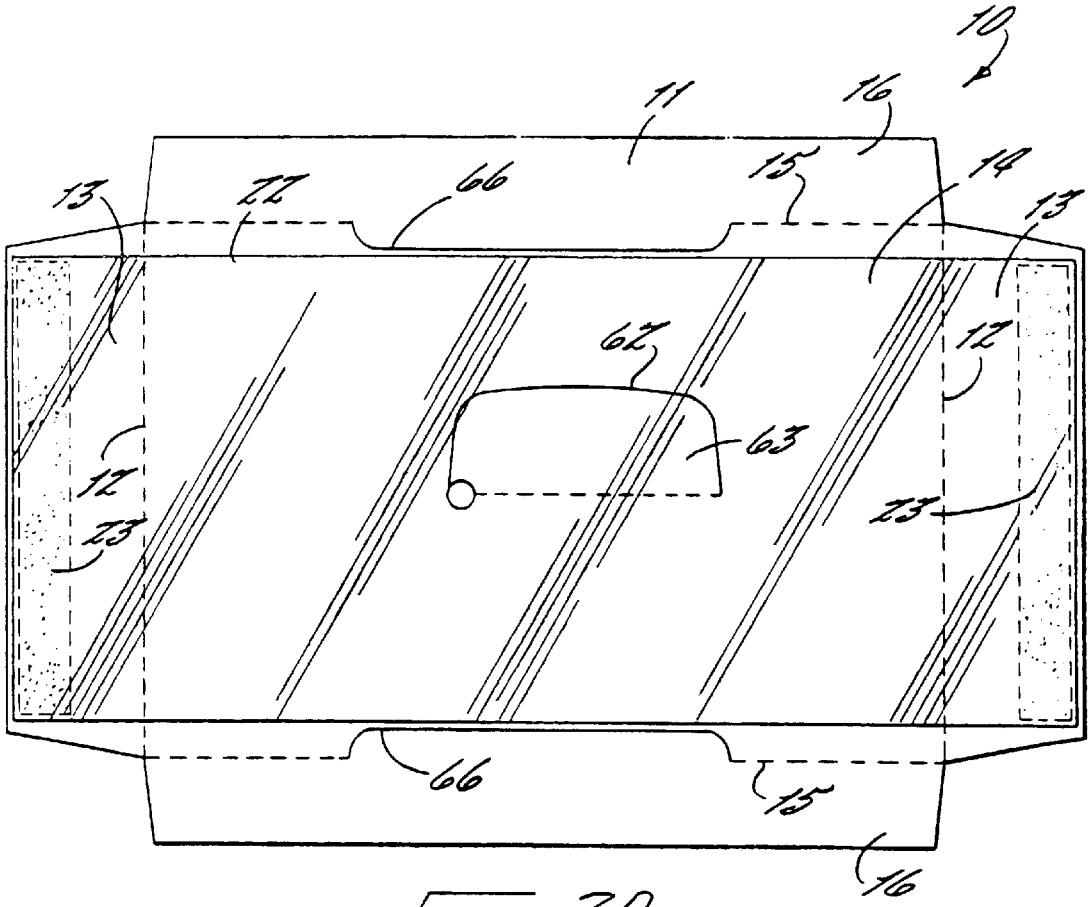
FIG. 20 is a top plan view of the eighth embodiment in an unfolded state.

An eighth embodiment of the packaging structure 10 is illustrated in FIGS. 19 and 20. The center panel portion 14 includes a patterned cut 62 that defines a folding tab 63. The tab 63 can be folded upwardly to separate two objects O,O' packaged on the center panel portion 14. The tab 63 also forms an opening 64 in the center panel portion 14 and permits a portion 65 of one object O' to project through the opening opposite from the film 22. For example, with regard to the model sailboat shown in FIG. 19, the keel 65 may extend through the opening 64 while the remainder of the hull is supported by the center panel portion 14.

A pair of spacer tabs 66 may also be cut into the center panel portion 14 from each of the second pair of fold lines 15. When the folding end portions 16 are folded upwardly, as shown in FIG. 19, the tabs 66 extend downwardly and space the bottom of the center panel portion 14 from the bottom of the box 25 so that the portion 65 of the object O' extending through the opening 64 is protected from physical impact.

Figure 21:
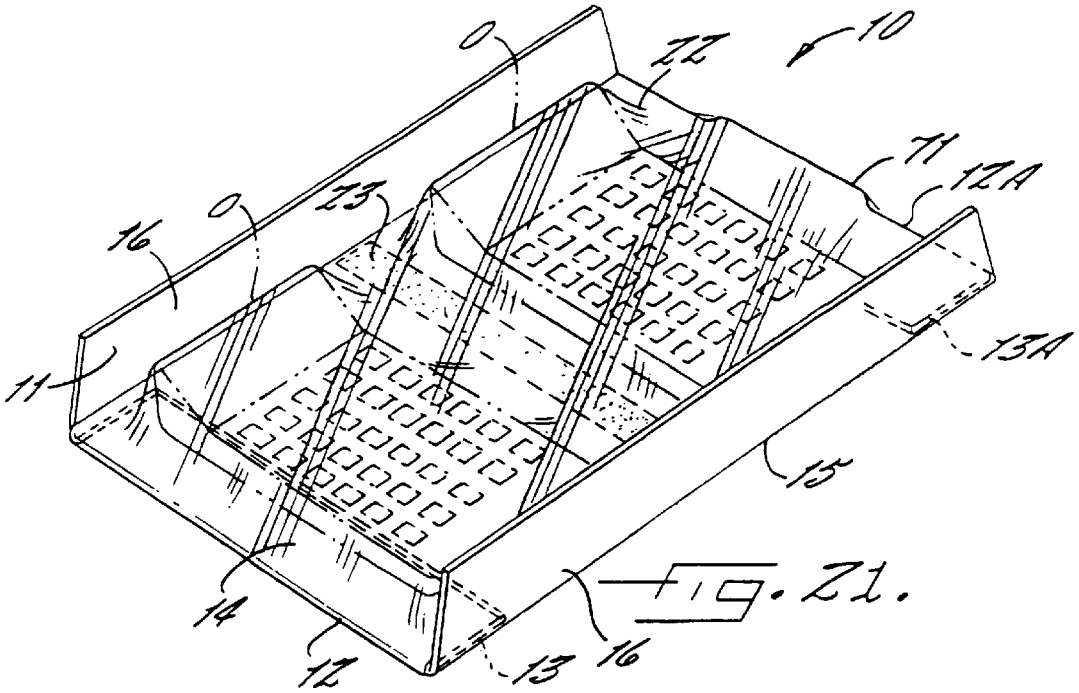
FIG. 21 is a perspective view of a ninth embodiment of the present invention illustrating two packaged objects.
Figure 22:
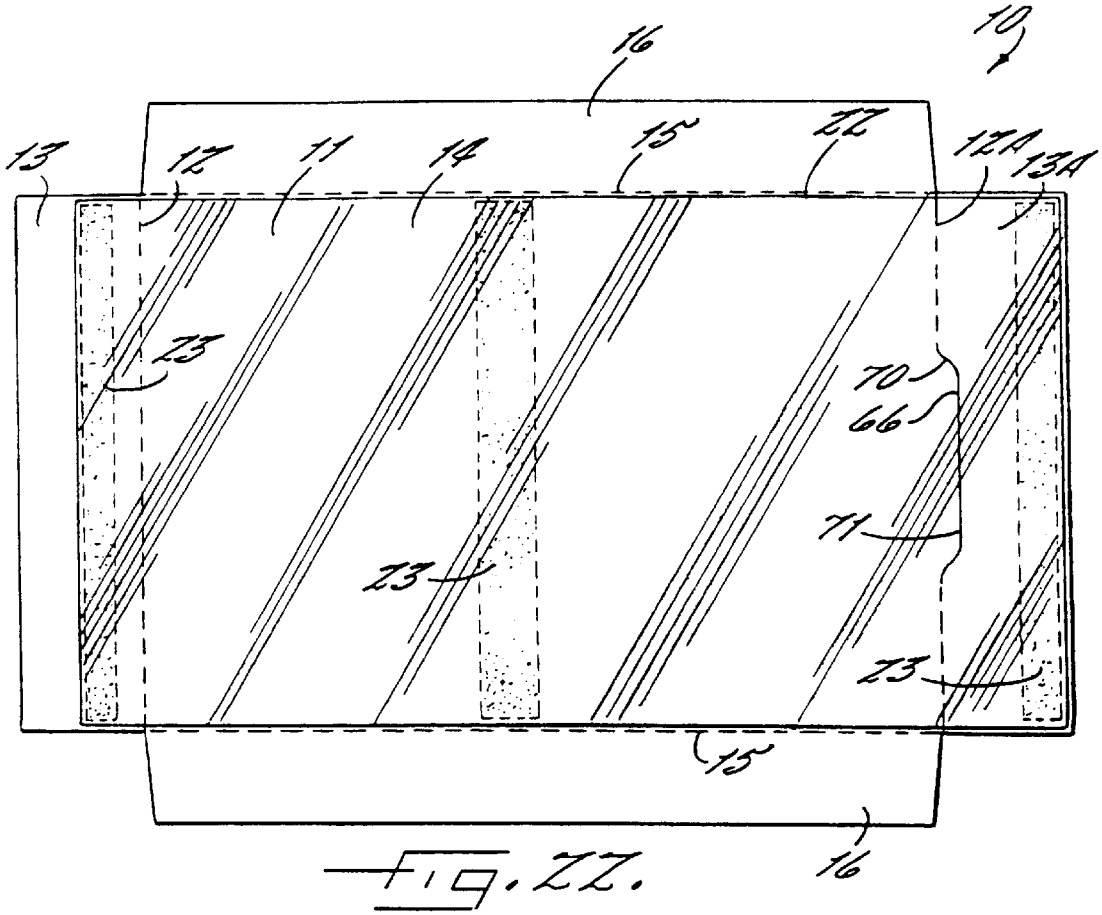
FIG. 22 is a top plan view of the ninth embodiment.

A ninth embodiment of the packaging structure 10 is illustrated in FIGS. 21 and 22. In particular, a tab-defining cut 70 is formed adjacent to one of the first pair of fold lines 12A. More specifically, a tab 71 extends from the center panel portion 14 into the folding side portion 13A so that, as the folding side portion is folded, the tension of the film material 22 is further increased. In accordance with the discussion above, the tab 71 increases the distance over which the film material 22 must extend when the folding side portion 13A is folded. This increased strain further tightens the film 22 against the object O being packaged. FIGS. 21 and 22 also illustrate the multiple pocket features of the third embodiment.

Figure 23:
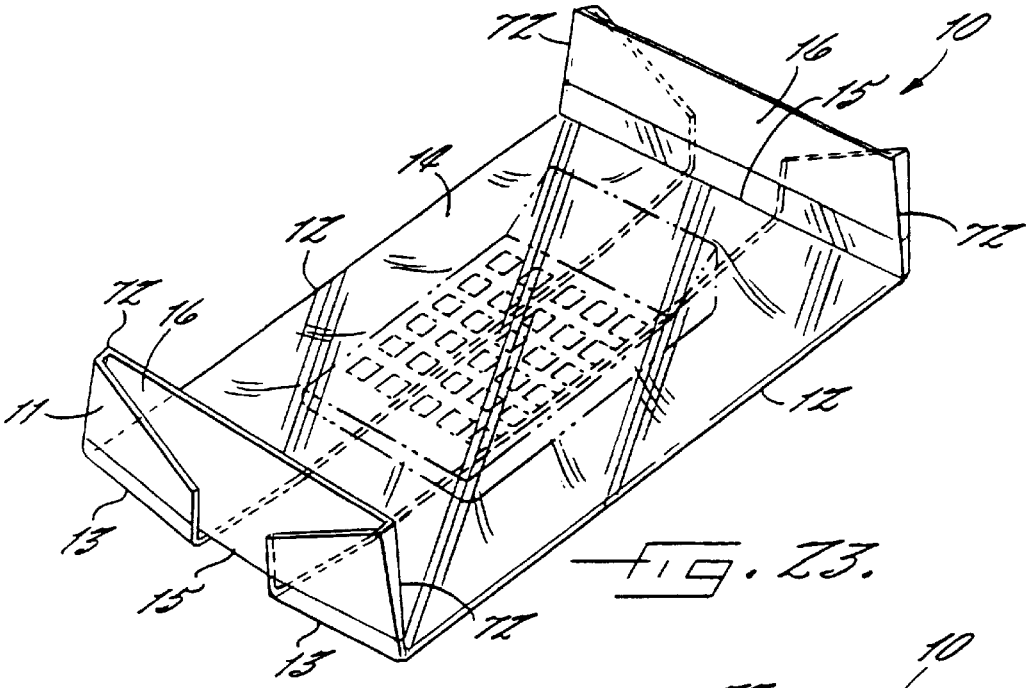
FIG. 23 is a perspective view of a tenth embodiment of the present invention.
Figure 24:
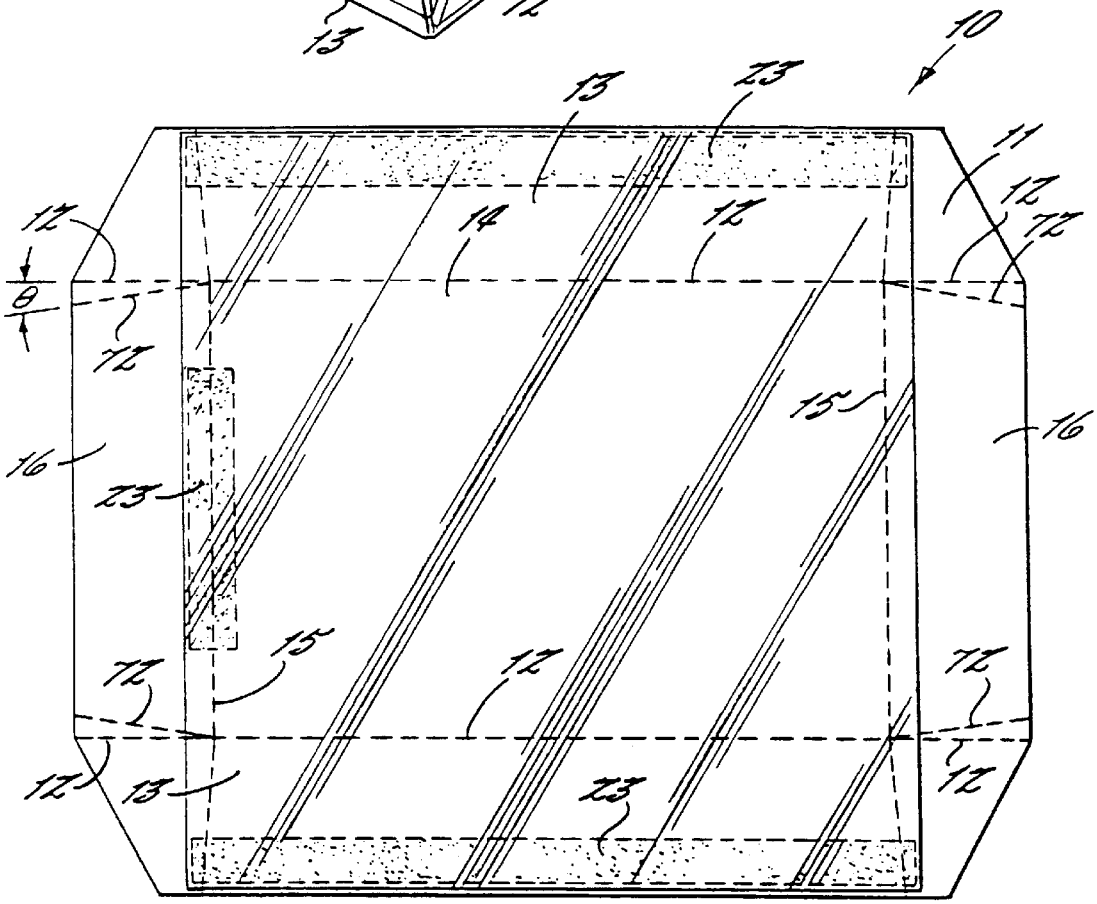
FIG. 24 is a top plan view of the tenth embodiment shown in an unfolded state.

A tenth embodiment of the packaging structure 10 is illustrated in FIGS. 23 and 24. The tenth embodiment includes four supplemental fold lines 72 extending from each of the intersections of the first 12 and second pairs 15 of fold lines. Each of the supplemental fold lines 72 extends at an acute angle θ from the first fold line 12 and towards the center of the distal edge of the respective folding end portion 16. Accordingly, when the packaging structure 10 is folded in the manner discussed above in connection with the first embodiment, the folding side portions 13 do not fold flat against the center panel portion 14 but define an acute angle θ therewith. The position of the side portions 13 thus spaces the center panel portion 14 from the bottom of the box 25. In addition, the resilient folding side portions 13 also perform a shock absorbing function with regard to the packaging structure 10.

Figure 25:
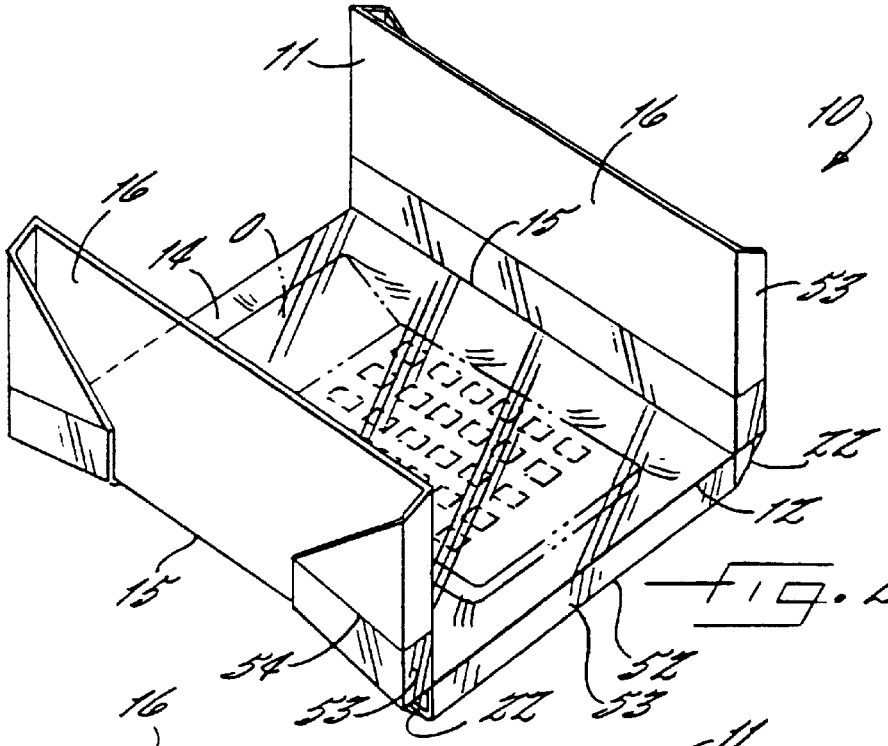
FIG. 25 is a perspective view of an eleventh embodiment of the packaging structure according to the present invention.
Figure 26:
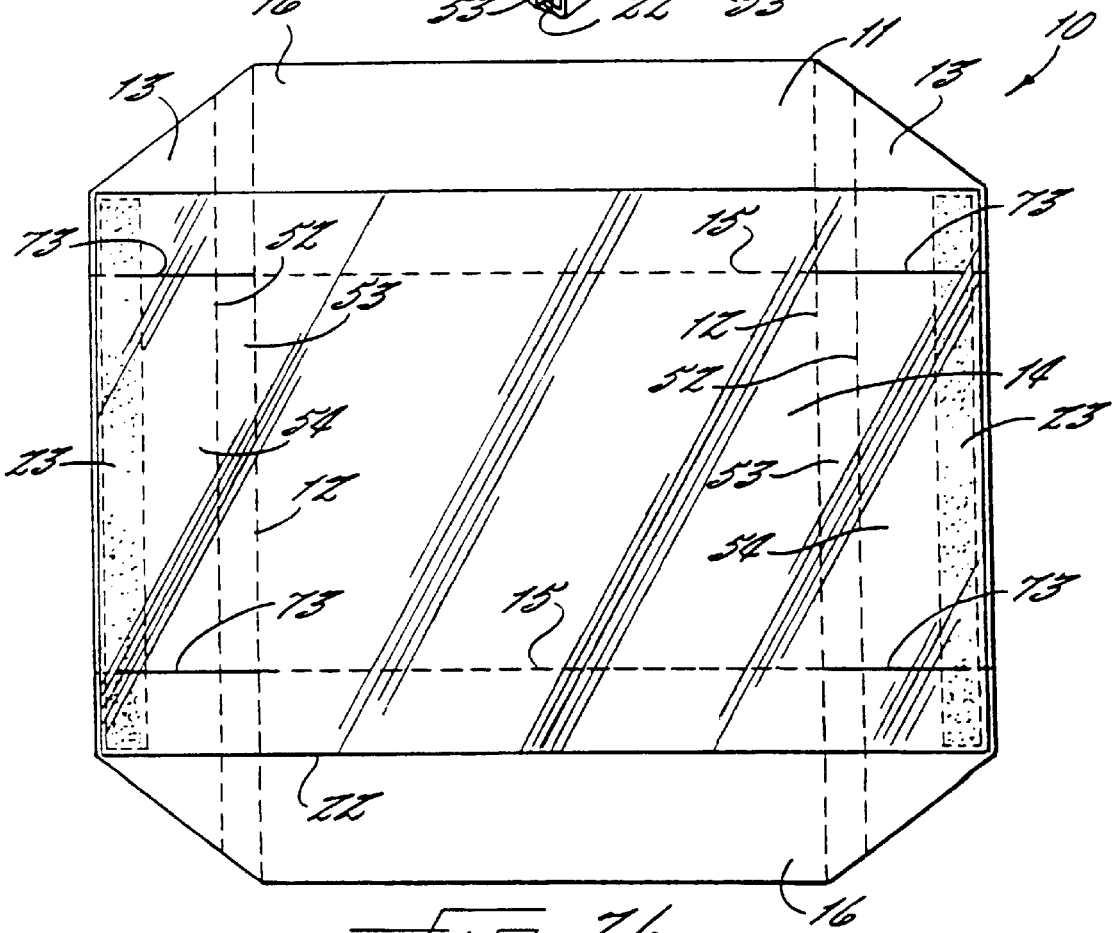
FIG. 26 is a top plan view of the eleventh embodiment.

An eleventh embodiment of the packaging structure 10 is illustrated in FIG. 25 and 26. The eleventh embodiment includes a third pair 52 of fold lines in the folding side portions 13 so as to define proximal 53 and distal 54 segments of the folding side portions 13. Four cuts 73 are formed and extend from the intersections of the first 12 and second 15 pairs of fold lines across the folding side portions 13. In other words, the cuts 73 replace the portion of the second fold lines 15 which would otherwise extend across the folding side portions 13. Thus, when the folding side portions 13 are folded downwardly and the folding end portions 16 are folded upwardly, in accordance with the discussion with regard to the first embodiment, the proximal segments 53 of the folding side portions extend perpendicular to the center panel portion 14. In addition, the distal segments 54 extend from the proximal segments 53 to the center panel portion 14 and are secured in this position by the tightened film 22. Thus, the proximal segments 53 form a spacer to space the center panel portion 14 from the bottom and sides of the box 25.

Figure 27:
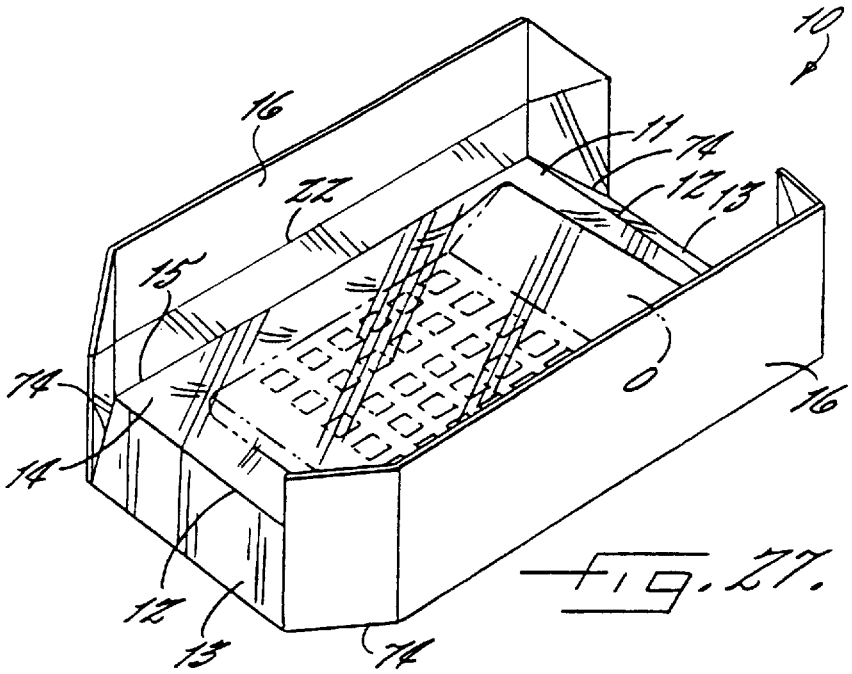
FIG. 27 is a perspective view of a twelfth embodiment of the present invention.
Figure 28:
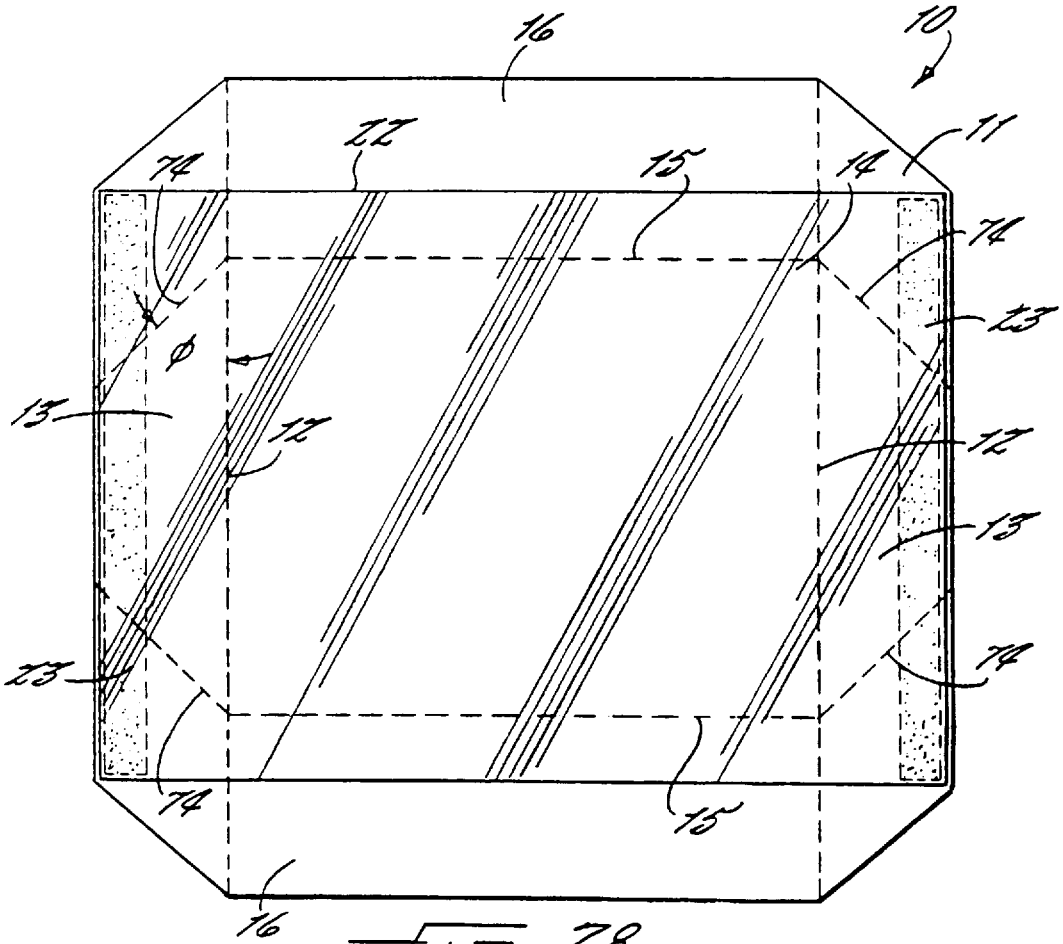
FIG. 28 is a top plan view of the twelfth embodiment.

A twelfth embodiment of the packaging structure 10 is illustrated in FIGS. 27 and 28. The second pair of fold lines 15 extend only along the center portion 14 of the panel 11 and terminate at the first pair of fold lines 12. Supplemental fold lines 74 are provided which extend from each of the ends of the second pair of fold lines 15 at an acute angle ϕ from the first fold lines 12 such that the supplemental fold lines 74 extend towards the center of the distal edge of the folding side portions 13. The supplemental fold lines 74 preferably extend at an acute angle ϕ of about 45° from the first pair of fold lines 12. Accordingly, as the folding side portions 13 are folded downwardly away from the plastic film material 22, the folding end portions 16 are caused to fold upwardly to the position shown in FIG. 27. The folding side portions 13, which can be folded downwardly no more than 90° because of their attachment to the folding end portions 16, thus form a spacer to space the center panel portion 14 from the bottom of the box 25.

Figure 29:
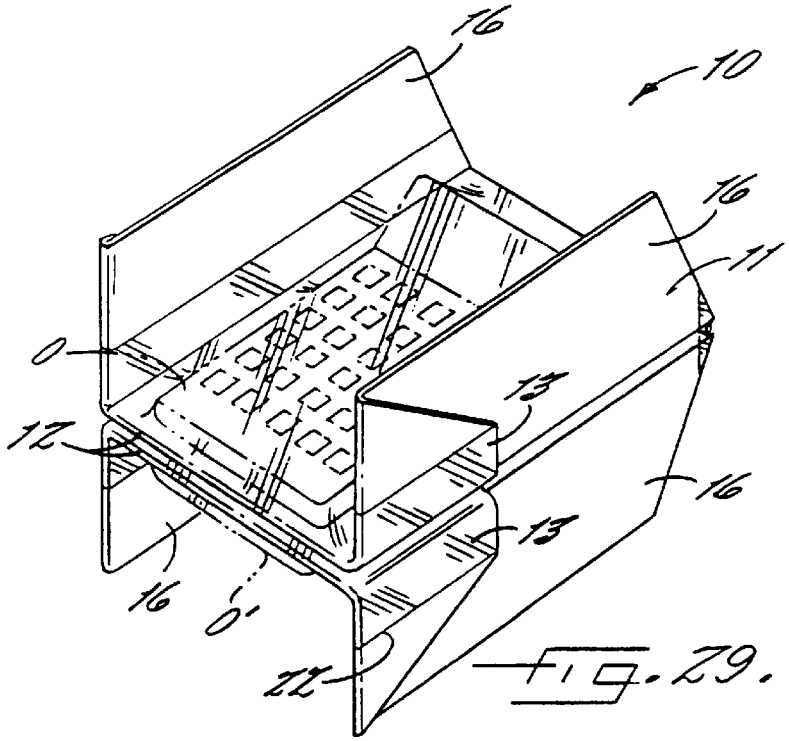
FIG. 29 is a perspective view of a thirteenth embodiment of the present invention illustrating two packaged objects.
Figure 30:
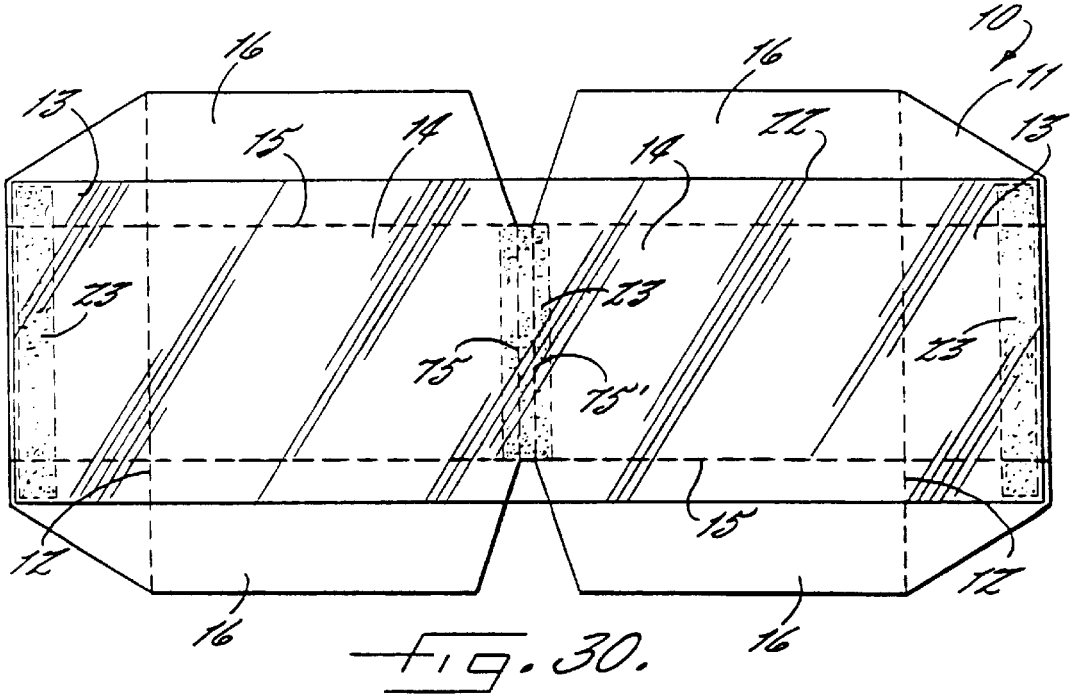
FIG. 30 is a top plan view of the thirteenth embodiment shown in an unfolded state.

A thirteenth embodiment of the packaging structure 10 of the present invention is illustrated in FIGS. 29 and 30. The thirteenth embodiment includes at least one central fold line 75 extending parallel to the first pair of fold lines 12. The central fold line may actually comprise two fold lines 75, 75' which are closely spaced to account for the center panel portion 14 thickness when folded in the manner discussed herein. The central fold line 75 thus defines a divided center panel portion 14 whereby objects O,O' may be held on each side of the central fold line 75. After objects O,O' have been inserted on each side of the central fold line 75 in the manner discussed above, the center portion 14 may be folded along the central fold line 75 so as to form the "H" shaped configuration shown in FIG. 29. The folding side portions 13 are first folded away from the plastic film material 22 and will be adjacent to each other when the center panel portion 14 is folded along the central fold line 75. Each of the folding end portions 16 may then be folded towards the plastic film material 22 so as to form the "H" shaped configuration illustrated in FIG. 29. The packaging structure 10 may then be placed into a box 25 such that one object O' will be disposed in the lower half of the box below the center panel portion 14 and the other object O will be disposed in the upper half of the box 24 above the center panel portion 14.

Figure 31:
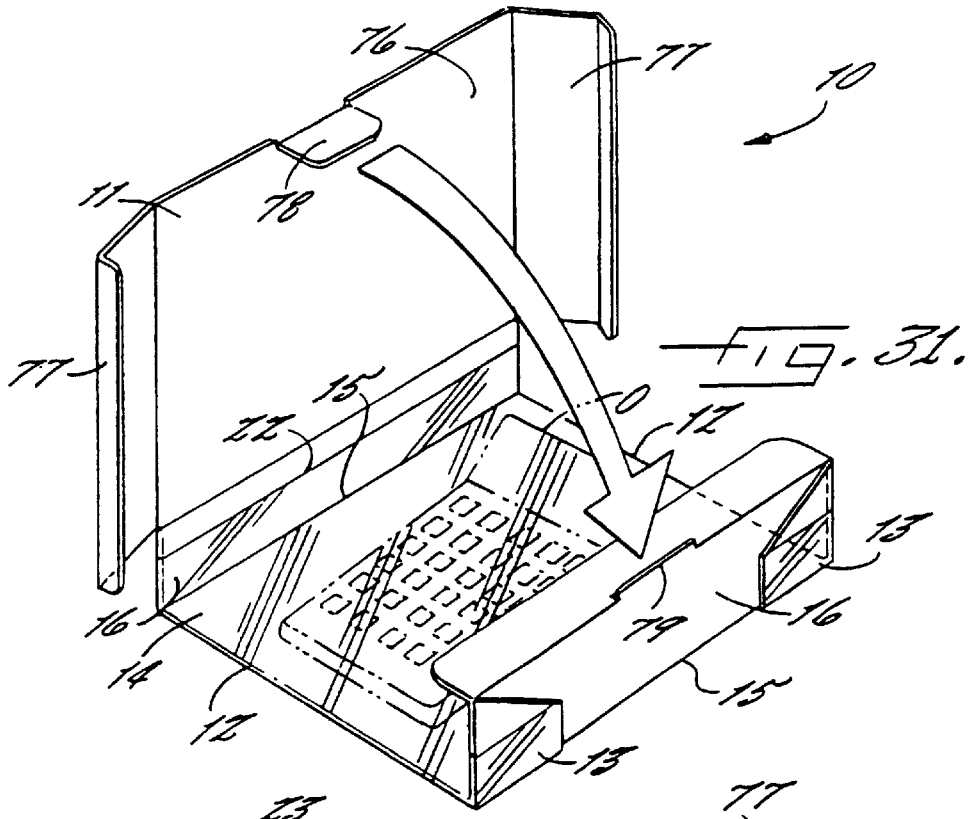
FIG. 31 is a perspective view of a fourteenth embodiment of the packaging structure of the present invention illustrating the closing of a box lid portion.
Figure 32:
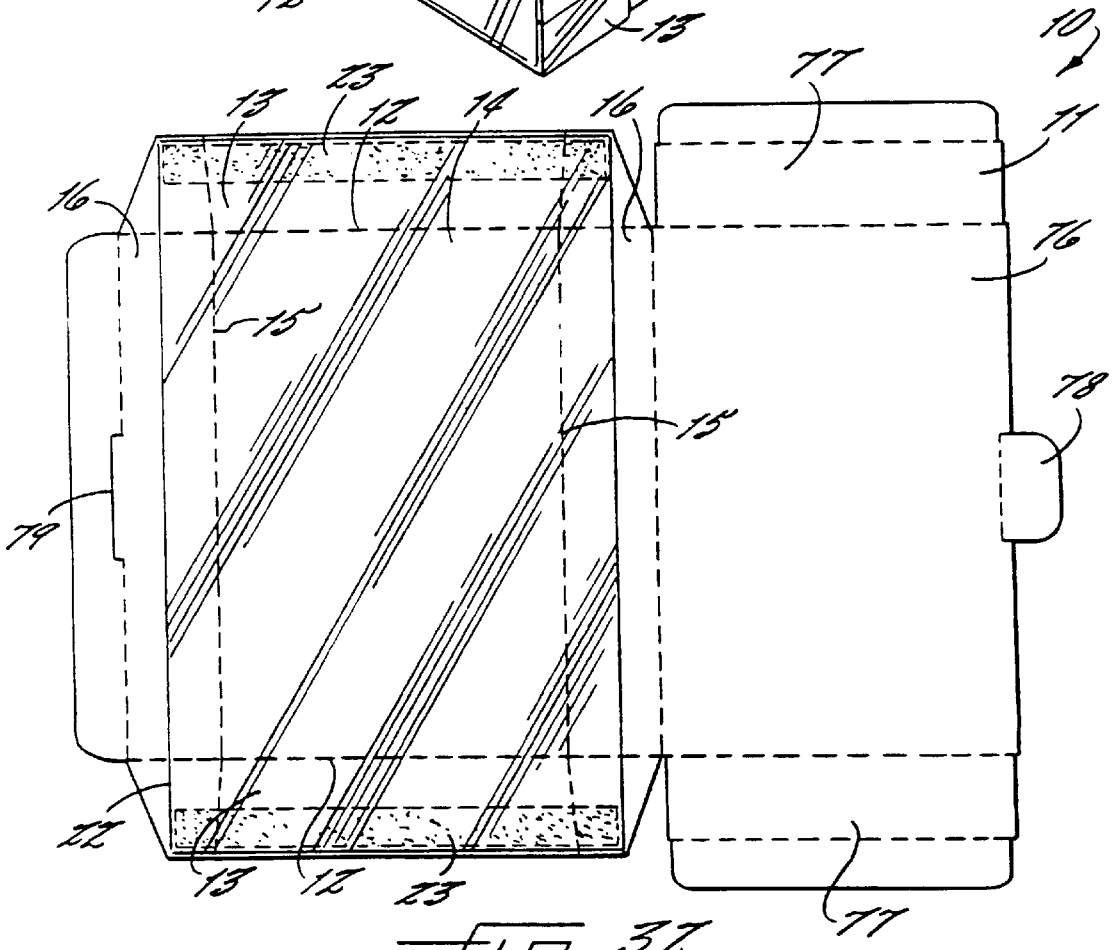
FIG. 32 is a top plan view of the fourteenth embodiment shown in an unfolded state.

A fourteenth embodiment of the packaging structure 10 is illustrated in FIGS. 31 and 32 and includes a box lid portion 76 attached to one of the folding end portions 16 for forming a self-contained box. The box lid portion 76 may include box side portions 77 attached thereto for forming the sides of the box when the box lid portion 76 is closed. The box lid portion 76 may also include a tuck tab 78 for receipt in a corresponding slot 79 in the folding end portion 16 so as to secure the box lid portion 76 and box side portions 77 in place. Accordingly, the fourteenth embodiment, when folded, constitutes a self-contained box and an external packing box 25 is not needed.

Figure 33:
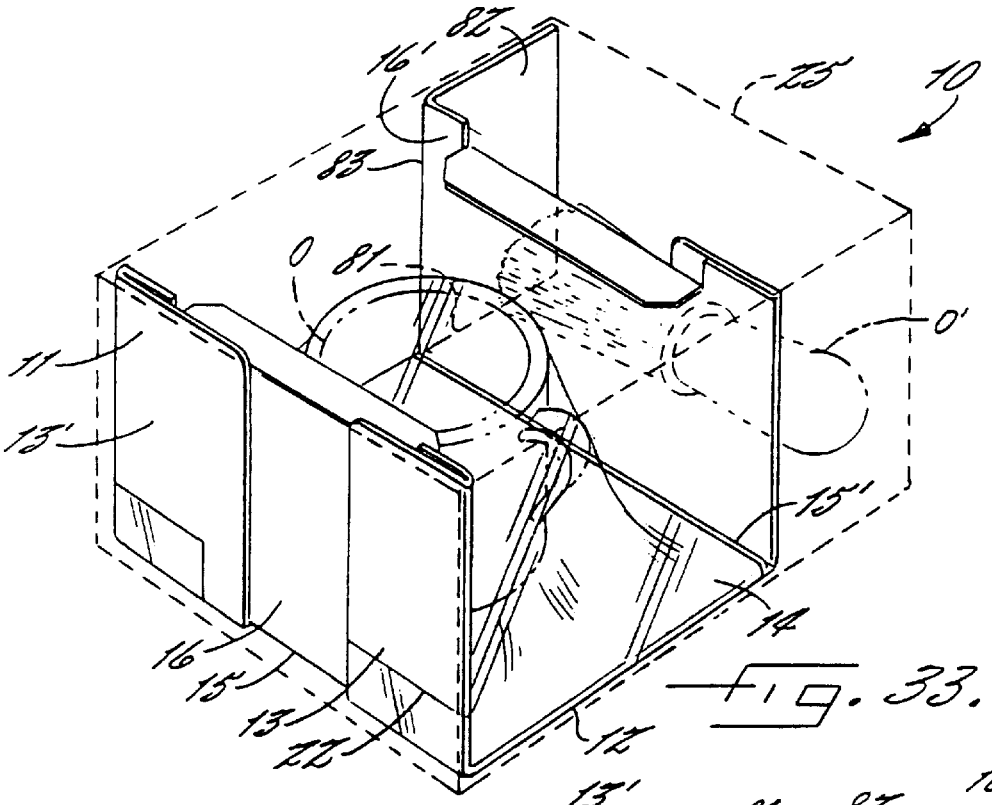
FIG. 33 is a perspective view of a fifteenth embodiment of the present invention illustrated within a protective box.
Figure 34:
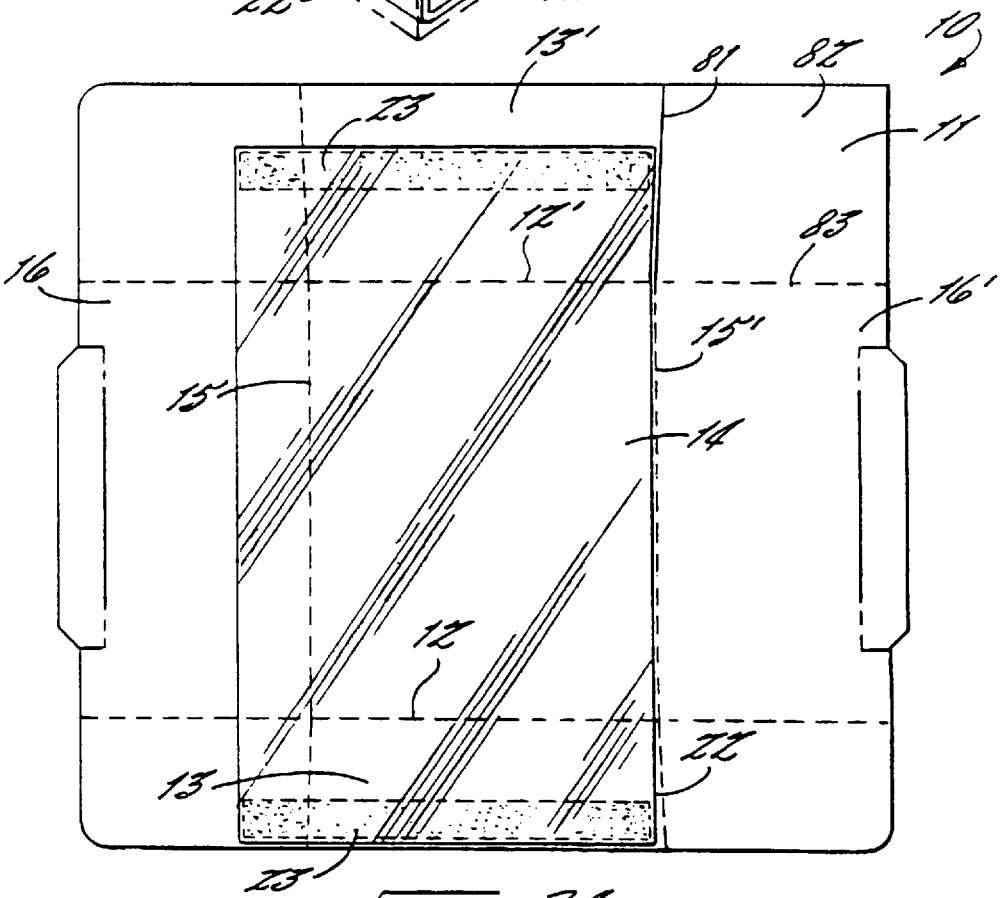
FIG. 34 is a top plan view of the fifteenth embodiment shown in an unfolded state.

A fifteenth embodiment of the packaging structure 10 is illustrated in FIGS. 33 and 34. The fifteenth embodiment includes a cut 81 formed in one of the folding side portions 13' and extending from one of the second pair of fold lines 15' to the distal edge of the folding side portion. Thus, the cut 81 forms a spacer tab 82 which is foldably connected to the adjacent folding end portion 16' by way of a portion 83 of the first fold line 12'. Accordingly, when the folding end portion 16' is folded upwardly towards the film 22, the spacer tab 82 may be folded away from the center panel portion 14 to the position shown in FIG. 33. The spacer tab 82 thus spaces the center panel portion 14 from an interior wall of the box 25. This may be advantageous when packaging two objects, one of which is fragile O, the other of which o' is not. For example, as shown in FIG. 33, a fragile shaving mug O may be placed against the center panel portion 14, but a less fragile shaving brush O' may be placed in the space created by the spacer tab 82 between the folding end portion 16' and the interior wall of the box 25. This can reduce packaging costs when it is not necessary to retain an object O' with the plastic film material 22.

Figure 35:
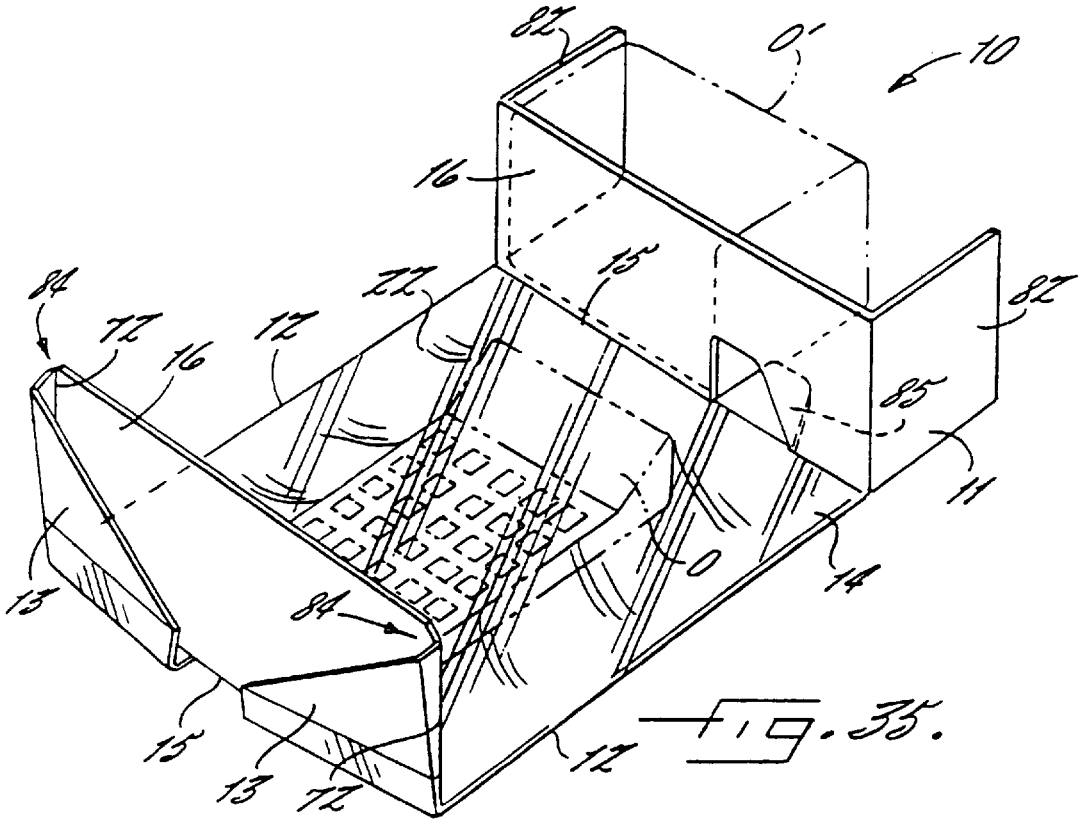
FIG. 35 is a perspective view of the sixteenth embodiment of the present invention.
Figure 36:
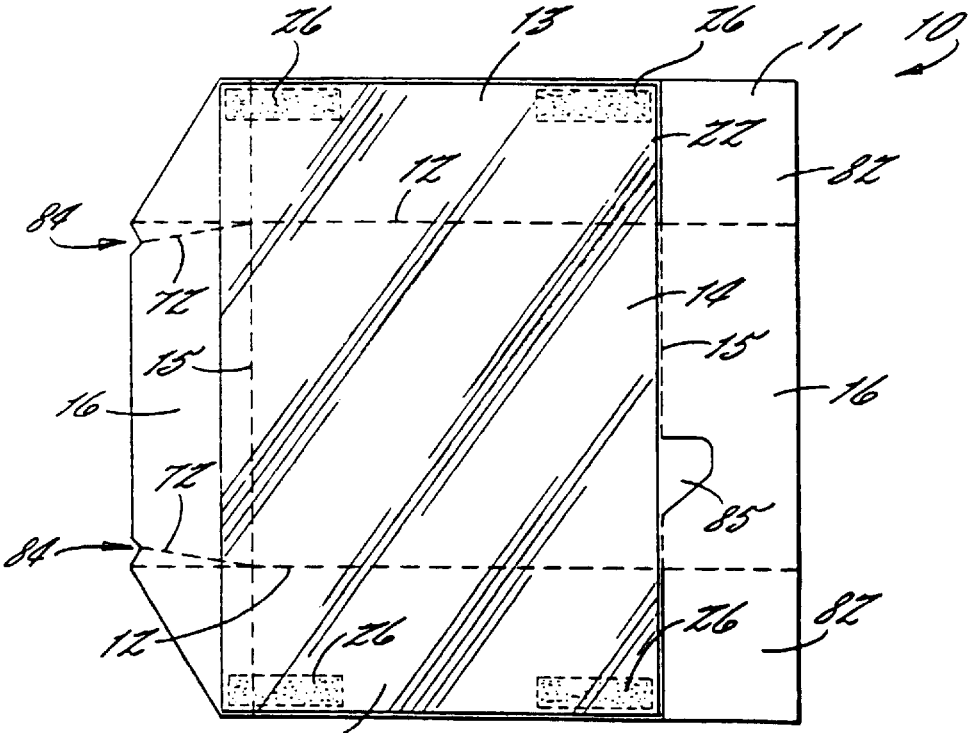
FIG. 36 is a top plan view of the sixteenth embodiment.

A sixteenth embodiment of the packaging structure 10 is illustrated in FIGS. 35 and 36, which is similar to the tenth embodiment illustrated in FIGS. 23 and 24. In the present embodiment, however, two notches 84 are formed in the distal edges of the folding end portions 16. These notches 84 shorten the length of the supplemental fold lines 72 relative to the adjacent portions of the first fold lines 12 and will thus more readily "break" (begin to fold) when the folding end portions 16 are folded upwardly towards the film 22. As illustrated, the sixteenth embodiment may also include two spacer tabs 82 of the type discussed above in connection with the fifteenth embodiment. A positioning tab 85 may also extend from the center panel portion 14 into the space created by the spacer tabs 82, to help position an object O' packaged in the space.

Figure 37:
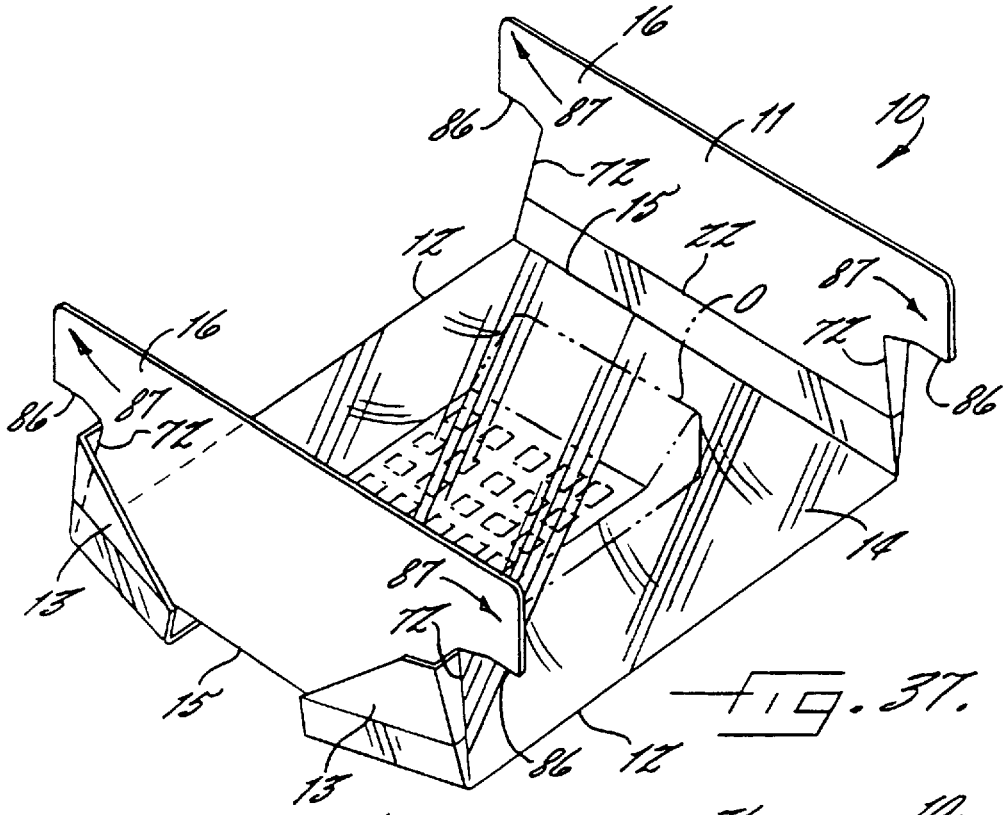
FIG. 37 is a perspective view of the seventeenth embodiment of the present invention.
Figure 38:
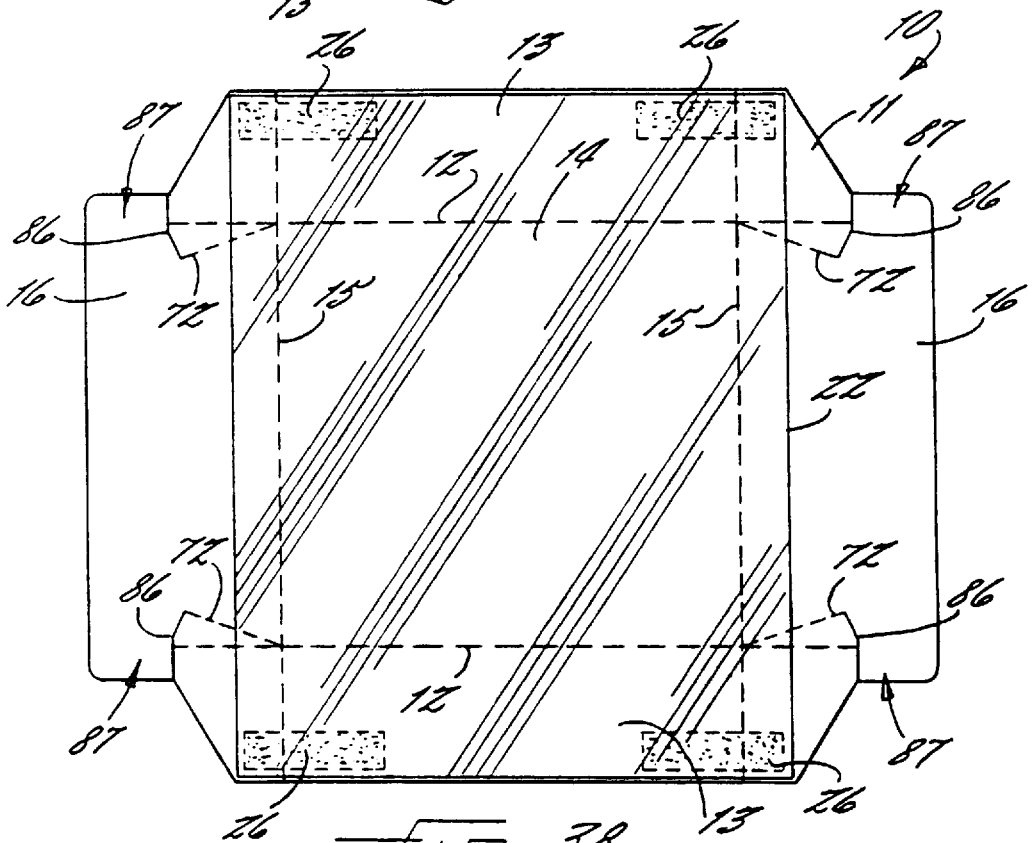
FIG. 38 is a top plan view of the seventeenth embodiment illustrated in an unfolded state.

A seventeenth embodiment of the packaging structure 10 is illustrated in FIGS. 37 and 38. The seventeenth embodiment is similar to the sixteenth embodiment in that it includes supplemental fold lines 72 which are shorter than the adjacent portions of the first pair of fold lines 12. In the seventeenth embodiment, however, cuts 86 are formed in the folding end portions 16 such that the supplemental fold lines 72 and the respective portions of the first fold lines 12 do not extend entirely across the folding end portions 16. Accordingly, when the folding end portions 16 are folded upwardly towards the film 22, they extend further upwardly than the ends of the first fold lines 12. In addition, the folding end portions 16 may extend further outwardly than the sides of the center panel portion 14 so that, when placed in a box 25, the projecting portions 87 of the folding end portions 16 contact the interior of the box. In this manner, the first pair of fold lines 12 are spaced from the interior of the box 25 and the center panel portion 14 does not directly contact the interior walls of the box at any point, thus further protecting the packaged object O.

Figure 39:
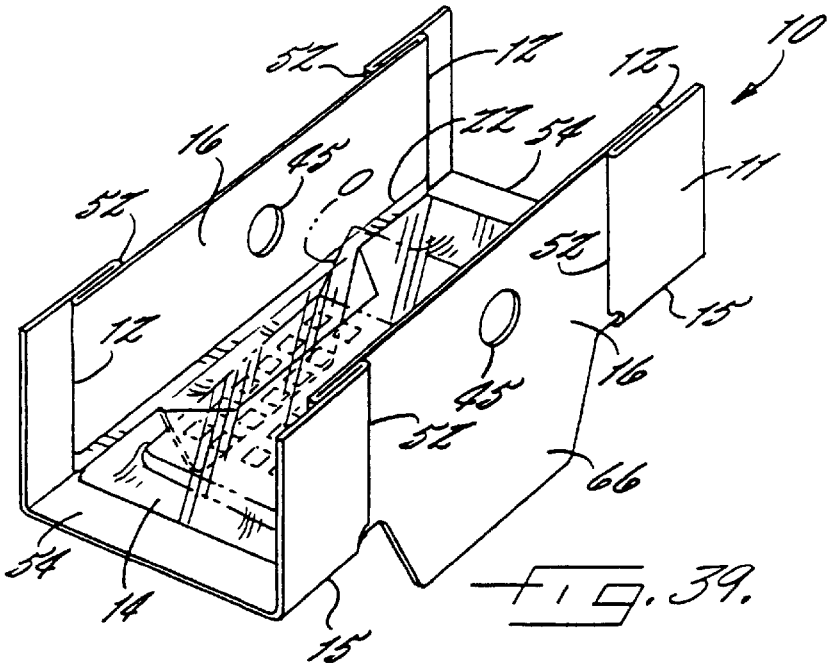
FIG. 39 is a perspective view of an eighteenth embodiment of the present invention.
Figure 40:
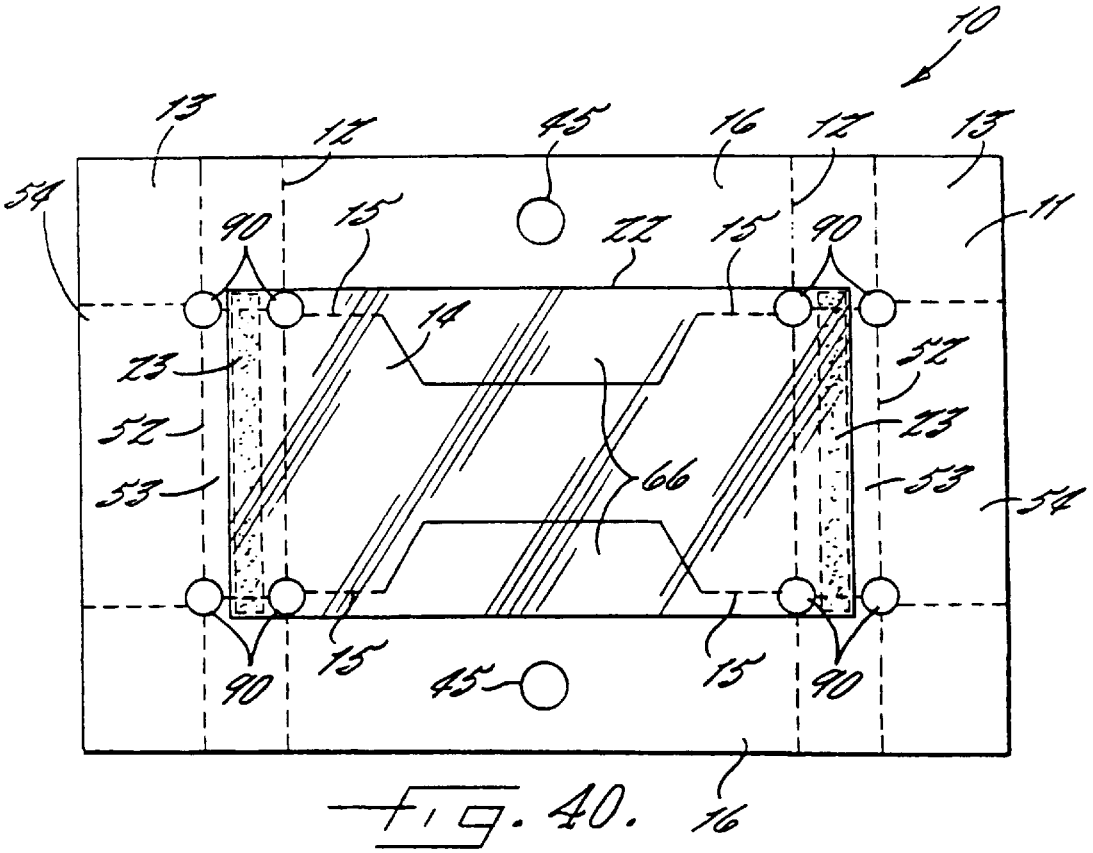
FIG. 40 is a top plan view of the eighteenth embodiment.

An eighteenth embodiment of the packaging structure 10 is illustrated in FIGS. 39 and 40 and includes a third pair of fold lines 52 located distally of both the first pair of fold lines 12 and the glue strips 23, thereby defining proximal 53 and distal 54 folding segments with the glue strips on the distal segments. The proximal segments 53 may first be folded in the manner discussed above so as to tighten the plastic film material 22 against the object O. The distal segments 54 may then be folded back in the opposite direction into the position shown in FIG. 39. It will be understood that this accordion-type folding enhances the shock absorbing function of the folding side portions 13, and it also serves to keep the center panel portion 14 away from the side of the box.

The eighteenth embodiment may also include holes 90 formed at the intersections of the second pair of fold lines 15 and the first 12 and third 52 pair of fold lines, so as to allow easier folding of the end portions 16 along the second pair of fold lines 15. The eighteenth embodiment also illustrates the handle holes 45 illustrated in the fifth embodiment in FIGS. 13 and 14. The drawings of the eighteenth embodiment also illustrate the vertical spacer tabs 66 of the eighth embodiment illustrated in FIGS. 19 and 20.

Figure 41:
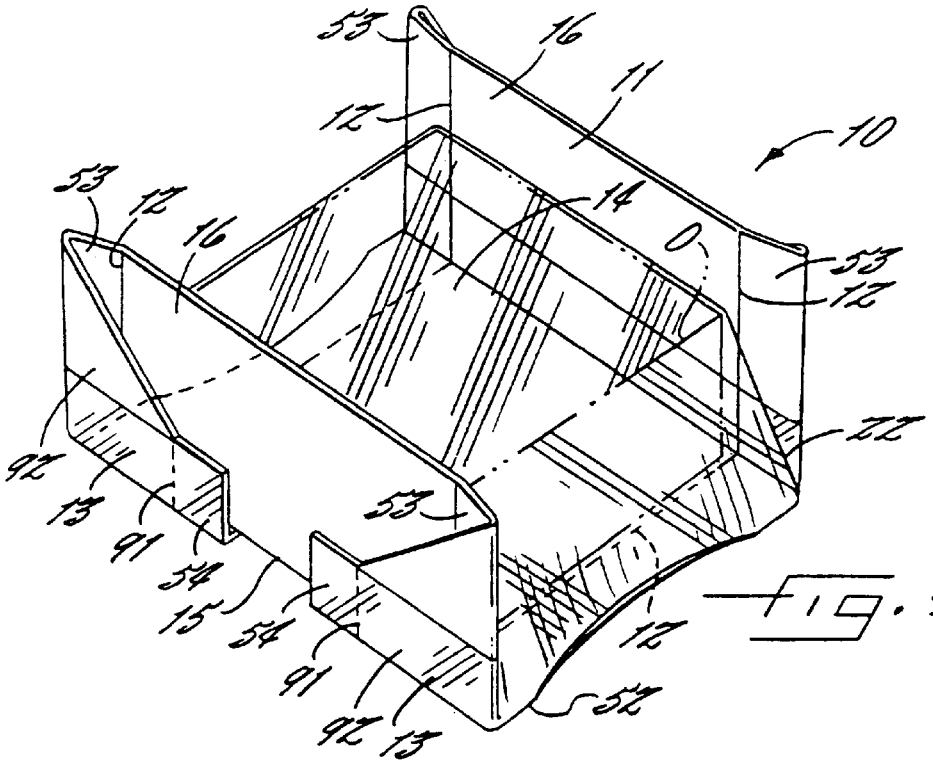
FIG. 41 is a perspective view of a nineteenth embodiment of the packaging structure of the present invention.
Figure 42:
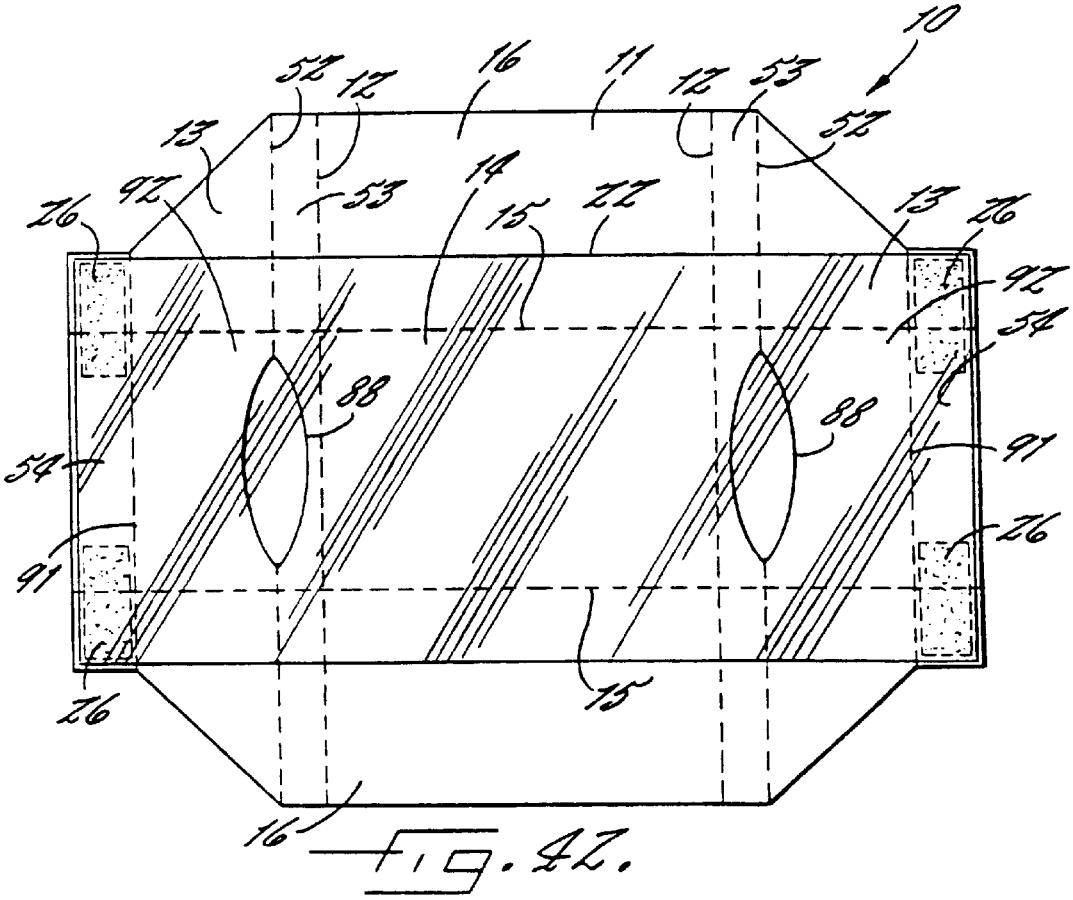
FIG. 42 is a top plan view of the nineteenth embodiment.

A nineteenth embodiment of the packaging structure 10 of the present invention is illustrated in FIGS. 41–43. The nineteenth embodiment includes an elliptical opening 88 formed in each of the folding side portions 13 along a third pair of fold lines 52. As such, the nineteenth embodiment is particularly useful for taller object O because, when the folding side portions 13 are folded along the third pair of fold lines 52, the openings 88 define a recess into which the plastic film material 22 may contract. Accordingly, the amount of tension applied to the object O across its mid-section is decreased because the circumferential distance about which the film 22 is drawn is smaller than the distance about which the film is drawn over the ends of the object.

Although one elliptical opening 88 is illustrated in each of the third pair of fold lines 52, it will be understood that the openings may have a different shape, number, and position. For example, the openings could be formed in the first pair of fold lines 12 to accomplish the same result.

Another notable feature of the nineteenth embodiment is the fourth pair of fold lines 91 formed in the folding side portions 13 immediately adjacent to the glue strips 23, or glue strip segments 26 as shown, thereby defining folding side portions having distal 54, medial 92, and proximal 53 segments. The securing power of a glue strip segment 26, in terms of the amount of tension which may be applied to the plastic film material 22, decreases as the angle $\gamma$ between the unsecured film and the glue strip segment increases. In other words, as the angle $\gamma$ of the tensile force approaches 90° relative to the glue strip segment 26, the plastic film material 22 is more likely to peel away from the glue strip segment. With taller objects O of the type illustrated in FIG. 43A, the angle $\gamma$ between the film material 22 and the folding side portion 13 is increased and may be large enough to cause the plastic film material 22 to peel away from the glue strip segment 26.

Figure 43A:
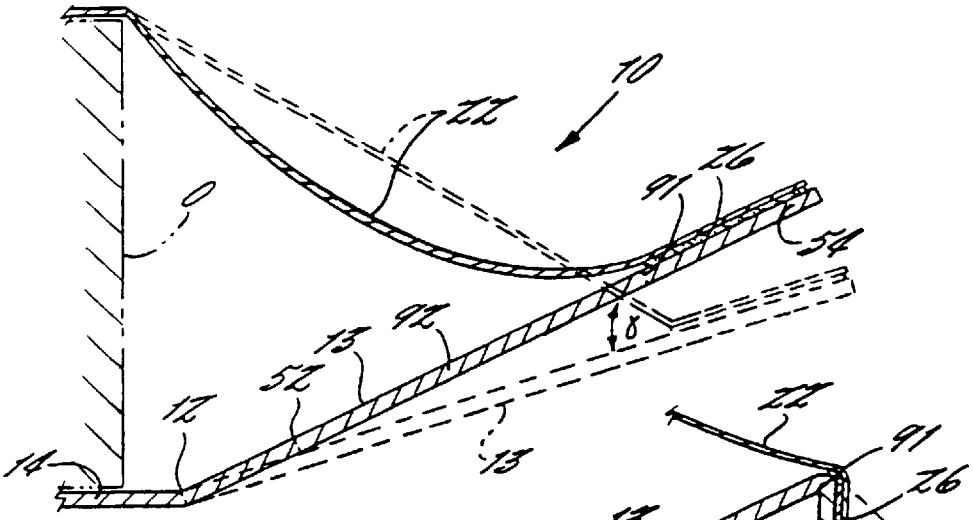
FIGS. 43A–43D are partial sectional views of the nineteenth embodiment illustrating the sequence used in folding the side portions.
Figure 43B:
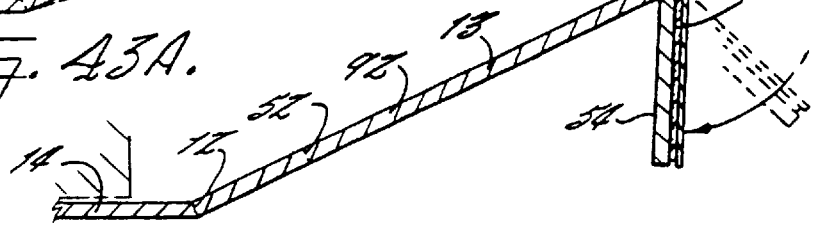

In the present embodiment of the invention, the smaller distal segments 54 may be folded under (away from the film 22) prior to folding the side portions 13 along the first 12 and third 52 pair of fold lines, as illustrated in FIG. 43B. After the distal segments 54 have been folded under, the tension angle $\gamma$ is substantially 0° because the plastic film material 22 is maintained flat against the entire distal segment. The proximal 53 and medial 92 segments may then be folded under as illustrated in FIG. 43C and distal segments 54 are folded back to a position coplanar with medial and proximal segments as illustrated in FIG. 43D.

Figure 43C:
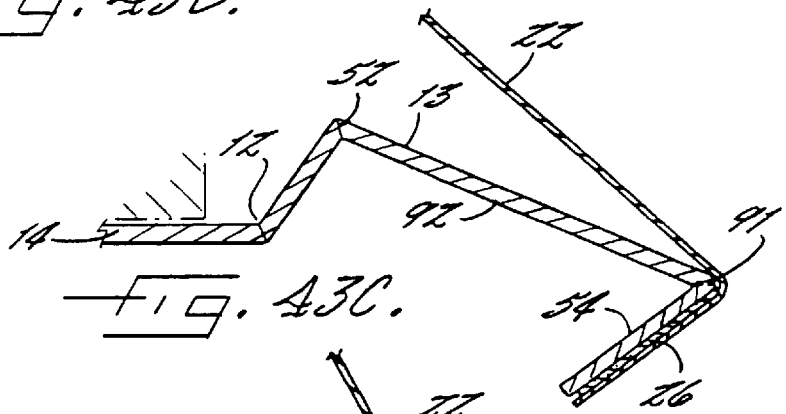
Figure 43D:
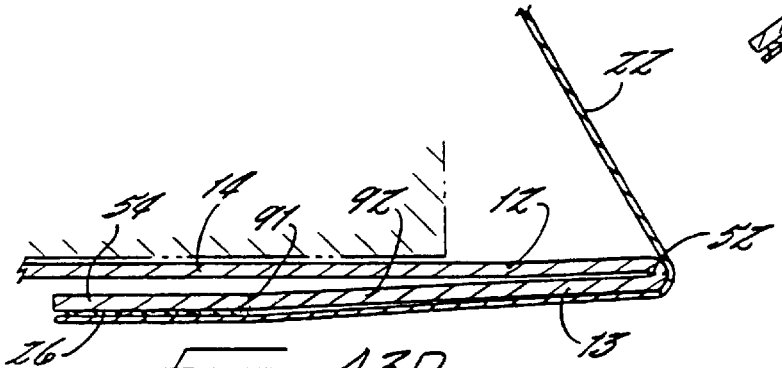

Additionally, as illustrated in the sequence of FIGS. 43B–43D, when the folding side portions 13 are folded under the center panel portion 14, the proximal segment 53 is folded slightly upwardly during the initial stages of the folding. As will be understood, however, after the plastic film material 22 is brought into contact with the entire medial portion 92, continued folding causes the proximal segment 53 to begin to fold downwardly in the opposite direction. This feature causes further increased tension in the plastic film material 22 and a more secure packaging of the object O.

Figure 44:
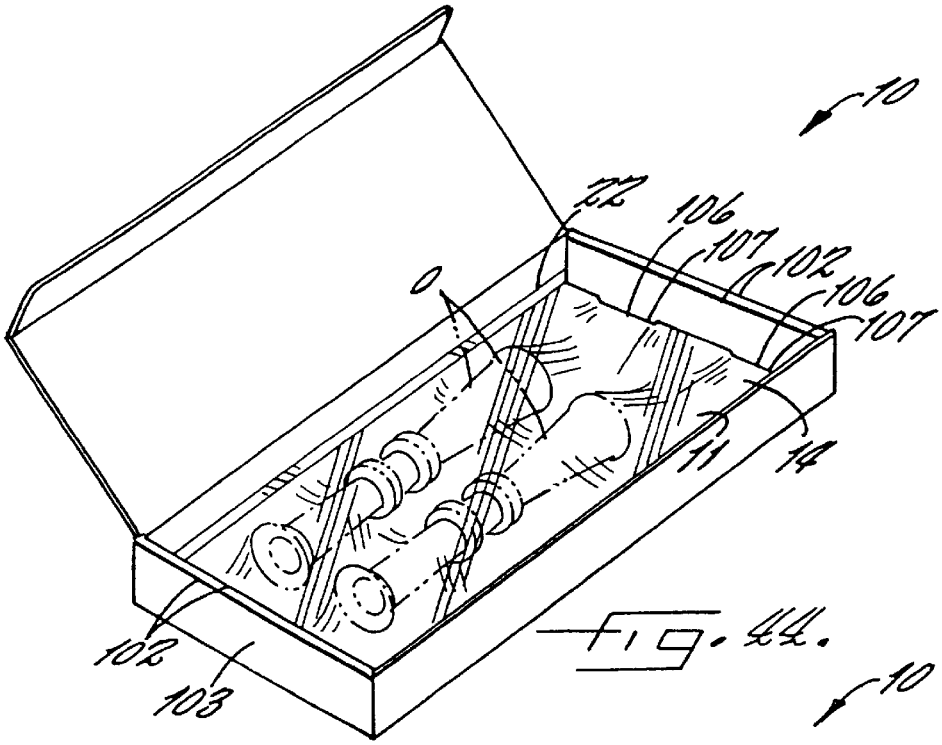
FIG. 44 is a perspective view of a twentieth embodiment of the present invention.
Figure 45:
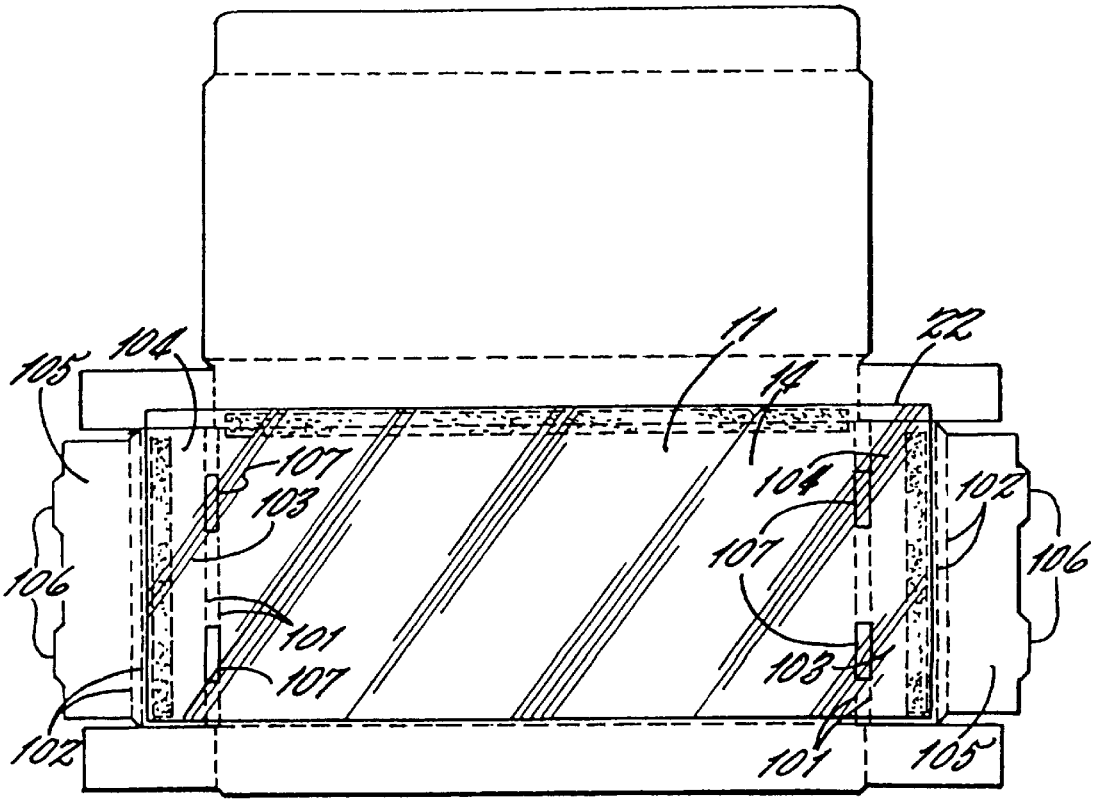
FIG. 45 is a top plan view of the twentieth embodiment in an unfolded state.

The twentieth embodiment of the packaging structure 10 is illustrated in FIGS. 44 and 45 and includes a center panel portion 14 with a flexible film material 22 superimposed on one surface thereof. The rigid panel 11 includes first 101 and second 102 pairs of fold lines which define folding side portions 103 having proximal 104 and distal 105 segments. Each fold line may actually include two closely spaced sub-lines which account for the thickness of the rigid panel material.

The distal edges of the distal segments 105 include at least one film tightening projection 106 for receipt in a corresponding opening 107 formed in the center panel portion 14. As illustrated in FIG. 45, each distal segment 105 may include two projections 106 and the center panel portion 14 may include four openings 107. To construct the twentieth embodiment, the proximal segment 104 is first folded upwardly towards the film 22. The distal segment 105 is then folded in the same direction so as to be flat against the film side of the proximal segment 104. The film tightening projections 106 are inserted into the openings 107 and force the plastic film 22 material into the openings. The resultant displacement of the film material 22 into the openings 107 causes the film material to be further tightened against the object or objects O being packaged.

An associated method for packaging an object also forms a part of the present invention and is directed to packaging an object O in a packaging structure 10 including a substantially rigid panel 11 having a pair of folding side portions 13 and a flexible film material 22 secured to the folding side portions. The method includes the steps of folding the side portions 13 in a direction toward the film 22, inserting the object O to be packaged between the film and the rigid panel 11, and then folding the side portions in the opposite direction to that of the first folding step. The side portions 13 are folded away from the film 22 until they are adjacent to the surface of the panel 11 which is opposite the film. The side portions 13 may then be secured in the folded position. The folded structure 10 can be placed into a box 25 for further handling and/or shipping.

A twenty-first embodiment of the present invention is illustrated in FIGS. 46–50. In the previous embodiments, the packaging structure 10 includes means for securing the film 22 to the folding side portions 13 of the rigid panel 11 including a pair of glue strips 23 extending along the distal edge of the folding side portions 13. In this embodiment, the means for securing one end of the film 22 to the panel 11 removably and adjustably secures the end of the film 22 to the respective folding side panel 13. In a preferred embodiment, a first end 108 of the film includes means constituting a glue strip 23 for securing the first end 108 of the film to a respective folding side portion 13. The glue strip 23 extends along the respective folding side portion 13.

A second end 109 of the film 22 is removably secured to the respective folding side portion 13 to assist in the placement of the object O within the packaging structure, i.e., between the film 22 and rigid panel 11. It may be beneficial according at least to some of the previously described embodiments, depending upon the size of the object O, to prop the folding side portions 13 upward during placement of the object O in the packaging structure 10. According to this embodiment, it is unnecessary to position the side portions 13 upward because the second end 109 is removably secured to the respective folding side portion 13.

The second end 109 of the film carries a securing member 110 by a second securing means 111. Preferably, the second securing means 111 includes a pair of glue strips 112 extending a significant distance along the width of the film 22. The width of the film as used herein refers to the dimension of the film transverse to the length of the film defined between the first 108 and second ends 109. An unsecured portion of the film 22 extends between the pair of glue strips 112. Of course, it would be readily apparent to one of ordinary skill in the art that there are many other equivalent means of securing the second end 109 of the film 22 to the securing member 110.

The securing member 110, preferably, is elongate and extends at least along the width of the film 22, e.g., it extends beyond the width of the film. The securing member 110 is formed of a material more rigid than the film 22 such as paperboard, cardboard or plastic. It will be appreciated that, although denominated as rigid, the chosen material would preferably have a certain amount of flexibility in the cases of extreme physical impact and that the use of very rigid materials, such as metals, may not be desirable. One preferred material is a single wall corrugated cardboard such as B-flute or E-flute corrugated cardboard. In a preferred embodiment, the securing member 110 may be formed of the same material as the substantially rigid panel 11. The securing member 110 may also define a notch 115.

One of the folding side portions 13 includes a mating member 113 for mating with the securing member 110. A pair of apertures may comprise separate mating members 113 and be provided on the folding side portions 13 for adjustability purposes as discussed below. Of course, any number of mating members 113 may be provided without departing from the scope of the present invention. The mating member 113 is defined by an aperture having a predetermined configuration. The configuration illustrated is an elongate, oblong configuration with a dimension to receive the securing member 110 and includes a protrusion 114. Alternatively, the securing member 110 may be configured to mate with the distal edge of the respective folding side portion 13. For example, the securing member may merely hook over or otherwise releasably mate with a portion of the folding side portion. Also, a mating member may be included on each folding side portion and both the first and second ends of the film may be removably secured to the respective folding side portion. The folding side portions 13 are illustrated as having a particular length, but it is within the scope of this invention for the side portions to be relatively shorter or longer than illustrated.

The securing member 110 is correspondingly configured to be received within the mating member 113. As set forth above, the second end 109 of the film 22 is secured to the securing member 110 with a pair of glue strips 112 defining an unsecured film portion therebetween. The distance d between the glue strips 112 is dimensioned to receive the protrusion 114 of the mating member 113 defined by the folding side portion 13. Accordingly, the securing member 110 may be received within the mating member 113 and secured therein due to the mating configurations of the members and the projection of the protrusion 114 of the mating member. A corresponding notch 115 of the securing member 110 aids with the insertion of the securing member into the mating member 113. Preferably, the configurations of the securing member 110 and the mating member 113 are substantially similar, e.g., the securing member may even be a portion removed from the folding side portion 13 so as to define the mating member, such as by a stamping process.

Figures 48, 49, 50:
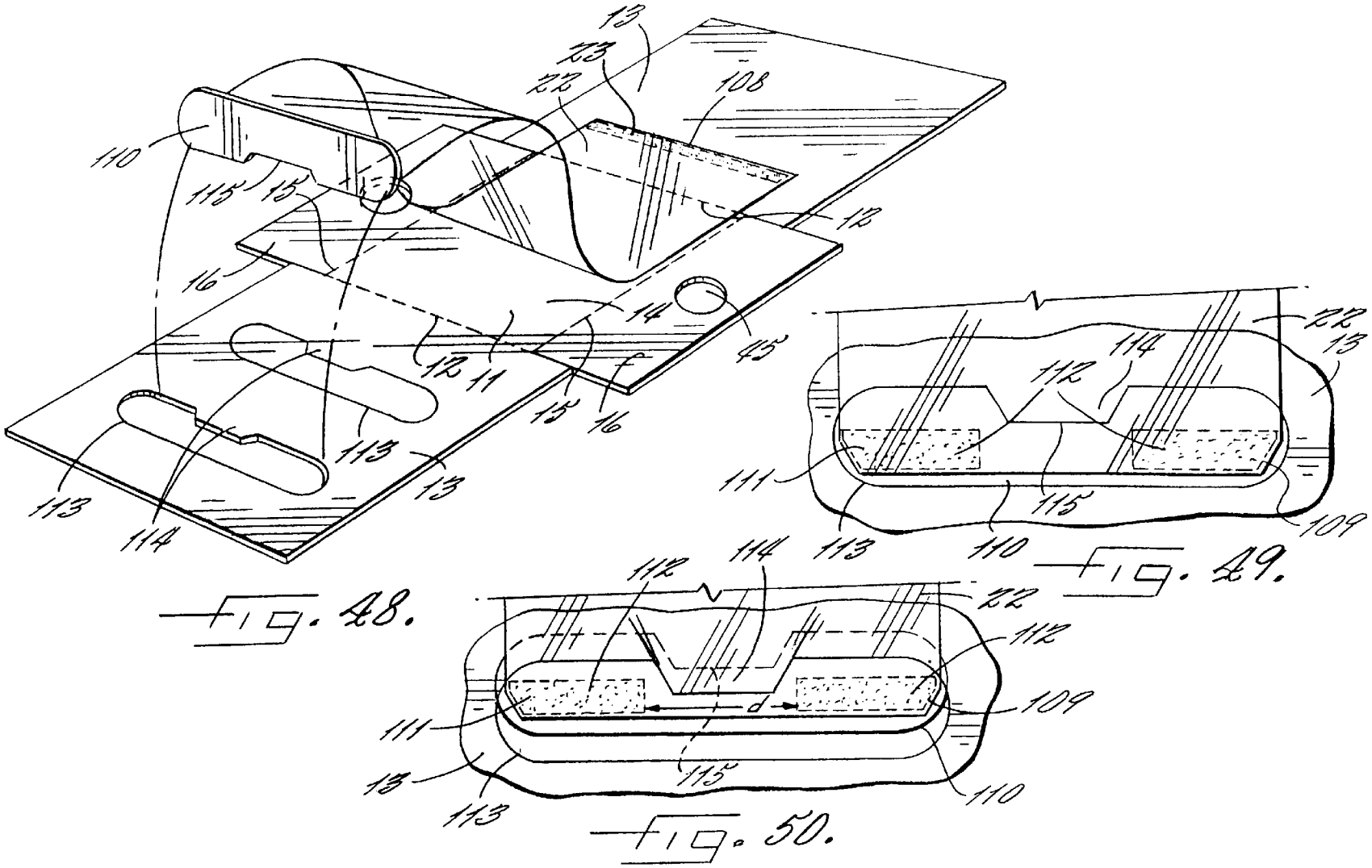
FIG. 48 is a perspective view of the twenty-first embodiment in an unfolded state.
FIG. 49 is an enlarged fragmentary view of the securing member and mating member of the twenty-first embodiment in a first position.
FIG. 50 is an enlarged fragmentary view of the securing member and mating member of the twenty-first embodiment in a secured position.

FIGS. 48–50 illustrate the manner of securing an object O in the packaging structure 10. According to this embodiment, an object O of any height may be positioned upon the center portion 14 of the rigid panel 11 without requiring that the folding side portions 13 be inclined upwardly for placing the film 22 in a relaxed and loose condition. The securing member 110 is initially removed from the mating member 113 and is then grasped and pulled over the object O in the direction of the mating member. Depending upon the height of the object O and the degree of tautness of the film 22 desired and permitted, the securing member 110 may be positioned in any one aperture of the plurality of apertures in the folding side portion 13.

Figure 46:
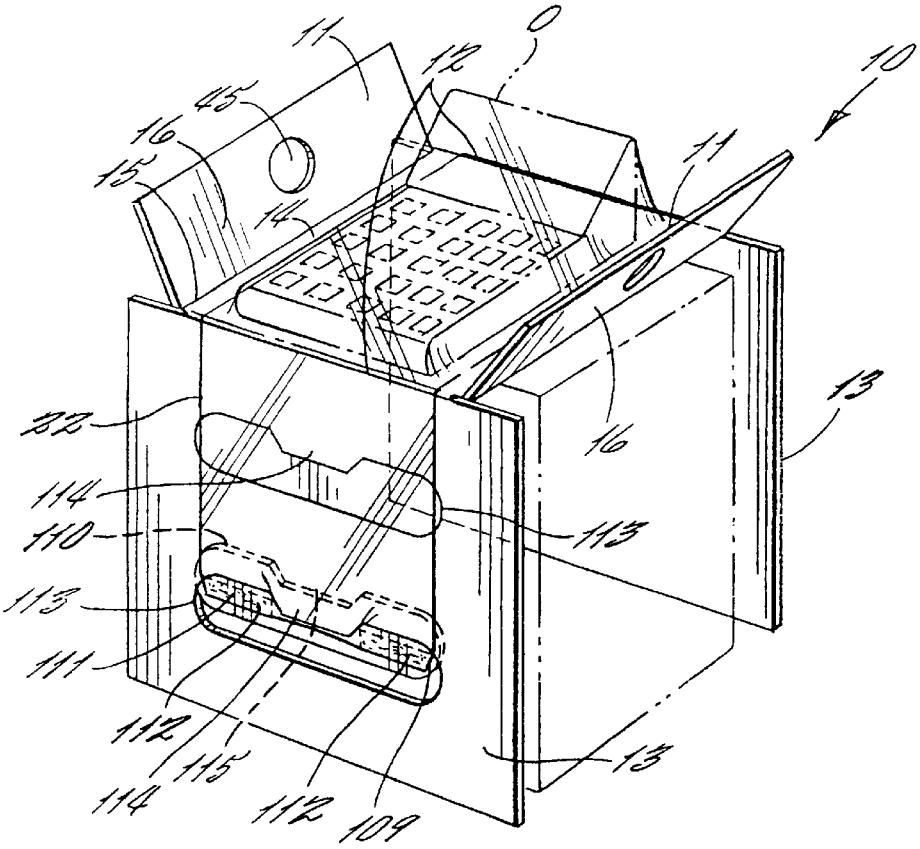
FIG. 46 is a perspective view of a twenty-first embodiment of the present invention.

The folding side portions 13 are then folded downward to tighten the film 22 about the object O as illustrated in FIG. 46. The folding side portions 13 may be folded any degree relative to the center panel portion 14, including folded so as to extend against the rear side of the center panel portion (e.g., as in the embodiment illustrated in FIG. 1). As illustrated in FIG. 46, when the folding side portions 13 are folded so as to extend perpendicular to the center panel portion 14, the packaging structure 10 readily conforms to a receptacle such as a box which may, for example, contain related accessories for the object O.

An aperture or opening (similar to the opening 55 illustrated in FIG. 15) may be defined by the center panel portion 14 so as to receive a portion of an object O such as one that is tall or has a portion which extends outwardly from the major plane of the object. For instance, in the embodiment illustrated in FIG. 46, a portion of the object O may be received within the opening so as to extend beneath the center panel portion 14. The angular positioning of the folding side portions 13 causes the center panel portion to be spaced from the bottom of a packaging box and facilitates the packaging of such an object O.

FIG. 49 illustrates a preferred embodiment wherein the configuration of the securing member 110 is substantially the same as the mating member 113 and wherein the two may be positioned so as to be flush. When the securing member 110 is urged completely through the aperture of the mating member 113, the protrusion 114 defined by the securing member is urged within the unsecured portion of the film which extends across the distance d defined between the pair of glue strips 112. This is illustrated in FIG. 50. Accordingly, the securing member 110 is secured with the mating member 113. The folding side portions 13 are then folded downward along the first pair of fold lines 12 and the folding end portions 16 are folded upward along the second pair of fold lines 15 to support the object O within the external box. The film 22 including the first end 108 and second end 109 carrying the securing member 110 for mating with a mating member 113 may be employed in several or all of the embodiments discussed herein as desired.

Figure 47:
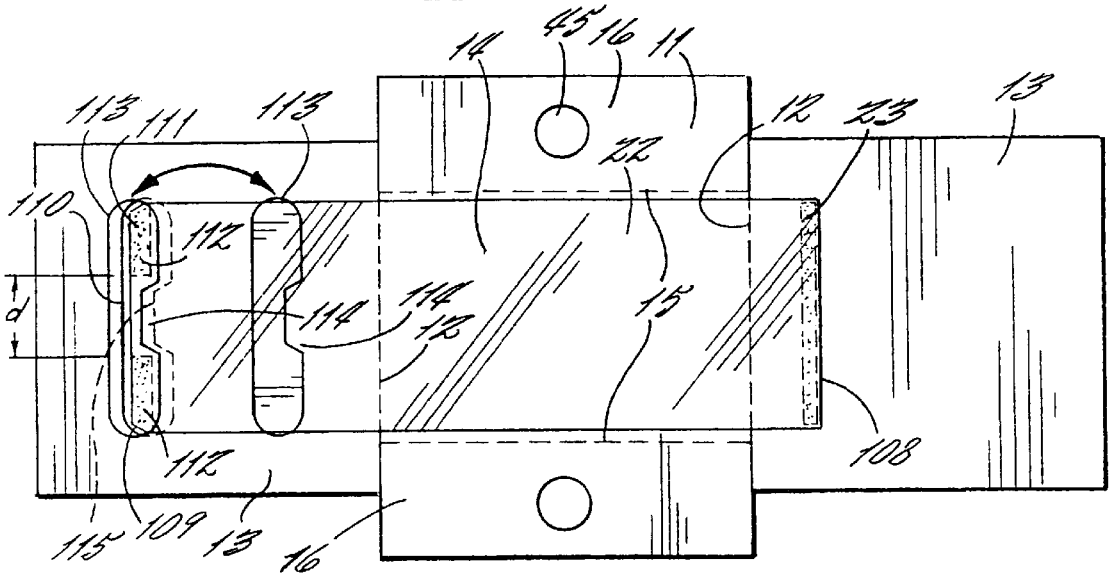
FIG. 47 is a top plan view of the twenty-first embodiment in an unfolded state.

The embodiment of the packaging structure 10 illustrated in FIGS. 46–50 may be used in alternative manners. For instance, the securing member 110 may be secured to the mating member 113 such as by insertion therethrough as illustrated in FIG. 47. The folding side portions 13 may be upwardly folded to loosen the film 22 relative to the center panel portion 14 of the rigid panel 11 without first removing the securing member 110. The object O can then be positioned between the film 22 and the center panel portion 14 and the folding side portions 13 then folded down as discussed above to tighten the film.

Figure 51:
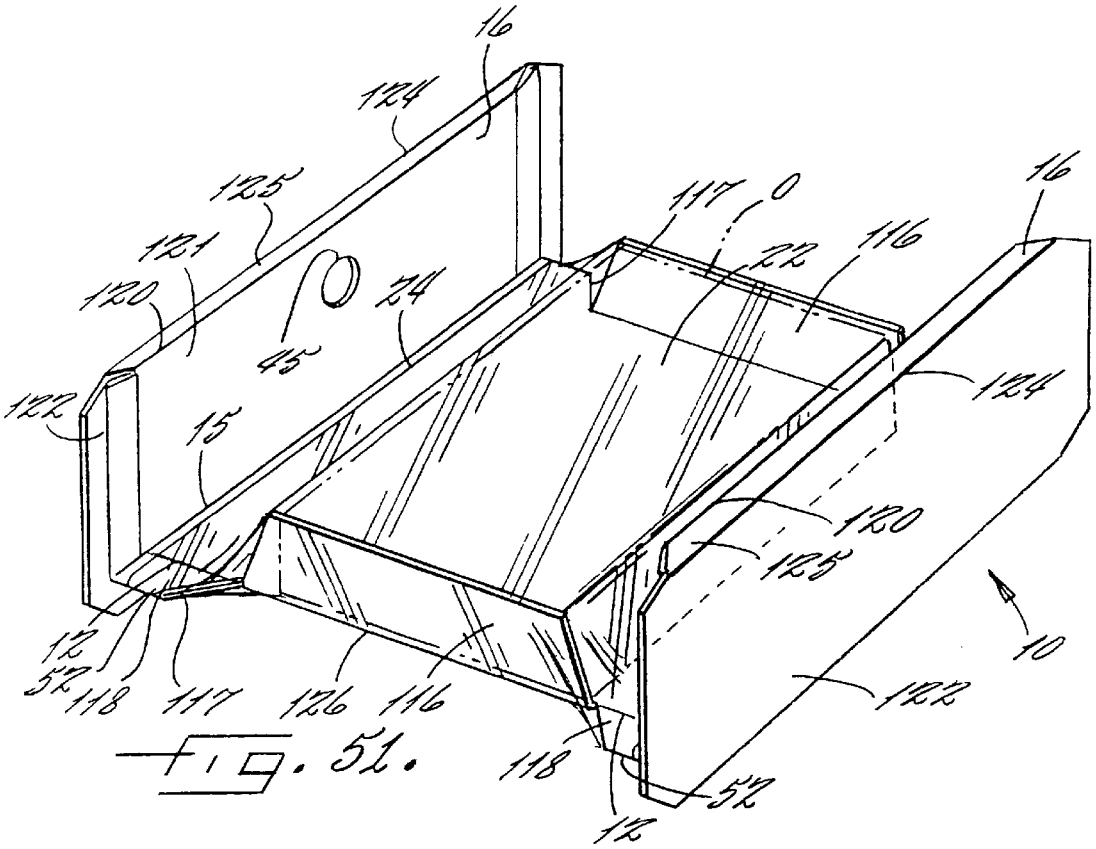
FIG. 51 is a perspective view of a twenty-second embodiment of the present invention.
Figure 52:
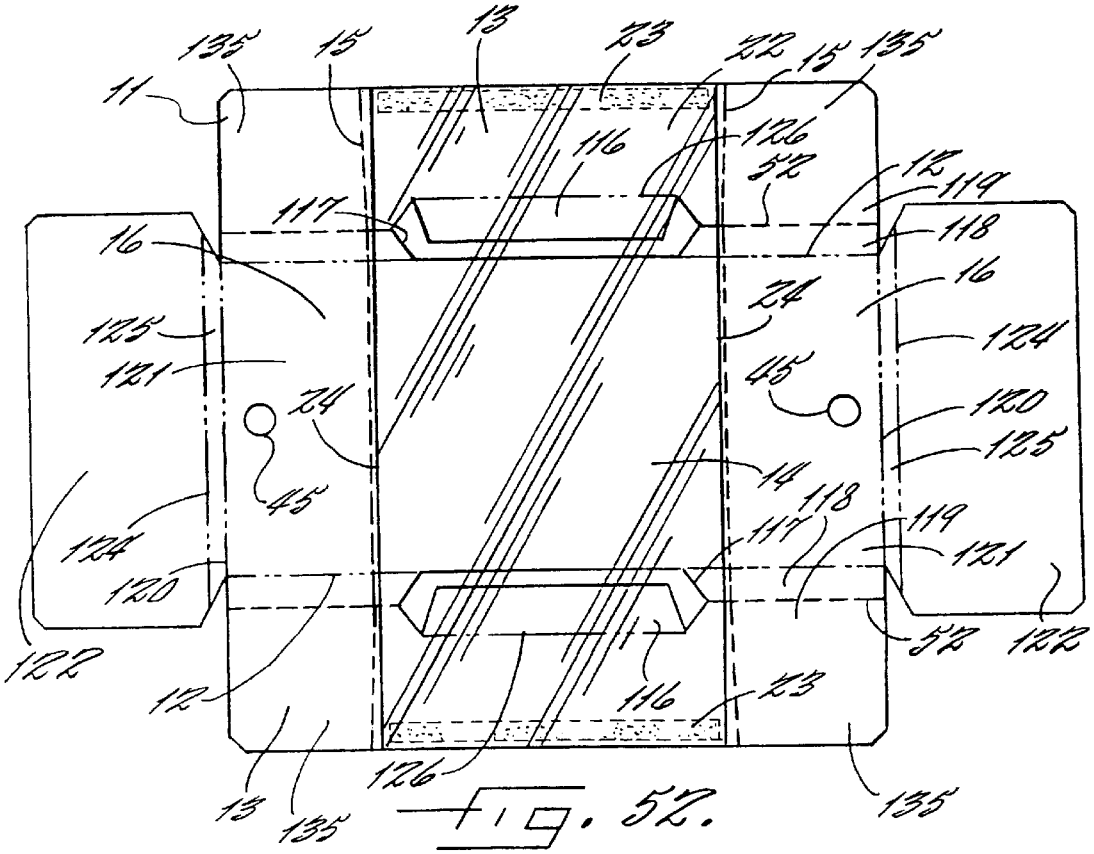
FIG. 52 is a top plan view of the twenty-second embodiment in an unfolded state.

A twenty-second embodiment of the present invention is illustrated in FIGS. 51 and 52. As with the previous embodiments, like or similar elements will be referenced by the same reference numbers as previously used. According to this embodiment of the present invention, the film 22 contacts at least the upper surface of the object O. The film 22 defines a pair of unsecured edge portions 24. The configuration of the packaging structure 10 according to this embodiment, prior to the folding thereof, is best illustrated in FIG. 52. The packaging structure 10 includes a rigid panel 11 having a pair of parallel first fold lines 12 defining a center portion 14 therebetween. The folding side portions 13 extend beyond the first fold lines 12, on opposing sides of the center portion 14.

A second pair of fold lines 15 extend perpendicular to the first fold lines 12 so as to define a pair of folding end portions 16. The pair of folding side portions 13 each further include a third fold line 52 which extends generally parallel to the first fold line 12. The third fold lines 52 define a proximal segment 118 and a distal segment 119 of each of the folding side portions 13. Preferably, the first fold lines 12 are perforated and the third fold lines 52 are scored. However, it is within the scope of the invention for either one to be perforated or scored or both to be perforated or scored.

The film 22 is secured to the rigid panel 11 by a pair of glue strips 23, one located on each of the folding side portions 13. Alternatively, one edge of the film 22 may be secured to the packaging structure by a single glue strip 23 wherein the second end of the film is detachably secured to the packaging structure as described in the immediately prior embodiment.

At least one, and preferably both, folding side portions 13 includes a patterned cut 117 which defines a tab 116. As illustrated, each patterned cut 117 extends at least between the first fold line 12 and the third fold line 52, i.e., across the proximal segment 118 of the folding side portion 13. As illustrated in FIG. 52, the patterned cut 117 is elongate wherein its length is substantially greater than its width. Preferably, the width of the patterned cut 117 extends across the proximal segment 118 as well as a portion of the distal segment 119 as illustrated in FIG. 52 and its length extends across a substantial portion of the side portion 13 corresponding to the width of the center panel 14. The base of the tab 116 is defined by a sixth fold line 126 which extends the length of the tab. The width of each tab 116 is such that the tab extends from the sixth fold line 126 towards the center panel portion 14 and has an inner edge which is closer to the center panel portion than the respective third fold line 52.

The folding end portions 16 each further include a fourth fold line 120 which defines a proximal segment 121 and a distal segment 122 of the respective folding end portion 16. Preferably, the fourth pair of fold lines 120 is perforated and the second pair of fold lines 15 is scored, but either or both may be scored or perforated. The distal segments 122 of the folding end portions 16 also include a fifth pair of fold lines wherein an intermediate portion 125 is defined between the fifth pair of fold lines and the fourth pair of fold lines 120. Preferably the fifth pair of fold lines 124 are perforated, but they may also be scored. Each proximal segment 121 of the folding end portion 16 further defines a handle hole 45. The operation of this embodiment will now be described in detail. The folding side portions 13 are folded upward so as to relax the film 22. The object O may then be positioned upon the center portion 14 of the rigid panel 11 beneath the film 22. Once the object is properly positioned on the center panel 14, the folding side portions 13 are then folded downward, towards the rear side of the center portion 14 until the film 22 becomes stretched over the object O.

The folding side portions 13 fold more readily due to the third fold lines 52. When the folding side portions 13 are folded to an initial extent, the proximal segment 118 thereof extends at an obtuse angle from the center portion 14 and at an acute angle to the distal segment 119. When the folding side portions 13 are fully folded, the tabs 116 protrude upward through the patterned cuts 117 so as to extend substantially perpendicular or slightly outwardly with respect to the center panel portion 14. The protrusion of the tabs 116 relaxes the film 22 somewhat relative to the object O. This is because the tabs 116 raise the film 22 from the surface of the center portion 14. The film 22 contacts the upper surface of the object O and does not substantially contact the side portions (adjacent the tabs 116) thereof. Accordingly, the distance over which the film 22 must extend is shortened relative to the previous embodiments and taller objects O can be packaged without excessively stretching the film. The tabs 116 may also contact the sides of the object O to prevent lateral movement thereof. This is illustrated in FIG. 51.

Once the object O is securely positioned between the center portion 14 and the film 22, the folding end portions 16 may then be folded upward along the second fold lines 15. The fourth 120 and fifth 124 fold lines of the folding end portions 16 facilitate folding of the distal segment 122 of the folding end portion. Each distal segment 122 folds over the folded distal segments 119 of the folding side portions 13. When folded, the intermediate portion 125 extends at a right angle relative to the proximal segment 121. The intermediate portion 125 allows for the finite thicknesses of the proximal 121 and distal 122 segments and the intermediate corner panels 135 of the folding side portions 13. Another advantageous feature of the present invention is that the distal segments 122 of the folding end portions 16 can be longer than the proximal segments 121. Thus, in a fashion similar to that illustrated in FIG. 13, the center panel portion 14 can be spaced from the bottom of a box by the additional length of the distal segments 122, allowing for improved isolation of the object O from external damage. The folding packaging structure 10 as illustrated in FIG. 51 may then be positioned within an external box (not shown). The handle holes 45 may thereafter be used to facilitate removal of the packaging structure 10 from its external box.

Figure 53:
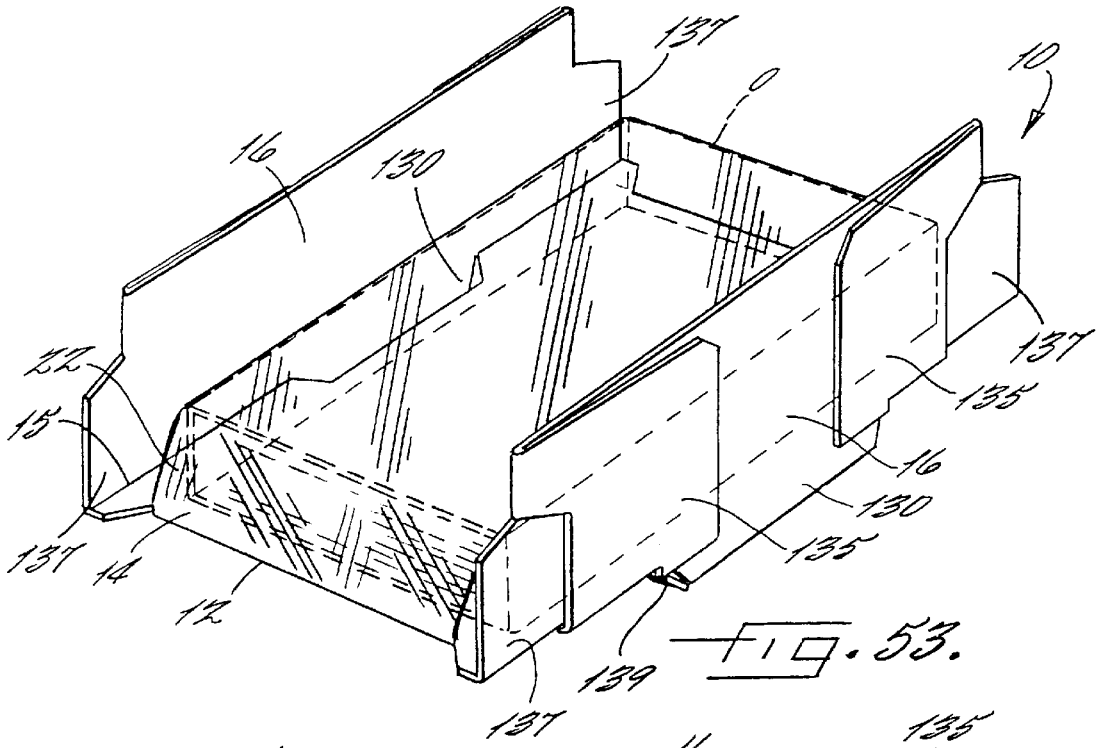
FIG. 53 is a perspective view of a twenty-third embodiment of the present invention.
Figure 54:
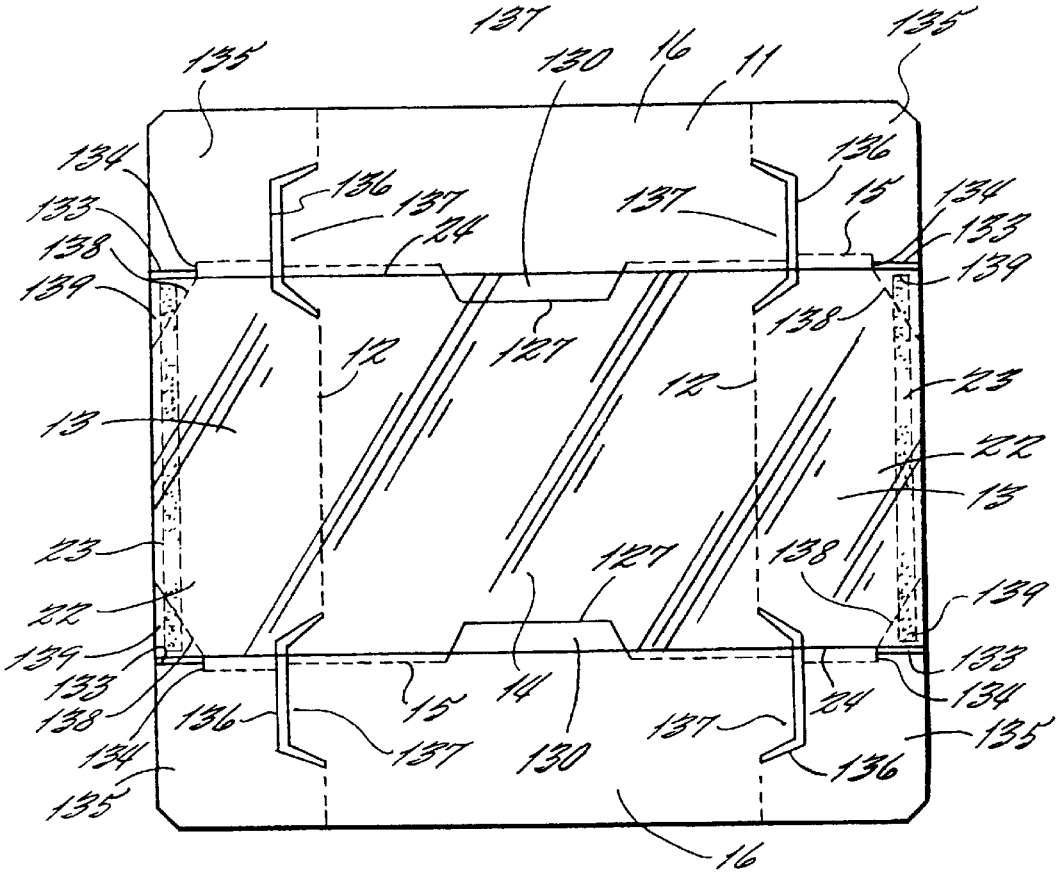
FIG. 54 is a top plan view of the twenty-third embodiment in an unfolded state.
Figure 55:
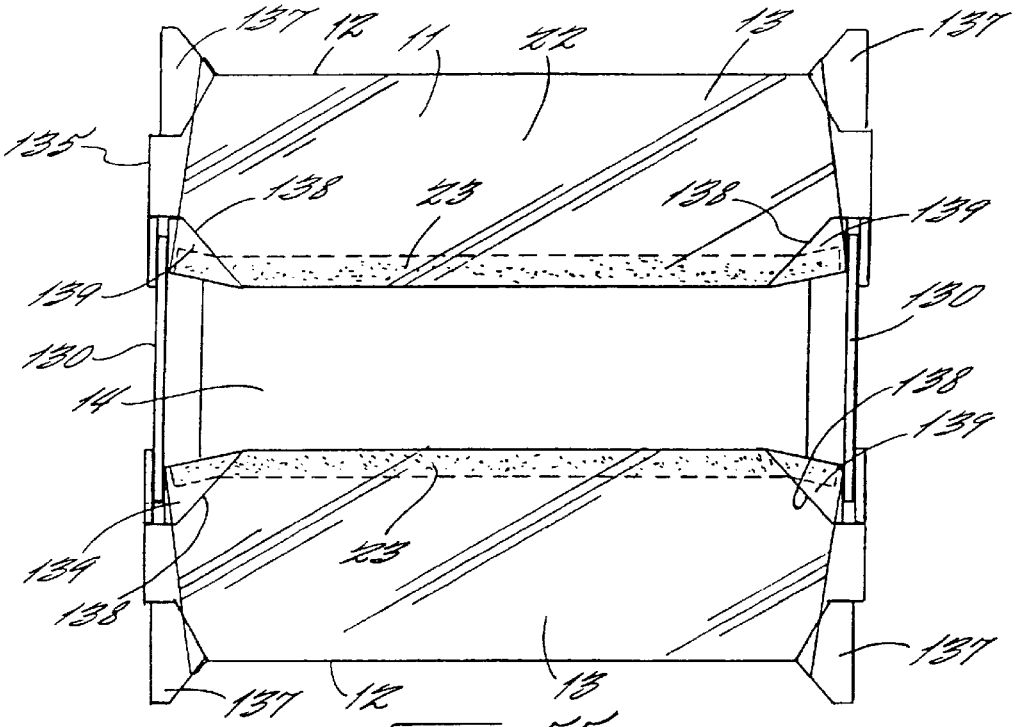
FIG. 55 is a bottom view of the twenty-third embodiment.

A twenty-third embodiment of the present invention is illustrated in FIGS. 53, 54 and 55. This particular embodiment is beneficial for packaging structures wherein it is desirable to position the object O so that it is removed from the bottom and/or from the sides of the box assembly within which it is placed. FIG. 54 represents the rigid panel 11 in its unfolded condition. The rigid panel 11 includes a first pair of generally parallel fold lines 12 which define folding side portions 13 similar to those of the previous embodiments. A second pair of fold lines 15 are generally parallel to one another and generally perpendicular to the first pair of fold lines 12. The second fold lines 15 define a pair of folding end portions 16 positioned on either side of the center portion 14. The first and second fold lines, 12 and 15, respectively, define the center panel portion 14 and four intersecting corner panels 135.

According to this embodiment, the film 22 extends across the center panel portion 14 and extends across the pair of first fold lines 12. The film 22 is secured by a pair of glue strips 23 positioned adjacent the ends of the folding side portions 13. Any of the securing members according to any of the previous embodiments may also be employed with this embodiment.

The pair of second fold lines 15 each include a tab-defining cut 127 so as to each define a first lock tab 130 on the respective folding end portion 16. As illustrated in FIG. 54, inner portions of the second fold line 15 extend in opposite directions from an edge of the first lock tab 130 to a patterned cut 136 described in more detail below. Outer portions of the second fold line 15 extend outwardly from the respective patterned cut 136 but do so at a greater distance from the edge 24 of the film 22 than the inner portions. A first cut 134 extends outward from a location adjacent the unsecured edge 24 of the film 22 and extends substantially perpendicular to the second fold line 15. A second cut 133 extends from the first cut 134 to the outer edge of the intersecting corner panel 135. Preferably, the second fold lines 15 are scored or perforated but the cuts 133,134 are continuously cut through all layers of the rigid panel 11.

The first fold lines 12 extend across the rigid panel 11 and are interrupted by a pair of lateral extensions 137 which are defined by the patterned cut 136. The lateral extensions 137 extend laterally outward from the first fold lines 12 when the folding side portions 13 are folded away from the film 22, i.e., downward. A pair of third fold lines 138 are provided on each of the folding side portions 13 and each extends angularly from the respective first cut 134 to the outer edge of the folding side portion 13. Preferably, the third fold lines 138 are scored but they may alternatively be perforated. The third fold lines 138 therefore each define a pair of second lock tabs 139.

Thus, when the rigid panel 11 is folded, the folding side portions 13 are folded downwardly about the first fold lines 12, in a direction away from the film 22. The folding end portions 16 are then folded along the second fold lines 15 and are folded upwardly towards the film 22. Accordingly, the first pair of lock tabs 130 extend downwardly from the center panel portion 14. As can be seen in FIG. 55, the first pair of lock tabs 130 contact the second pair of lock tabs 139 when folded about the second fold line 15 such that the second lock tabs fold slightly downwardly along the third fold lines 138. The first pair of lock tabs 130 extend through cuts 133,134 and thereby lock the tabs securely together and the folding side portions 13 and end portions 16 in their respective positions.

When the packaging structure 10 is positioned within a box, the first pair of lock tabs 130 extend vertically and position the center panel portion 14 above the base of a box assembly. Furthermore, the lateral extensions 137 maintain the center panel portion 14 at a distance from adjacent sides of the box assembly. The object O is thus spaced from the box in all three dimensions.

Figure 56:
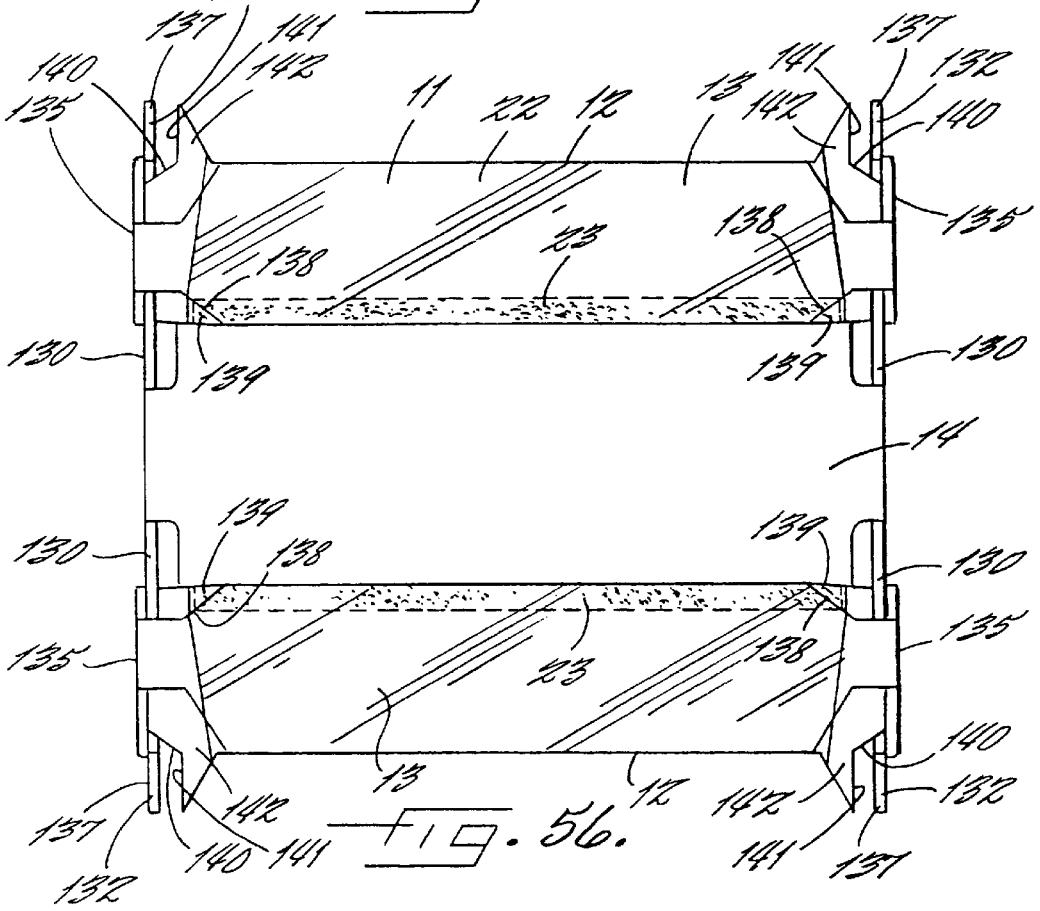
FIG. 56 is a bottom view of a twenty-fourth embodiment of the present invention.
Figure 57:
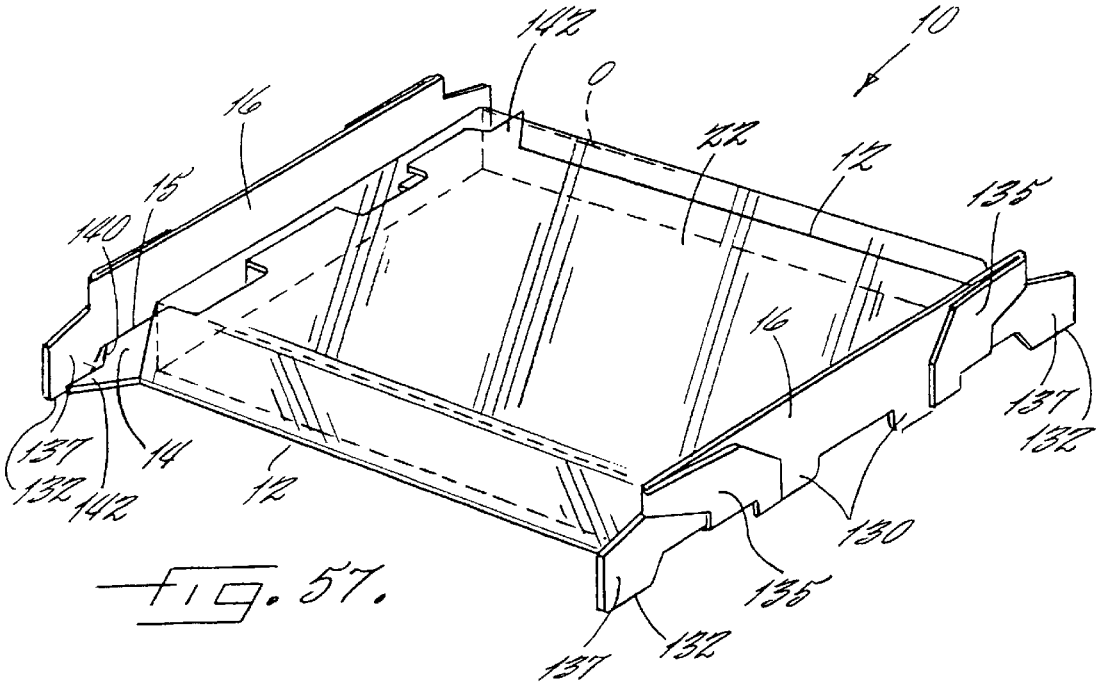
FIG. 57 is a perspective view of the twenty-fourth embodiment of the present invention.
Figure 58:
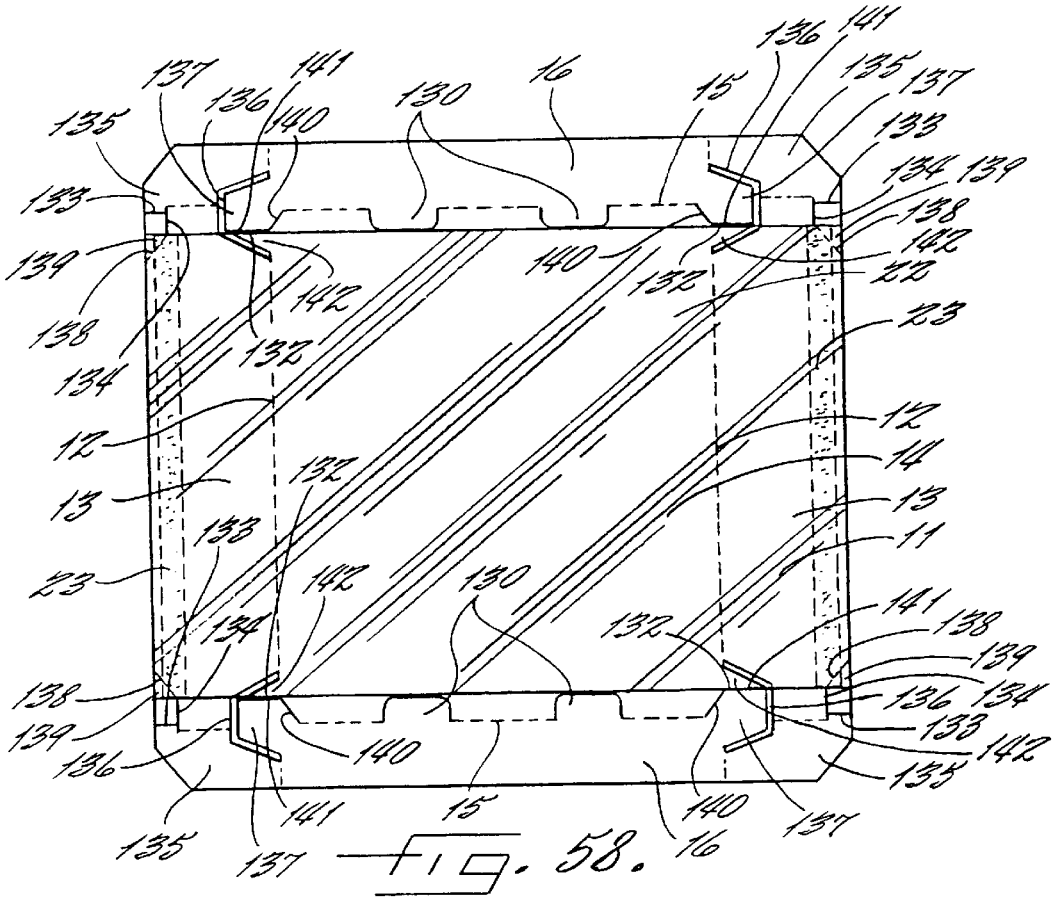
FIG. 58 is a top plan view of the twenty-fourth embodiment.

The twenty-fourth embodiment of the present invention is illustrated in FIGS. 56, 57 and 58. This embodiment is similar to the twenty-third embodiment in that the rigid panel 11 includes a first pair of fold lines 12 and a second pair of fold lines 15 which define the center portion 14 therebetween and which also define intersecting corner panels 135. According to this embodiment, the second pair of fold lines 15 each define a pair of first lock tabs 130. Each of the second fold lines 15 do not intersect the pair of first fold lines 12. Rather, the end of each second fold line 15 terminates at an angular cut 140 which leads to a parallel cut 141 parallel to the second fold lines 15. The parallel cut 141 extends from the angular cut 140 towards the edge of the folding side portion 13. The angular cut 140 and the parallel cut 141 define lateral extensions 137 on each of the folding end portions 16. These lateral extensions 137 position the packaging structure 10 within a box assembly similar to the previous embodiment.

Each of the first fold lines 12 is discontinuous and intersects with a pair of patterned cuts 136 located on each of the folding side portions 13. A portion of the patterned cut 136 extends on the respective folding side portion 13 beyond the unsecured edge 24 of the film 22. This portion of the patterned cut 136, together with the parallel cut 141, define a respective pair of flat surfaces 132 on each of the lateral extensions 137. These flat surfaces 132 vertically stabilize the folded panel 11 and prevent it from rocking back and forth on the base surface of the box. In addition, on the opposite sides of the parallel cuts 141, film guides 142 are formed which cinch the film 22 laterally adjacent the first fold lines 12 and maintain it tightly over the object O when it is positioned upon the center portion 14.

The patterned cuts 136 in this and the previous embodiment include spaced apart cut lines such that material is removed when the patterned cut is formed. This provides clearance for the portions adjacent the cut lines when they are so folded so that no undesirable binding occurs. Similar to the previous embodiment, this embodiment also includes a pair of third fold lines 138 and first and second cuts 134,133 which define a pair of second lock tabs 139 adjacent each of the intersecting corner panels 135. The interlocking feature for this embodiment can be seen in FIG. 56. Preferably, the portion of the second fold lines 15 defining the first pair of lock tabs 130 are defined by a cut, i.e., extending through all layers of the rigid panel 11, and the portions of the second fold line 15 on either side of the first lock tabs 130 are perforated.

Figure 59:
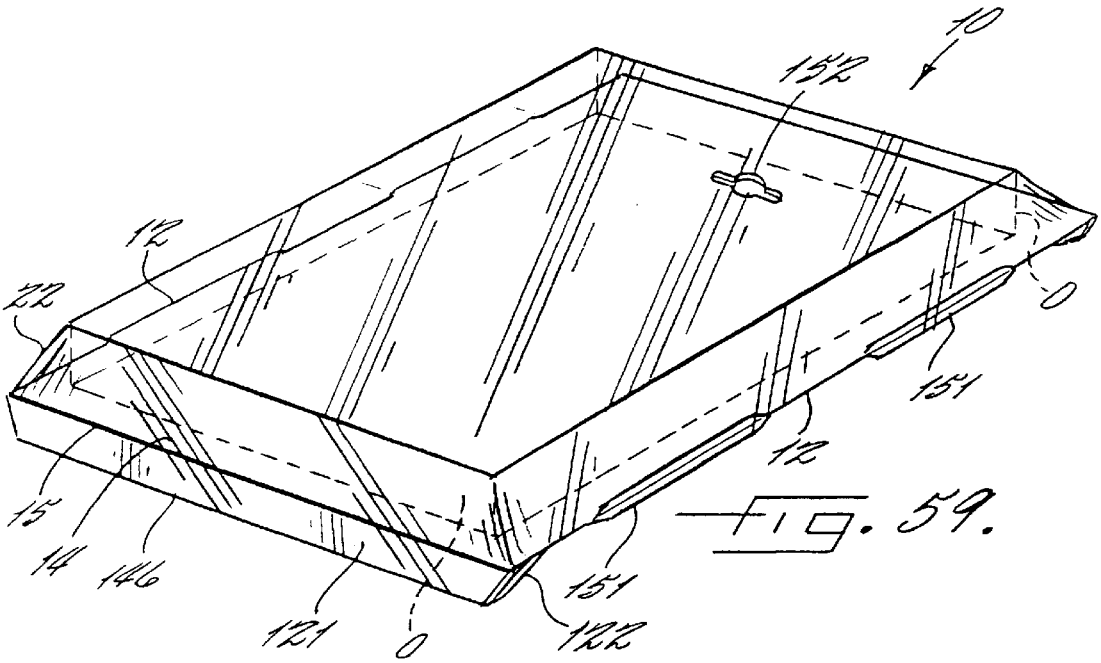
FIG. 59 is a perspective view of a twenty-fifth embodiment of the present invention.
Figure 60:
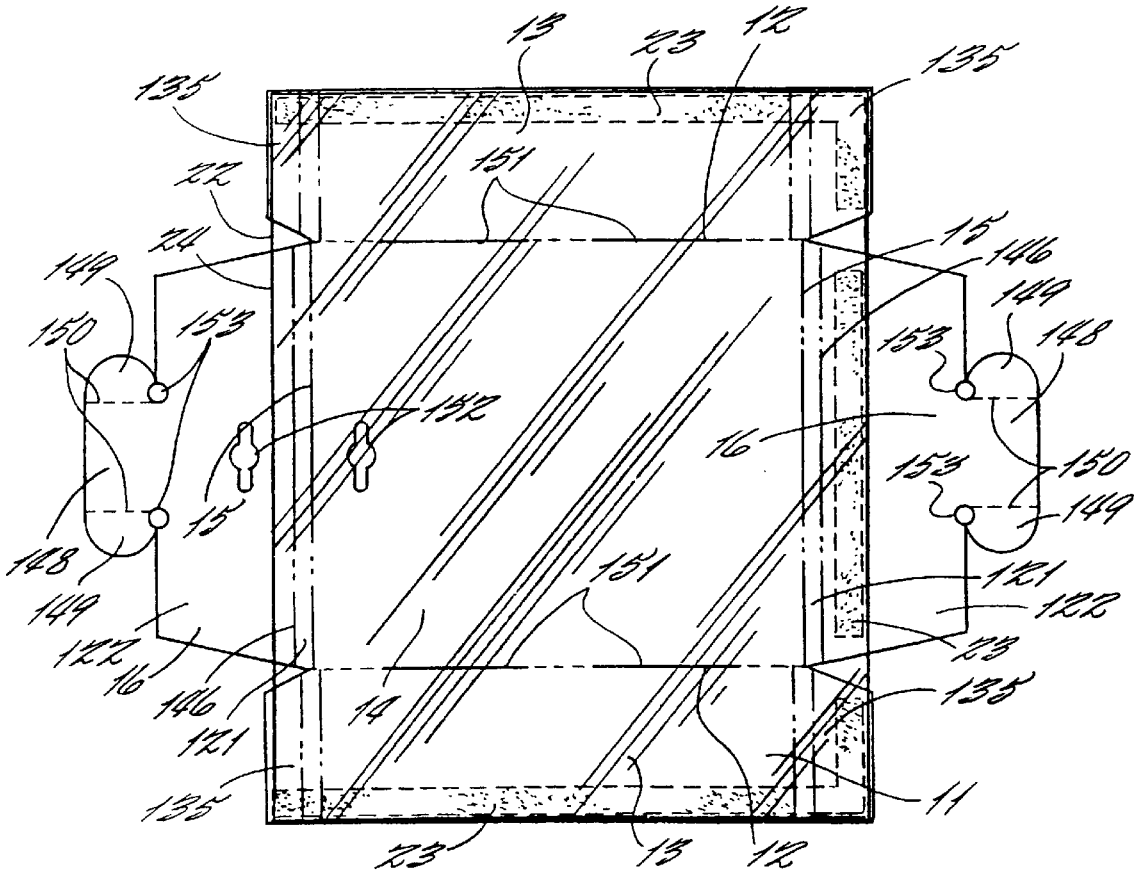
FIG. 60 is a top plan view of the twenty-fifth embodiment.

A twenty-fifth embodiment is illustrated in FIGS. 59 and 60. This embodiment differs from previous embodiments in that it is not necessary to position the packaging structure 10 within an external box for storage, transportation or display. According to this embodiment, the packaging structure 10 retains and displays the object O between the film 22 and the center portion 14 and, when folded, the packaging structure 10 may solely be used to display the object O.

More specifically, the packaging structure includes a first pair of fold lines 12 which are generally parallel to one another and a second pair of fold lines 15 which are also generally parallel to one another and which intersect the first fold lines 12 so as to define intersecting corner panels 135. The glue strips 23, according to this embodiment, substantially secure three sides of the film 22, that is, along the edges of each of the folding side portions 13 and along a respective edge of one of the folding end portions 16. Preferably, the glue strips 23 extend substantially along the length of each of the folding side portions 13 and substantially along the edge of the intersecting corner panels 135 and across one of the folding end portions 16.

Each of the folding end portions 16 further includes a third pair of fold lines 146 which extends substantially parallel to the second pair of fold lines 15. Preferably, the first fold lines 12 include at least one and, preferably, a pair of first fold line cuts 151. The remainder of the first fold lines 12 may be scored, whereas the second 15 and third 146 fold lines may be perforated, or vice versa, or both. The third fold lines 146 define the proximal end segment 121 and the distal end segment 122. The distal end segments 122 of the folding end portions 16 each include a lock tab 148. The lock tabs 148 each include a fourth pair of fold lines 150 which define, on each lock tab 148, a pair of lock extensions 149. Preferably, the fourth lines 150 are scored but they may alternatively be perforated. A hang tag aperture 152 is defined by the center portion 14 and also by a respective one of the folding end portions 16.

As such, the folding side portions 13 may be folded upward, towards the film 22, to relax the film adjacent the center portion 14 wherein the object O may be inserted beneath the unsecured edge 24 of the film. The folding side portions 13 may then be folded downward, away from the film 22 so as to be substantially flush with the rear side of the center portion 14. The cuts 151 facilitate a more complete folding thereof.

The second 15 and third 146 fold lines extend across the intersecting corner panels 135 but each is slightly offset. More specifically, the portion of the second fold line 15 which extends across the intersecting corner panel 135 is parallel to the portion of the second fold line 15 which extends across the folding end portions 16, but is not in alignment therewith. The same is true for the third fold lines 146. These offsets are to account for the finite thicknesses of the individual layers when folded together.

The folding end portions 16 may then be folded downward away from the film 22 so as to be substantially flush with the already folded side portions 13. The combination of the second fold lines 15 and the third fold lines 146, which define an intermediate portion therebetween, facilitate the folding of the end portions 16 around the side portions 13. Thus, the intermediate section defined therebetween is substantially perpendicular to the center portion 14 as well as perpendicular to the distal end segment 122 of the folding end portion 16.

The lock extensions 149 may then be folded along the fourth pair of fold lines 150 and inserted between the folded side portions 13 and the rear side of the center portion 14. A pair of apertures 153 facilitate the folding and insertion thereof. Accordingly, the lock tabs 148 secure the folding end portions 16 over the folding side portions 13. When folded, the hang tab apertures 152 of the center portion 14 and the respective folding end portions 16 are correspondingly configured and positioned so that when the packaging structure 10 is fully folded, an aperture extends fully through the rigid panel 11 of the packaging structure 10. As such, the folded packaging structure 10 with the object O received and retained therein, may then be displayed or stored by insertion of, for example, a hanger which extends through the hang tab apertures 152.

Figure 61:
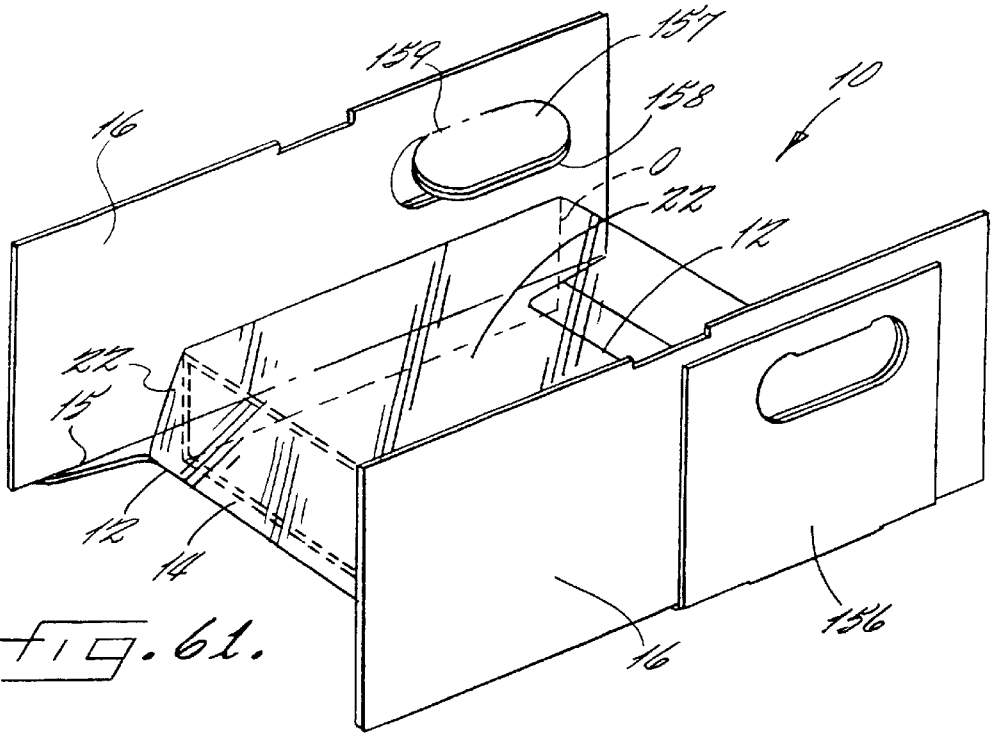
FIG. 61 is a perspective view of a twenty-sixth embodiment of the present invention.
Figure 62:
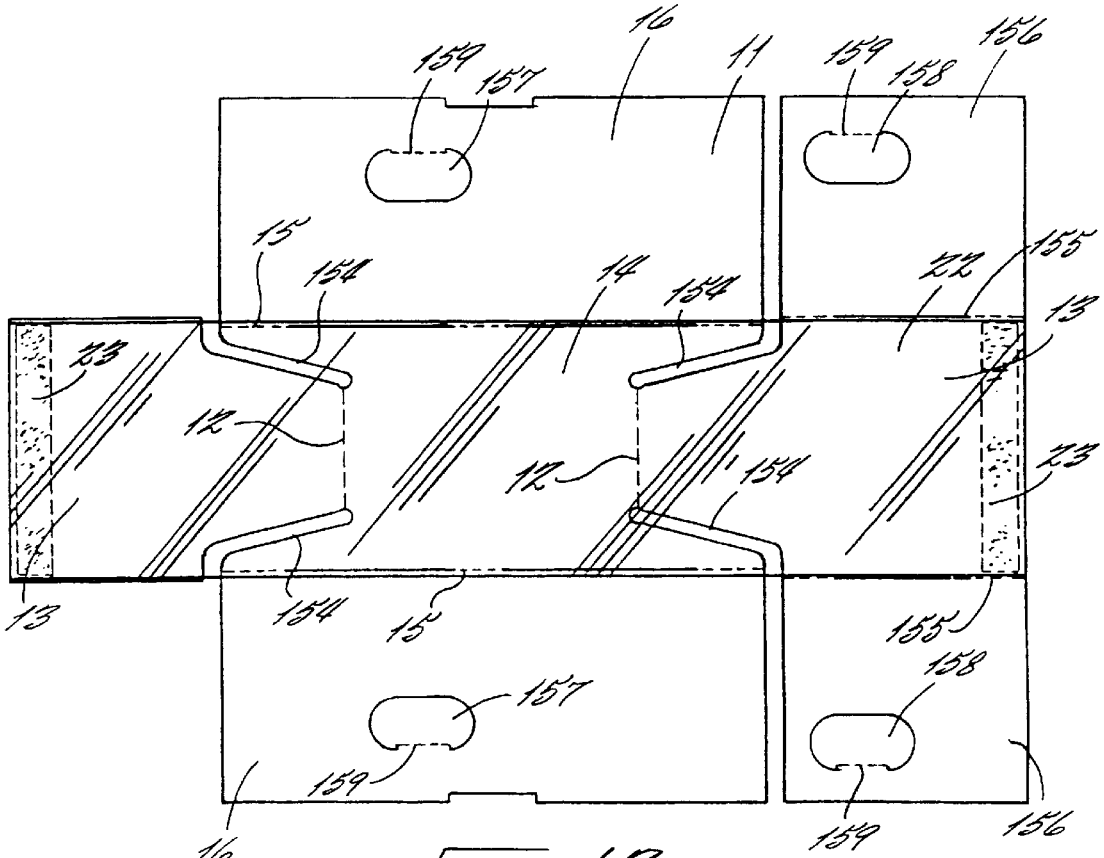
FIG. 62 is a top plan view of the twenty-sixth embodiment.

The twenty-sixth embodiment of the present invention is represented by FIGS. 61 and 62. The packaging structure 10 according to this embodiment includes a first pair of fold lines 12 and a second pair of fold lines 15. The second pair of fold lines 15 define therebetween the center portion 14. The second fold lines 15 also define folding end portions 16 on either side of the center portion 14 and the first fold lines 12 define folding side portions 13 on each side of the center portion 14. The film 22 extends from one folding side portion 13 to the other folding side portion, across the center portion 14. Glue strips 23 are provided on each folding side portion 13.

The center portion 14 is defined by the second fold lines 15 on opposing ends thereof and on each side by the first fold lines 12 and by a pair of patterned cuts 154. As illustrated, the patterned cuts 154 extend from the edge of the respective folding end portion 16 inward, towards the area of the center portion 14 upon which the object O is positioned. The pair of first fold lines 12 extend between a respective pair of patterned cuts 154.

Extending outwardly from either side of at least one of the folding side portions 13 is a pair of lateral end portions 156. The lateral end portions 156 are defined by a third pair of fold lines 155, one each extending along the folding side portion 13, substantially parallel to the second fold lines 15.

The folding end portions 16 include cuts defining a first pair of handle tabs 157. The lateral end portions 156 each define one of a second pair of handle tabs 158. Both the first and second pair of handle tabs 157 and 158 include a handle fold line 159 which extends along the base thereof. Preferably, the first and second handle tabs 157 and 158 are similarly configured.

In operation, the folding side portions 13 are folded upwardly along the first fold lines in a direction towards the film 22 to relax the same. Thus, an object O may be positioned between the film 22 and the center portion 14. The folding side portions 13 are then folded downwardly wherein the folding side portion without the lateral end portions 156 is folded so as to be substantially flush with the rear side of the center portion 14. The other folding side portion 13 is then folded so as to lie substantially flush over the first folding side portion 13. The folding end portions 16 are then folded upwardly towards the film 22 covering the object O. As such, the lateral end portions 156 are likewise folded upward.

The packaging structure 10 may be secured in the folded position by aligning the first and second pair of handle tabs 157 and 158 and folding the tabs in the same direction, e.g., inward. When the handle tabs are folded along the handle fold lines 159, apertures are provided which assist in handling and positioning of the packaging structure 10 such as when it is placed within an external box. In addition, the handle tabs 157 and 158 will create an interlocking arrangement when folded in the same direction. Alternatively, one or no handle tabs 157 or 158 may be provided wherein, in place thereof, an aperture will be provided.

In the drawings and specification, there have been disclosed typical preferred embodiments of the invention and, although specific terms have been employed, they have been used in a generic and descriptive sense only and not for purposes of limitation, the scope of the invention being set forth in the following claims.

What is claimed is:

1. A packaging structure for holding an object securely against a rigid backing, said packaging structure comprising:

a substantially rigid panel having a first pair of fold lines spaced from opposite side edges of said panel to define respective folding side portions;

a second pair of fold lines spaced from opposite end edges of said rigid panel and oriented transverse to said first pair of fold lines, said second pair of fold lines defining respective folding end portions, said first and second pairs of fold lines delimiting a center portion of said rigid panel;

a first additional fold line in each of said folding side portions defining proximal and distal side segments in each of said folding side portions;

a second additional fold line in each of said folding end portions defining proximal and distal end segments in each of said folding end portions;

a flexible film material having opposed ends, said film material being superimposed on one surface of said rigid panel and extending over said center portion and past at least one of said first pair of fold lines onto one of said folding side portions of said rigid panel, said opposed ends of said film material being connected to said rigid panel so as to define at least one region in which an edge portion of said film material between said opposed ends is not secured to said rigid panel, whereby at least a portion of an object may be positioned between said rigid panel and said film material and said film material may be tightened against at least the portion of the object when at least one of said folding side portions is folded away from said film material.

2. A packaging structure according to claim 1, further comprising an auxiliary fold line in each of said distal end segments.

3. A packaging structure according to claim 1, wherein each of said distal end segments has a predetermined dimension between said second additional fold line and said end edge of said panel, and each of said proximal end segments has a width between said second fold line and said second additional fold line which is less than said predetermined dimension.

4. A packaging structure according to claim 1, wherein said center portion of said rigid panel is substantially continuous.

5. A packaging structure according to claim 1, wherein said unsecured edge portion of said film material is adjacent to one of said second fold lines.

6. A packaging structure according to claim 1, further comprising a patterned cut in each of said folding side portions for defining a tab in each of said folding side portions, said tabs projecting towards said film material and separating said film material from said center portion of said rigid panel when said folding side portions are folded away from said film material.

7. A packaging structure according to claim 6, wherein each of said tabs is defined at least in part by said proximal side segment of said folding side portion.

8. A packaging structure according to claim 7, wherein each of said tabs is defined by said proximal and distal side segments of said folding side portion.

9. A packaging structure according to claim 6, wherein each of said folding side portions includes a further fold line which defines a base of said tab, wherein said tab is foldable relative to said folding side portion.

10. A packaging structure according to claim 9, wherein said tab extends from said base and terminates at a free end spaced from said first fold line, said free end of said tab being positionable above said center portion when said folding side portion is folded downward relative to said center portion.

11. A packaging structure for holding an object securely against a rigid backing, said packaging structure comprising:

a substantially rigid panel having a first pair of fold lines spaced from opposite side edges of said panel to define respective folding side portions and a center portion therebetween;

an additional fold line in each of said folding side portions defining proximal and distal folding segments in each of said folding side portions;

a flexible film material having opposed ends, said film material being superimposed on one surface of said rigid panel and extending over said center portion and past at least one of said first pair of fold lines onto one of said folding side portions of said rigid panel, said opposed ends of said film material being connected to said rigid panel so as to define at least one region in which an edge portion of said film material between said opposed ends is not secured to said rigid panel, whereby at least a portion of an object may be positioned between said rigid panel and said film material and said film material may be tightened against at least the portion of the object when at least one of said folding side portions is folded away form said film material; and a patterned cut in each of said folding side portions for defining a tab in each of said folding side portions, said tabs projecting towards said film material and separating said film material from said center portion of said rigid panel when said folding side portions are folded away from said film material.

12. A packaging structure according to claim 11, wherein each of said tabs is defined at least in part by said proximal segment of said folding side portion.

13. A packaging structure according to claim 12, wherein each of said tabs is defined by said proximal and distal segments of said folding side portion.

14. A packaging structure according to claim 11, wherein each of said folding side portions includes a further fold line which defines a base of said tab, wherein said tab is foldable relative to said folding side portion.

15. A packaging structure according to claim 14, wherein said tab extends from said base and terminates at a free end spaced from said first fold line, said free end of said tab being positionable above said center portion when said folding side portion is folded downward relative to said center portion.

16. A method of packaging an object in a packaging structure including a substantially rigid panel having a pair of folding side portions defined by a first pair of fold lines and a center portion between said pair of folding side portions, a patterned cut defining a tab in each of said folding side portions, each tab being connected to one of said folding side portions by a further fold line, and a flexible film material superimposed on one surface of said rigid panel and having opposed ends secured to said rigid panel with at least one end secured to one of said folding side portions so as to define at least one region in which an edge portion of said film material between said ends is not secured to said rigid panel, the method comprising:

clearing said film material away from said center portion of said rigid panel;

placing at least a portion of said object between said film material and said center portion of said rigid panel;

folding said folding side portions along said first fold lines in a direction away from said film material and along said further fold lines so that said tabs project upwardly relative to said center portion and raise said film material relative to at least said portion of said object.

17. A method of packaging an object according to claim 16, wherein said step of clearing said film material includes the step of folding said folding side portions in a direction towards said film material.

* * * * *